US006379497B1

(12) United States Patent
Sandstrom et al.

(10) Patent No.: US 6,379,497 B1
(45) Date of Patent: Apr. 30, 2002

(54) BULK ENHANCED PAPERBOARD AND SHAPED PRODUCTS MADE THEREFROM

(75) Inventors: Erland Sandstrom, Menasha; Kenneth J. Shanton, Neenah; Dean Swoboda, DePere, all of WI (US)

(73) Assignee: Fort James Corporation, Deerfield, IL (US)

( * ) Notice: Subject to any disclaimer, the term of this patent is extended or adjusted under 35 U.S.C. 154(b) by 0 days.

(21) Appl. No.: 09/314,767

(22) Filed: May 19, 1999

Related U.S. Application Data

(63) Continuation-in-part of application No. 08/896,239, filed on Jul. 17, 1997, now abandoned, which is a continuation-in-part of application No. 08/716,511, filed on Sep. 20, 1996, now abandoned.

(51) Int. Cl.[7] ..... D21H 27/30

(52) U.S. Cl. ..... 162/123; 162/125; 162/127; 162/129; 162/130; 162/135; 162/137; 162/158

(58) Field of Search ..... 162/123, 125, 162/127, 129, 130, 135, 137, 158

(56) References Cited

U.S. PATENT DOCUMENTS 4,619,734 A * 10/1986 Anderson ..... 162/111
4,913,775 A * 4/1990 Langley et al. ..... 162/164.3
5,514,429 A * 5/1996 Kamihgaraguchi et al. ..... 428/34.2

* cited by examiner

*Primary Examiner*—Peter Chin
(74) *Attorney, Agent, or Firm*—Finnegan, Henderson, Farabow, Garrett & Dunner, L.L.P

(57) ABSTRACT

An improved paperboard has been bulk enhanced by retaining a substantial portion of bulk-enhanced additives including expandable microspheres in a suitable distribution within the paperboard. The cellulosic paperboard web has an overall fiber weight (w) of at least 40 lbs./3000 square feet and at a fiber density of 3, 4.5, 6.5, 7, 8.3, and 9 pounds per 3000 square foot ream at a fiberboard thickness of 0.001 inch respectively, has a GM Taber stiffness of at least about $0.00716\ w^{2.63}$ grams-centimeter/fiber mat density$^{1.63}$ pounds per 3000 square foot ream at a fiberboard thickness of 0.001 inch, and a GM tensile stiffness of at least about 1890+24.2 w pounds per inch. The high retention of the bulk enhancing additives is believed to result from the incorporation of suitable retention aids. The resulting paperboard has better GM Taber stiffness values and GM tensile stiffness than prior art paperboards. The paperboard also has increased strain to failure and is able to be formed into suitable paperboard containers without loss of integrity. The resulting containers have increased hold times when they contain hot or cold food or drink.

69 Claims, 41 Drawing Sheets

1. DENSITY VALUES SHOWN ARE FIBER MAT DENSITIES. (FIBER WEIGHT/CALIPER)

1. DENSITY VALUES SHOWN ARE FIBER MAT DENSITIES. (FIBER WEIGHT/CALIPER)

1. EXPANCEL RETENTION WITH APOLLO + RETEN=83%
2. EXPANCEL RETENTION WITHOUT APOLLO +RETEN=36%

PLATE

PLATE

PLATE

PLATE

BOWL

BOWL

CANISTER

CANISTER

FRENCH FRIES SLEEVE

HAMBURGER CLAMSHELL

HAMBURGER CLAMSHELL

RECTANGULAR TAKE-OUT CONTAINER

RECTANGULAR TAKE-OUT CONTAINER

CUP

CUP

FOOD BUCKET

FOOD BUCKET

BOWL WITH MICROWAVE SUSCEPTOR LAYER

BOWL WITH MICROWAVE SUSCEPTOR LAYER

CUP WITH ADDITIONAL INSULATION FEATURE

EXPANDED CROSS-SECTION THROUGH SIDEWALL

1. DENSITY VALUES SHOWN ARE FIBER MAT DENSITIES. (FIBER WEIGHT/CALIPER)

1. DENSITY VALUES SHOWN ARE FIBER MAT DENSITIES. (FIBER WEIGHT/CALIPER)

BULK ENHANCED PAPERBOARD AND SHAPED PRODUCTS MADE THEREFROM

RELATED APPLICATION

This is a continuation in part application of Ser. No. 08/896,239 filed on Jul. 17, 1997 now abandoned, which is a continuation in part of Ser. No. 08/716,511 filed on Sep. 20, 1996 now ABN.

BACKGROUND OF THE INVENTION

Cellulosic paperboard must reconcile several conflicting properties to be useful for the manufacture of plates, cups, bowls, canisters, French fry sleeves, hamburger clam shells, rectangular take-out containers, and related articles of manufacture. The paperboard has to have good thermal resistance, improved formability, and, to be economical, reduced board weight, or, for premium applications, increased container rigidity. The fiber weight (hereinafter "w") of the paperboard should be at least about forty pounds for each three thousand square foot ream. Fiber weight is the weight of fiber in pounds for each three thousand square foot ream. The fiber weight is measured at standard TAPPI conditions which provide that the measurements take place at a fifty percent relative humidity at seventy degrees Fahrenheit. In general, the fiber weight of a 3000 square foot ream is equal to the basis weight of such a ream minus the weight of any coating and/or size press. The fiber mat density of the paperboard of this invention is in the range of about 3 to 9 pounds per 3000 square foot ream at a fiberboard thickness of 0.001 inch. The preferred fiber mat density is in the range of about 4.5 to 8.3 pounds per 3000 square foot ream at a fiberboard thickness of 0.001 inch. To achieve the superior properties of our novel cellulosic paperboard, it has been discovered that the board at a fiber mat density of 3, 4.5, 6.5, 7, 8.3, and 9 pounds per 3000 square foot ream at a fiberboard thickness of 0.001 inch, should have a GM Taber stiffness of at least 0.00716 $w^{2.63}$ grams-centimeters/fiber mat density$^{1.63}$ pounds per 3000 square foot ream at a fiberboard thickness of 0.001 inch, and a GM tensile stiffness of at least about 1890+24.2 w pounds per inch. The preferred GM Taber stiffness value for paperboards having the fiber mat density given above is 0.00501 $w^{2.63}$ grams-centimeter/fiber mat density$^{1.63}$ pounds per 3000 square foot ream at a fiberboard thickness of 0.001 inch, and the GM tensile stiffness is 1323+24.2 w pounds per inch. The high GM Taber stiffness values listed are desired to facilitate the bending of the paperboard into the aforementioned articles of manufacture and to provide these articles with greater rigidity. Likewise the high GM Taber and GM tensile stiffness prevents the plates, cups, and other articles of manufacture from collapsing when used by the consumer. The articles of manufacture can suitably be prepared from either one-ply or multi-ply paperboard as disclosed herein. The present invention provides one-ply and multi-ply paperboard comprising (a) predominantly cellulosic fibers, (b) bulk and porosity enhancing additive interspersed with the cellulosic fibers in a controlled distribution throughout the thickness of the paperboard, and (c) size press applied binder coating optionally including a pigment adjacent both surfaces of the paperboard and penetrating into the board to a controlled extent. The amount of size press applied is at least one pound for each three thousand square foot ream of paperboard having a fiber mat density of about 3 to below 9 pounds per 3000 square foot ream at a fiberboard thickness of 0.001 inch. For boards having a fiber mat density of 9 pounds per 3000 square foot ream at a fiberboard thickness of 0.001 inch or a greater density, the amount of size press applied should be at least six pounds for each three thousand square foot ream. The overall fiber weight of the paperboard is at least 40 lbs. per 3000 square foot ream, suitably 60 to 320 lbs. per 3000 square foot ream, preferably 70 to 240 lbs. per 3000 square foot ream, most preferably 80 to 220 lbs. per 3000 square foot ream, and the distribution of the bulk and porosity enhancing additive is controlled so that at least twenty percent of the additive is distributed in the central layer and not more than 75 percent of the additive is distributed on the periphery of the paperboard with no periphery having more than twice the percent of the additive distributed in the central layer of the paperboard. The penetration of the size press applied binder and optionally pigment coating into board is controlled to produce a cellulosic fiber board web having at a fiber mat density of 3, 4.5, 6.5, 7, 8.3, and 9 pounds per 3000 square foot ream at a fiberboard thickness of 0.001 inch, a GM Taber stiffness respectively of at least 0.00716 $w^{2.63}$ grams-centimeter/fiber mat density$^{1.63}$ pounds per 3000 square foot ream at a fiberboard thickness of 0.001 inch, and GM tensile stiffness of about 1890+24.2 w pounds per inch. The preferred GM Taber stiffness for the paperboard of this invention having a fiber mat density of 3, 4.5, 6.5, 7, 8.3, and 9 pounds per 3000 square foot ream at a fiberboard thickness of 0.001 inch is 0.00501 $w^{2.63}$ grams-centimeter/fiber mat density$^{1.63}$ pounds per 3000 square foot ream at a fiberboard thickness of 0.001 inch, and the preferred GM tensile stiffness is 1323+24.2 w pounds per inch. The GM tensile and GM Taber values for the web and one-ply board are the same. For multi-ply board the overall paperboard GM Taber stiffness and GM tensile stiffness are the same as for a one-ply paperboard. The aforementioned combination of GM Taber stiffness and GM tensile stiffness provides a paperboard which can readily be converted to useful high quality cups, plates, compartmented plates, bowls, canisters, French fry sleeves, hamburger clam shells, rectangular take-out containers, food buckets, and other consumer products and useful articles of manufacture including cartons and folding paper boxes. This paperboard is also particularly suitable for the manufacture of heat insulating paperboard containers having on their wall surfaces a foamed layer of a thermoplastic film such as a polyethylene.

FIELD OF INVENTION

This invention relates to an improved paperboard, to improved shaped paperboard products, and to methods of making such paperboard and shaped paperboard products including heat insulating paperboard containers such as cups having as their wall surface a foamed layer of a thermoplastic film. More particularly, this invention is directed to an improved bulk-enhanced paperboard, to methods of making such an improved paperboard, and to shaped paperboard products made from such improved paperboard.

DESCRIPTION OF BACKGROUND ART

Prior art has not been able to produce a paperboard having the GM Taber stiffness and GM tensile of the board of this invention. Prior art bulk-enhanced paper products, such as those disclosed in U.S. Pat. Nos. 3,941,634 and 3,293,114, resulting from the addition of expandable microspheres and other bulk enhancing additives and methods for making such paper suffer from a number of drawbacks. For example, one persistent problem in such papers is poor retention of the expandable microspheres or other bulk enhancing additives on the embryonic paper web made in the course of manufacturing the paperboard. This poor retention results in relatively low bulk enhancement of the resulting paperboard per unit weight of bulk enhancing additive added, making the enhancement process unnecessarily costly. A further problem resulting from the poor retention of microspheres and other bulk enhancers experienced in prior art bulk enhancement methods is fouling of the papermaking apparatus with unretained microspheres and other bulk enhancing additives.

A related problem associated with the addition of microspheres and other bulk enhancing additives in the papermaking process is their uneven distribution within the resulting paperboard. Paperboards prepared using prior art enhancement techniques have exhibited a decided asymmetry, with microspheres and other bulk enhancing additives migrating to one of the outer surfaces of the paper web and causing undesired roughness in the surface of the finished paper and hence interference with the smooth and efficient operation of the papermaking apparatus.

The void volume provided by the microspheres reduces the rate of thermal transfer within the paper, which is desirable in many applications. However, the asymmetric distribution of microspheres experienced in the prior art produces uneven thermal insulating characteristics.

In addition, prior art has not created a satisfactory bulk-enhanced paperboard. Prior art products tend to have low thermal insulative properties. The excessive concentration of microspheres at the paper surface creates dusting, which interferes with the operation of printing presses in which the paperboard is used. The printability of the paperboard itself, that is, the satisfactory retention of printed matter on the paperboard, is also adversely affected by such dusting.

Prior art attempts at addressing the above and other drawbacks and disadvantages of paper containing microspheres and other bulk enhancing additives have been unsatisfactory and have had their own drawbacks and disadvantages. For example, in U.S. Pat. No. 3,941,634 Nisser attempts to address the inadequate retention and non-uniform distribution of microspheres by sandwiching the microspheres between two paper webs formed on two wire screens. The introduction of the second paper web adds complexity and expense to the papermaking process. Furthermore, the Nisser process generally does not optimize thermal insulation characteristics because it does not produce a sufficiently even distribution of microspheres within the resulting paper. The same problems are encountered in U.S. Pat. No. 3,293,114 and make the use of current bulk-enhanced papers in thermal insulation applications problematic.

Another attempted solution to the above and other drawbacks and disadvantages of paper containing microspheres has been to employ a surface sizing formulation to "bury" the microspheres which would otherwise be found on the outer surface of the resulting paper. See for example, *Development of a Unique Lightweight Paper*, by George Treier, TAPPI Vol. 55, No. 5, May 1972. This approach, again, has failed to achieve the desired distribution and retention of microspheres, as well as other desirable paper characteristics. In addition to the expensive film forming materials described in the George Treier article, the Treier process increases the complexity and cost of manufacturing paperboard.

The process of making cups, plates, bowls, canisters, French fry sleeves, hamburger clam shells, rectangular take-out containers, food buckets, and other shaped paper articles by deforming bulk-enhanced paperboard to create the desired shapes also suffers from various drawbacks and disadvantages. Such paperboard is generally rendered substantially less deformable after being bulk-enhanced by the additions of microspheres. This reduced deformability interferes particularly with top curl forming in rolled brim containers made from bulk-enhanced paperboard. It also interferes with the drawing of cups, plates, bowls, canisters, French fry sleeves, hamburger clam shells, rectangular take-out containers, and food buckets, the reduced deformability in forming dies, and all other applications requiring deformation of bulk-enhanced paper generally and bulk-enhanced paperboard in particular.

Accordingly, there is a need for an improved, bulk-enhanced paperboard which retains a higher percentage of added bulk enhancers in the center layer of the board than has heretofore been achieved. There is a need for a cellulosic paperboard which at a fiber mat density of 3, 4.5, 6.5, 7, 8.3, and 9 pounds per 3000 square foot ream at a fiberboard thickness of 0.001 inch, has a GM Taber stiffness of at least about 0.00716 $w^{2.63}$ grams-centimeter/fiber mat density$^{1.63}$ pounds per 3000 square foot ream at a fiberboard thickness of 0.001 inch, and a GM tensile of 1890+24.2 w pounds per inch. The preferred GM Taber stiffness for the paperboard of this invention having a fiber mat density of 3, 4.5, 6.5, 7, 8.3, and 9 pounds per 3000 square foot ream at a fiberboard thickness of 0.001 inch is 0.00501 $w^{2.63}$ grams-centimeter/fiber mat density$^{1}$ 63 pounds per 3000 square foot ream at a fiberboard thickness of 0.001 inch, and the preferred GM tensile stiffness is 1323+24.2 w pounds per inch. At a fiber mat density of 3, 4.5, 6.5, 7, and 8.3 pounds per 3000 square foot ream at a fiberboard thickness of 0.001 inch, GM Taber stiffness is 0.00120 $w^{2.63}$ grams-centimeter/fiber mat density$^{1.63}$ pounds per 3000 square foot ream at a fiberboard thickness of 0.001 inch, 0.00062 $w^{2.63}$ grams-centimeter/fiber mat density$^{1.63}$ pounds per 3000 square foot ream at a fiberboard thickness of 0.001 inch, 0.00034 w2.63 grams-centimeter/fiber mat density$^{1.63}$ pounds per 3000 square foot ream at a fiberboard thickness of 0.001 inch, 0.00030 $w^{2.63}$ grams-centimeter/fiber mat density$^{1.63}$ pounds per 3000 square foot ream at a fiberboard thickness of 0.001 inch, and 0.00023 $w^{2.63}$ grams-centimeter/fiber mat density$^{1.63}$ pounds per 3000 square foot ream at a fiberboard thickness of 0.001 inch; the GM Taber stiffness is 1890+24.2 w pounds per inch. The preferred GM Taber stiffness values for a fiber mat density of 3, 4.5, 6.5, 7, and 8.3 pounds per 3000 square foot ream at a fiberboard thickness of 0.001 inch are respectively 0.0084 $w^{2.63}$ /grams-centimeter/fiber mat density$^{1.63}$ pounds per 3000 square foot ream at a fiberboard thickness of 0.001 inch, 0.00043 $w^{2.63}$ grams-centimeter/fiber mat density$^{1.63}$ pounds per 3000 square foot ream at a fiberboard thickness of 0.001 inch, 0.00024 $w^{2.63}$ grams-centimeter/fiber mat density$^{1.63}$ pounds per 3000 square foot ream at a fiberboard thickness of 0.001 inch, 0.00021 $w^{2.63}$ grams-centimeter/fiber mat density$^{1.63}$ pounds per 3000 square foot ream at a fiberboard thickness of 0.001 inch, and 0.00016 $w^{2.63}$ grams-centimeter/fiber mat density$^{1.63}$ pounds per 3000 square foot ream at a fiberboard thickness of 0.001 inch, at a GM tensile value of 1323+24.2 w pounds per inch. At a paperboard fiber mat density of 3, 4.5, 6.5, and 7 pounds per 3000 square foot ream at a fiberboard thickness of 0.001 inch, the GM Taber stiffness values are as follows: 0.00120 $w^{2.63}$ grams-centimeter/fiber mat density$^{163}$ pounds per 3000 square foot ream at a fiberboard thickness of 0.001 inch, 0.00062 $w^{2.63}$ grams-centimeter/fiber mat density$^{1.63}$ pounds per 3000 square foot ream at a fiberboard thickness of 0.001 inch, 0.00034 $w^{2.63}$ grams-centimeter/fiber mat density$^{1.63}$ pounds per 3000 square foot ream at a fiberboard thickness of 0.001 inch, and 0.00030 $w^{2.63}$ grams-centimeter/fiber mat density$^{1.63}$ pounds per 3000 square foot ream at a fiberboard thickness of 0.001 inch, and the GM tensile stiffness is 1890+24.2 w pounds per inch. The preferred GM Taber stiffness values for the foregoing fiber mat densities are 0.0084 $w^{2.63}$ grams-centimeter/fiber mat density$^{1.63}$ pounds per 3000 square foot ream at a fiberboard thickness of 0.001 inch, 0.00043 $w^{2.63}$ grams-centimeter/fiber mat density$^{1.63}$ pounds per 3000 square foot ream at a fiberboard thickness of 0.001 inch, 0.00024 $w^{2.63}$ grams-centimeter/fiber mat density$^{1.63}$ pounds per 3000 square foot ream at a fiberboard thickness of 0.001 inch, and 0.00021 $w^{2.63}$ grams-centimeter/fiber mat density$^{1.63}$ pounds per 3000 square foot ream at a fiberboard thickness of 0.001 inch, at the preferred GM tensile of 1323+24.2 w pounds per inch.

There is a further need for an efficient, economical method of ensuring a better distribution of bulk additives in paperboard intended for use in shaping containers and other products in which good insulating characteristics and deformability are desired.

There is a further need for bulk-enhanced paperboard whose manufacture does not cause fouling by unretained microspheres and which operates on conventional paper-making machinery without causing dryer sticking problems and without interfering with printing operations to which the paperboard may be exposed.

SUMMARY

Accordingly, one object of the present invention is to provide a bulk-enhanced paperboard meeting the above needs in which a high percentage of bulk enhancing additives are retained and in which those bulk enhancing additives are substantially uniformly distributed in the resulting bulk-enhanced paperboard.

This is accomplished in one embodiment of the invention by providing a cellulosic paperboard web comprising predominantly cellulosic fibers; bulk and porosity enhancing additive interspersed with said cellulosic fibers in a controlled distribution throughout the thickness of the paperboard and size press applied binder, optionally including a pigment coating adjacent both surfaces of the paperboard web and penetrating into the paperboard web to a controlled extent. The overall fiber weight "w" of the web being at least 40 lbs. per 3000 square foot ream for less stringent requirements such as French fry sleeves. For other applications, the suitable range is 60 to 320 lbs. per 3000 square foot ream, advantageously 70 to 320 lbs. per 3000 square foot ream, and preferably 80 to 220 lbs. per 3000 square foot ream. Both the distribution of the bulk and porosity enhancing additive throughout the thickness of the paperboard and the penetration of the size press applied binder and optionally pigment coating into the board being controlled to simultaneously produce, at a fiber density of 3, 4.5, 6.5, 7, 8.3, and 9 pounds per 3000 square foot ream at a fiberboard thickness of 0.001 inch, a GM Taber stiffness respectively of at least about 0.00716 $w^{2.63}$ grams-centimeter/fiber mat density$^{1.63}$ pounds per 3000 square foot ream at a fiberboard thickness of 0.001 inch, a GM tensile of 1890+24.2 w pounds per inch. The preferred GM Taber stiffness is 0.00501 $w^{2.63}$ grams-centimeter/fiber mat density$^{1.63}$ pounds per 3000 square foot ream at a fiberboard thickness of 0.001 inch, and the preferred GM tensile stiffness is 1323+24.2 w pounds per inch. At a fiber mat density of 3, 4.5, 6.5, 7, and 8.3 pounds per 3000 square foot ream at a fiberboard thickness of 0.001 inch, GM Taber stiffness is 0.00120 $w^{2.63}$ grams-centimeter/fiber mat density$^{1.63}$ pounds per 3000 square foot ream at a fiberboard thickness of 0.001 inch, 0.00062 $w^{2.63}$ grams-centimeter/fiber mat density$^{1.63}$ pounds per 3000 square foot ream at a fiberboard thickness of 0.001 inch, 0.00034 $w^{2.63}$ grams-centimeter/fiber mat density$^{1.63}$ pounds per 3000 square foot ream at a fiberboard thickness of 0.001 inch, 0.00030 $w^{2.63}$ grams-centimeter/fiber mat density$^{1.63}$ pounds per 3000 square foot ream at a fiberboard thickness of 0.001 inch, and 0.00023 $w^{2.63}$ grams-centimeter/fiber mat density$^{1.63}$ pounds per 3000 square foot ream at a fiberboard thickness of 0.001 inch, at a GM tensile stiffness of 1890+24.2 w pounds per inch. The preferred GM Taber stiffness values for a board having a fiber mat density of about 3, 4.5, 6.5, 7, and 8.3 pounds per 3000 square foot ream at a fiberboard thickness of 0.001 inch are 0.0084 $w^{2.63}$ grams-centimeter/fiber mat density$^{1.63}$ pounds per 3000 square foot ream at a fiberboard thickness of 0.001 inch, 0.00043 $w^{2.63}$ grams-centimeter/fiber mat density $^{1.63}$ pounds per 3000 square foot ream at a fiberboard thickness of 0.001 inch, 0.00024 $w^{2.63}$ grams-centimeter/fiber mat density$^{1.63}$ pounds per 3000 square foot ream at a fiberboard thickness of 0.001 inch, 0.00021 $w^{2.63}$ grams-centimeter/fiber mat density$^{1.63}$ pounds per 3000 square foot ream at a fiberboard thickness of 0.001 inch, and 0.00016 $w^{2.63}$ grams-centimeter/fiber mat density$^{1.63}$ pounds per 3000 square foot ream at a fiberboard thickness of 0.001 inch, at GM tensile of 1323+24.2 w pounds per inch. At a fiber mat density of 3, 4.5, 6.5, and 7 pounds per 3000 square foot ream at a fiberboard thickness of 0.001 inch, the GM Taber stiffness values are 0.00120 w grams-centimeter/fiber mat density$^{1.63}$ pounds per 3000 square foot ream at a fiberboard thickness of 0.001 inch, 0.00062 $w^{2.63}$ grams-centimeter/fiber mat density$^{1.63}$ pounds per 3000 square foot ream at a fiberboard thickness of 0.001 inch, 0.00034 $w^{2.63}$ grams-centimeter/fiber mat density$^{1.63}$ pounds per 3000 square foot ream at a fiberboard thickness of 0.001 inch, 0.00030 $w^{2.63}$ grams-centimeter/fiber mat density$^{1.63}$ pounds per 3000 square foot ream at a fiberboard thickness of 0.001 inch, and a GM tensile stiffness 1890+24.2 w pounds per inch. The preferred GM Taber stiffness values are 0.0084 $w^{2.63}$ grams-centimeter/fiber mat density$^{1.63}$ pounds per 3000 square foot ream at a fiberboard thickness of 0.001 inch, 0.00043 $w^{2.63}$ grams-centimeter/fiber mat density$^{1.63}$ pounds per 3000 square foot ream at a fiberboard thickness of 0.001 inch, 0.00024 $w^{2.63}$ grams-centimeter/fiber mat density$^{1.63}$ pounds per 3000 square foot ream at a fiberboard thickness of 0.001 inch, 0.00021 $w^{2.63}$ grams-centimeter/fiber mat density$^{11.63}$ pounds per 3000 square foot ream at a fiberboard thickness of 0.001 inch, at a GM tensile of 1323+24.2 w pounds per inch.

The formable ultra rigid paperboard exhibits superior bending (GM Taber stiffness) and GM tensile stiffness. Usually, the paperboard has a bulking additive present. This bulking additive is selected from a group consisting of expanded or unexpanded microspheres, continuously or discontinuously coated expanded or unexpanded microspheres, thermally or chemically treated cellulose fibers rendered anfractuous and high bulk additive (HBA) fibers and mixtures of some or all of these bulking additives. The thermally or chemically treated fibers are disclosed in U.S. Pat. Nos. 5,384,011 and 5,384,012 assigned to the assignee of the instant patent application. Both of these United States patents are incorporated herein by reference in their entirety. Suitably the bulking additives, such as microspheres, are attached to the cellulose fiber prior to the formation of the embryonic web.

Microspheres are heat expandable thermoplastic polymeric hollow spheres containing a thermally activatable expanding agent. Such materials, the method of their manufacture, and considerable information concerning the properties and uses of microspheres are all set forth in the following U.S. Pat. Nos. 3,615,972; 3,864,181; 4,006,273; and 4,044,176. Microspheres are prepared from polyvinylidene chloride, polyacrylonitrile, poly-alkyl methacrylates, polystyrene or vinyl chloride. A wide variety of blowing agents can be employed in microspheres. Advantageously, commercially available blowing agents are selected from the lower alkanes such as propane, butane, pentane, and mixtures thereof. Isobutane is the preferred blowing agent for polyvinylidene chloride microspheres. Suitable microspheres are disclosed in U.S. Pat. Nos. 3,556,934; 3,293,114; and 4,722,944, all incorporated herein by reference. Suitable coated unexpanded and expanded microspheres are disclosed in U.S. Pat. Nos. 4,722,943 and 4,829,094, both incorporated herein by reference.

Suitably a retention aid is employed. The retention aid is selected from the group consisting of coagulation agents, flocculation agents, and entrapment agents. Flocculation and coagulation agents are the preferred retention aids. Advantageously a binder is utilized, usually in conjunction with a pigment. Suitable sizing agents are also employed. Suitably 1–30 pounds of sizing agent for a three thousand square foot ream are used for paperboards having a fiber mat density of about 3 to 8.3 pounds per 3000 square foot ream at a fiberboard thickness of 0.001 inch. Advantageously, 6–30 pounds of sizing agent is used for a three thousand square foot ream of paperboard having a fiber mat density in excess of 8.3 pounds per 3000 square foot ream at a fiberboard thickness of 0.001 inch. For certain special applications, 0–6 pounds of sizing agent is used for a three thousand square foot ream. Advantageously, about 15–30 pounds of the sizing agent is utilized. Preferably 16–19 pounds of the sizing agent is used for each three thousand square foot ream. The appropriate control of the amount of sizing agent added controls the GM tensile stiffness of the board. In the manufacture of the paperboard optionally wet strength agents are utilized. Parez 631 is a suitable wet strength agent. Other wet strength agents are FDA approved polyamides and acrylamides if the end use of the board is to be used as food containers and the wet strength agents come in direct contact with edible material.

Advantageously, the bulk enhanced paperboard is conveniently pressed into high quality articles of manufacture having a high GM Taber stiffness and GM tensile stiffness. Useful articles made from the bulk enhanced paperboard include cartons, folding paper boxes, cups, plates, compartmented plates, bowls, canisters, French fry sleeves, hamburger clam shells, rectangular take-out containers, food buckets, heat insulating containers coated or laminated with a polyolefin and foamed with the water contained in the fiberboard and food containers with a microwave susceptor layer. The articles of manufacture are characterized by having excellent insulation properties. These properties are critical for hot and cold cups and plates of this invention. The GM Taber stiffness and GM tensile stiffness for the one-ply web is the same as for the one-ply paperboard. For multi-ply boards, the GM Taber stiffness and GM tensile stiffness is the same as for the one-ply paperboard. The paperboard of this invention has at a fiber mat density of 3, 4.5, 6.5, 7, 8.3, and 9 pounds per 3000 square foot ream at a fiberboard thickness of 0.001 inch, a GM Taber stiffness of at least about 0.00716 $w^{2.63}$ grams-centimeter/fiber mat density$^{1.63}$ pounds per 3000 square foot ream at a fiberboard thickness of 0.001 inch, and a GM tensile of 1890+24.2 w pounds per inch. The preferred GM Taber stiffness at a fiber mat density of 3–9 pounds per 3000 square foot ream at a fiberboard thickness of 0.001 inch is 0.00501 $w^{2.63}$ grams-centimeter/fiber mat density$^{1.63}$ pounds per 3000 square foot ream at a fiberboard thickness of 0.001 inch, and the preferred GM tensile stiffness is 1323+24.2 w pounds per inch. The GM Taber stiffness values for a paperboard having a fiber mat density of 3, 4.5, 6.5, 7, and 8.3 pounds per 3000 square foot ream at a fiberboard thickness of 0.001 inch, are 0.00120 $w^{2.63}$ grams-centimeter/fiber mat density$^{1.63}$ pounds per 3000 square foot ream at a fiberboard thickness of 0.001 inch, 0.00062 $w^{2.63}$ grams-centimeter/fiber mat density$^{1.63}$ pounds per 3000 square foot ream at a fiberboard thickness of 0.001 inch, 0.00034 $w^{2.63}$ grams-centimeter/fiber mat density$^{1.63}$ pounds per 3000 square foot ream at a fiberboard thickness of 0.001 inch, 0.00030 $w^{2.63}$ grams-centimeter/fiber mat density$^{1.63}$ pounds per 3000 square foot ream at a fiberboard thickness of 0.001 inch, and 0.00023 $w^{2.63}$ grams-centimeter/fiber mat density$^{1.63}$ pounds per 3000 square foot ream at a fiberboard thickness of 0.001 inch, at a GM tensile stiffness of 1890+24.2 w pounds per inch. The preferred GM Taber stiffness values for a board having a fiber mat density of about 3, 4.5, 6.5, 7, and 8.3 pounds per 3000 square foot ream at a fiberboard thickness of 0.001 inch are 0.0084 $w^{2.63}$ grams-centimeter/fiber mat density$^{1.63}$ pounds per 3000 square foot ream at a fiberboard thickness of 0.001 inch, 0.00043 w grams-centimeter/fiber mat density$^{1.63}$ pounds per 3000 square foot ream at a fiberboard thickness of 0.001 inch, 0.00024 $w^{2.63}$ grams-centimeter/fiber mat density$^{1.63}$ pounds per 3000 square foot ream at a fiberboard thickness of 0.001 inch, 0.00021 $w^{2.63}$ grams-centimeter/fiber mat density$^{1.63}$ pounds per 3000 square foot ream at a fiberboard thickness of 0.001 inch, and 0.00016 $w^{2.63}$ grams-centimeter/fiber mat density$^{1.63}$ pounds per 3000 square foot ream at a fiberboard thickness of 0.001 inch, at a GM tensile of 1323+24.2 w pounds per inch. At a fiber mat density of 3, 4.5, 6.5, and 7 pounds per 3000 square foot ream at a fiberboard thickness of 0001 inch, the GM Taber stiffness values are 0.00120 $w^{2.63}$ grams-centimeter/fiber mat density$^{1.63}$ pounds per 3000 square foot ream at a fiberboard thickness of 0.001 inch, 0.00062 $w^{2.63}$ grams-centimeter/fiber mat density$^{1.63}$ pounds per 3000 square foot ream at a fiberboard thickness of 0.001 inch, 0.00034 $w^{2.63}$ grams-centimeter/fiber mat density$^{1.63}$ pounds per 3000 square foot ream at a fiberboard thickness of 0.001 inch, and 0.00030 $w^{2.63}$ grams-centimeter/fiber mat density$^{1.63}$ pounds per 3000 square foot ream at a fiberboard thickness of 0.001 inch, at a GM tensile stiffness of 1890+24.2 w pounds per inch. The preferred GM Taber stiffness values are 0.0084 $w^{2.63}$ grams-centimeter/fiber mat density$^{1.63}$ pounds per 3000 square foot ream at a fiberboard thickness of 0.001 inch, 0.00043 $w^{2.63}$ grams-centimeter/fiber mat density$^{1.63}$ pounds per 3000 square foot ream at a fiberboard thickness of 0.001 inch, 0.00024 $w^{2.63}$ grams-centimeter/fiber mat density$^{1.63}$ pounds per 3000 square foot ream at a fiberboard thickness of 0.001 inch, and 0.00021 $w^{2.63}$ grams-centimeter/fiber mat density$^{1.63}$ pounds per 3000 square foot ream at a fiberboard thickness of 0.001 inch, at a GM tensile of 1323+24.2 w pounds per inch.

DETAILED DESCRIPTION

In our process, the usual conventional papermaking fibers are suitable. We utilize softwood, hardwood, chemical pulp obtained from softwood and/or hardwood chips liberated into fiber by sulfate, sulfite, sulfide or other chemical pulping processes. Mechanical pulp was obtained by mechanical treatment of softwood and/or hardwood. Recycled fiber and other refined fiber may suitably be utilized in our paperboard manufacturing process.

Papermaking fibers used to form the high bulk paperboard of the present invention include cellulosic fibers commonly referred to as wood pulp fibers, liberated in the pulping process from softwood (gymnosperms or coniferous trees) and hardwoods (angiosperms or deciduous trees). The particular tree and pulping process used to liberate the tracheid are not critical to the success of the present invention. Cellulosic fibers from diverse material origins may be used to form the web of the present invention including cottonwood and non-woody fibers liberated from sabai grass, rice straw, banana leaves, paper mulberry (i.e., bast fiber), abaca leaves, pineapple leaves, esparto grass leaves, and fibers from the genus Hesperaloe in the family Agavaceae. Also recycled fibers which may contain any of the above fiber sources in different percentages can be used in the present invention.

Papermaking fibers can be liberated from their source material by any one of the number of chemical pulping processes familiar to one experienced in the art including sulfate, sulfite, polysulfite, soda pulping, etc. The pulp can be bleached if desired by chemical means including the use of chlorine, chlorine dioxide, oxygen, hydrogen peroxide, etc. Furthermore, papermaking fibers can be liberated from source material by any one of a number of mechanical/chemical pulping processes familiar to anyone experienced in the art including mechanical pulping, thermomechanical pulping, and chemi-thermomechanical pulping. These mechanical pulps can be bleached, if one wishes, by a number of familiar bleaching schemes including alkaline peroxide and ozone bleaching.

Generally in our process the range of hardwood to softwood varies from 0–100% to 100 to 0%. The preferred range for hardwood to softwood is about 20 to 80 to about 80 to 20; the most preferred range of hardwood comprises about 40 to about 80 percent of the furnish and the softwood comprises about 60 to about 20 percent of the furnish.

Figure 1:
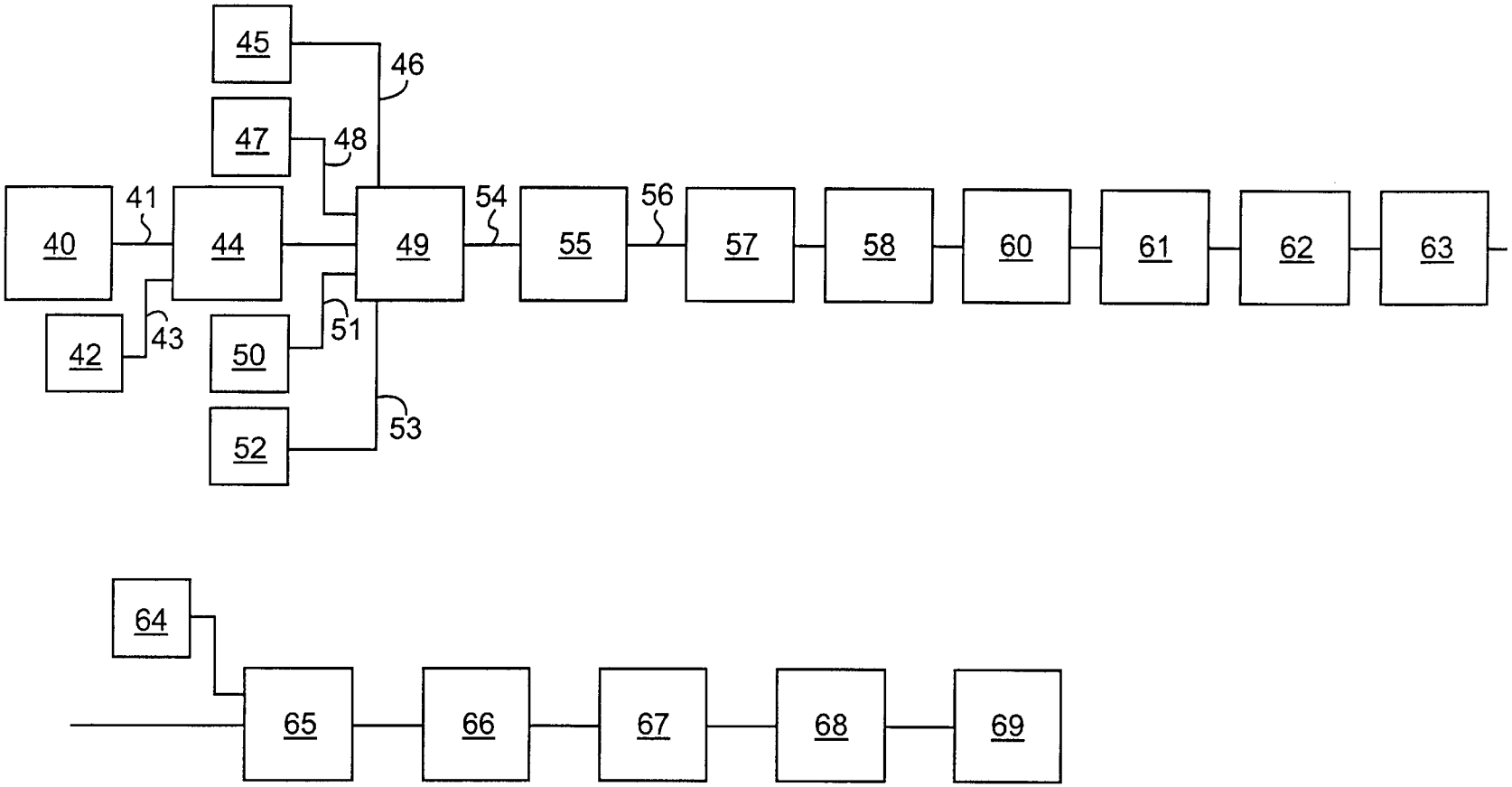
FIG. 1 is a flow diagram depicting the process for the manufacture of the paperboard.
Figure 2:
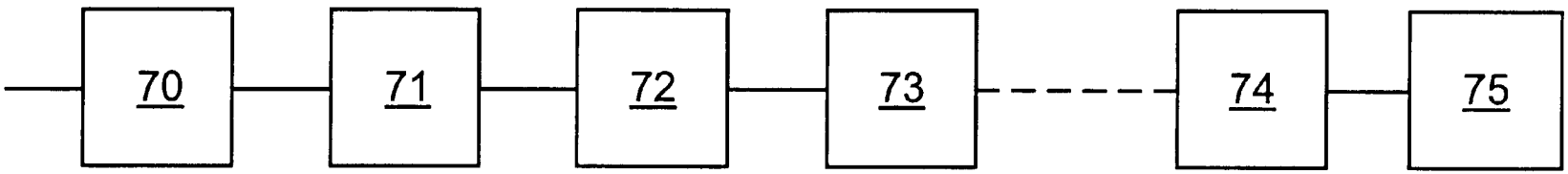
FIG. 2 is a flow diagram depicting the conversion of the paperboard to optionally printed and dyed articles of manufacture.

FIGS. 1 and 2 provide a schematic layout of a suitable process for the manufacture of the paperboard of this invention and for the manufacture of the articles of manufacture using the paperboard as raw material.

Figure 16A:
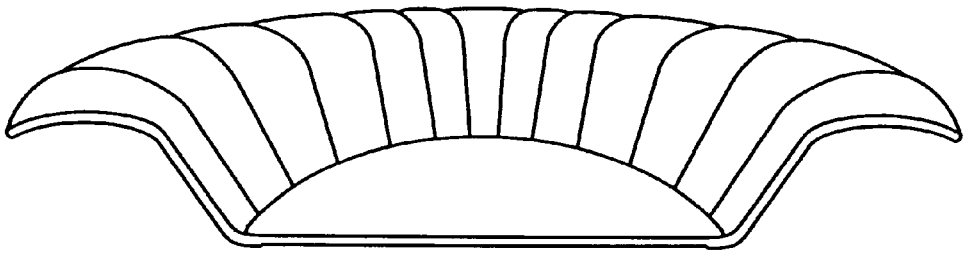
FIGS. 16A and B are drawings of a plate of this invention formed from the paperboard of this invention.
Figure 16B:
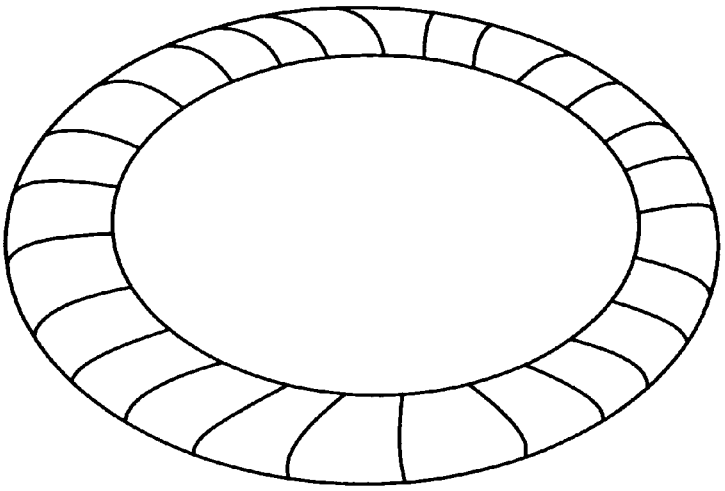
Figure 17A:
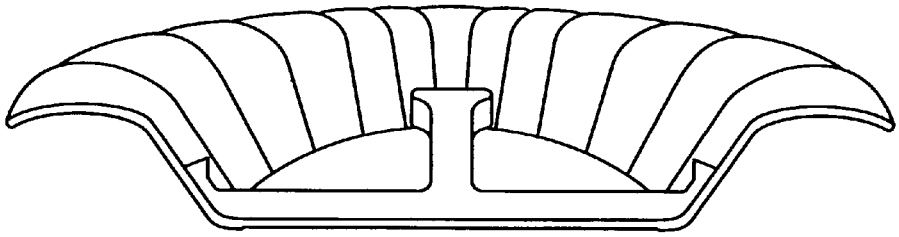
FIGS. 17A and B are drawings of a compartmented plate of this invention formed from the paperboard of this invention.
Figure 17B:
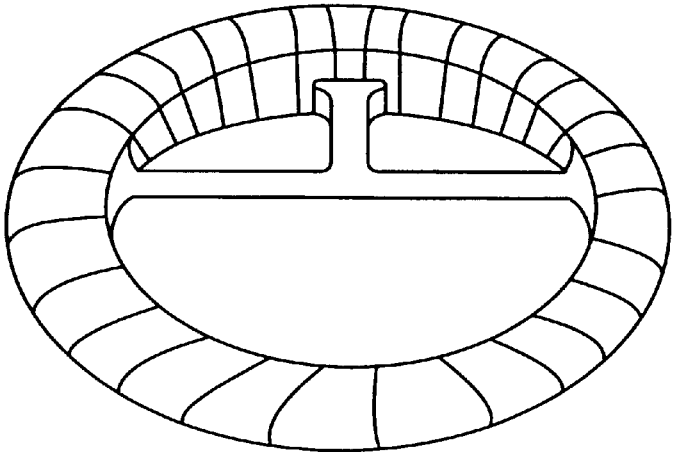
Figure 18A:
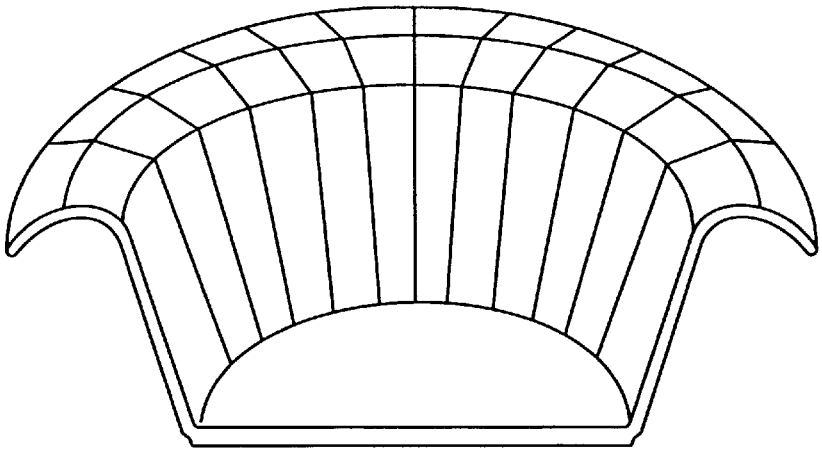
FIGS. 18A and B are drawings of a bowl of this invention formed from the paperboard of this invention.
Figure 18B:
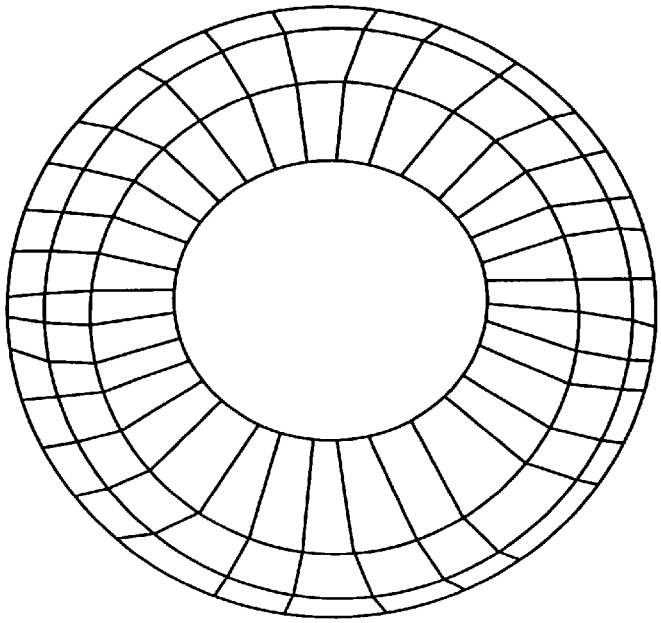

In FIG. 1 it is shown that feedstock is pumped into the mix box 40. Alum and other internal sizing agents are added to the feedstock along line 41 prior to it being pumped into the machine chest (44). Optionally a wet strength agent such a Parez or Kymene is added to the feedstock through line (43) at the machine chest (44). Suitable wet strength agents are nitrogen containing polyamides. For food service products, if the food comes in contact with the wet strength agent, it has to be approved by the FDA. Representative polyamides are listed in European Patent Application 91850148.7 relating to polyamide epichlorohydrin (PAE) wet strength resins and that patent application is incorporated herein by reference. Parez 631NC which is a glyoxylated polyacrylamide is a suitable wet strength agent. In the stuff box (49) starch is charged through line (46), and optionally blue dye is charged through line (48); for pH control, a base such as caustic is charged through line (51) and retention aid is charged through line (53). The cationic starch is added through line (54) and prior to the cleaners (55). The bulk enhancing additive is added after the mixture has been cleaned at the cleaners (55) and prior to the time it has reached the screens (57). The embryonic paperboard web is formed on the fourdrinier wire (58). The water is removed through a water removal apparatus (60). Initially the water is removed from the bottom side of the sheet through the fourdrinier table and from the top side of the web through the BelBond vacuum system. The web is heated with steam through steam showers (61), and the paperboard web is pressed in the press section (62) and dried in the dryer sections (63). Starch is supplied through line 64 to the size press (65). The web is passed through calender stacks (66) to smooth the web. Coating section (67) represents one to six coaters. The binder and optionally pigment is coated on both sides of the paperboard. Usually about three to six coatings are provided. For paper cup and related applications, usually the paperboard is not coated. The coated or uncoated paperboard is calendered in the gloss calender (68) and rolled on the reel (69). The paperboard is optionally placed in a printing press (70) for plate and bowl applications. Suitably a rotogravure press, flexopress or lithopress is utilized. Advantageously two to eight colors are printed on the reel. The printed reel is placed in a coater (71) where optionally two plate coatings are applied. Optionally, the reeled web is suitably moistened in a wetting applicator (72) (Dahigren Press). The moistened web is wound onto a reel (73). A moistened web is utilized in the manufacture of articles which require significant deformation of the board. Representative articles requiring significant deformation of the board are plates shown in FIGS. 16 and 17 and bowls shown in FIG. 18.

Figure 28A:
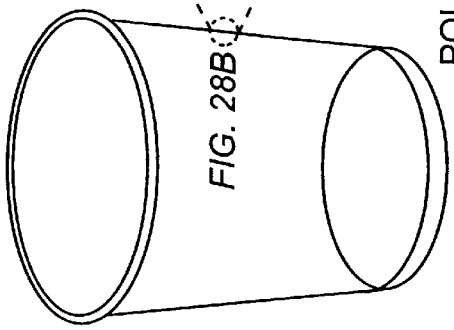
FIGS. 28A–C are drawings of a heat insulating cup having on its wall surface a foamed layer of thermoplastic film.
Figure 28B:
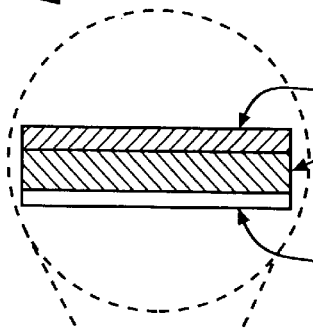
Figure 28C:
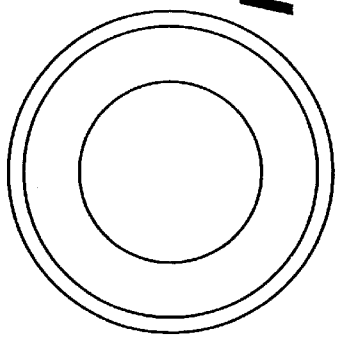

Moisture may be introduced into the paperboard blank in the form of water or preferably as a moistening/lubricating solution. When blank stock in roll form is used, as in commercial scale operations, the blank stock is unrolled, coated as described above, wetted, rerolled, and allowed to stand for up to 24 hours or more before die-cutting is undertaken. One preferred moistening/lubricating solution comprises a polyethylene wax solution which acts both as a lubricant in the pressing operation and to introduce moisture in the paperboard blank to give the paperboard blank the required plasticity. In many applications water is the preferred moistening solution. This is particularly true when water contained in the paperboard is used to form the foamed coating on cellulosic containers having a polyolefin skin such as shown in FIG. 28.

Figure 19A:
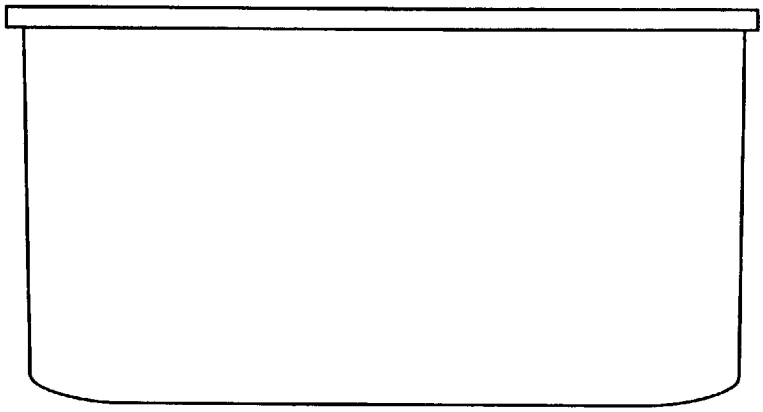
FIGS. 19A and B are drawings of a canister of this invention formed from the paperboard of this invention.
Figure 19B:
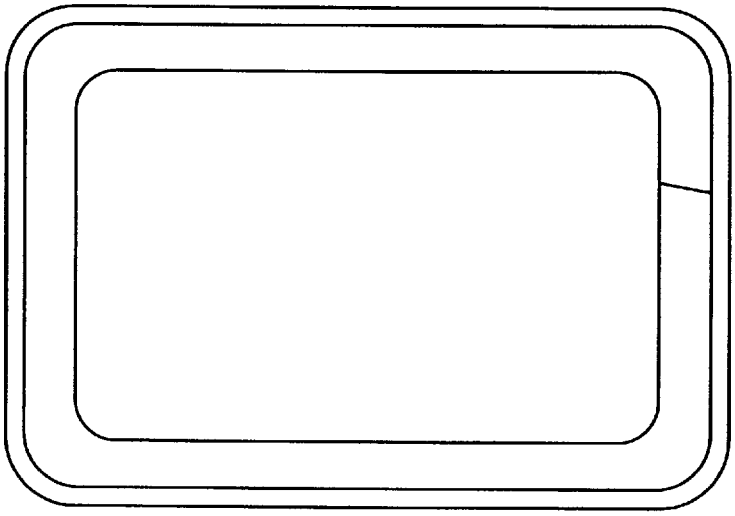
Figure 22A:
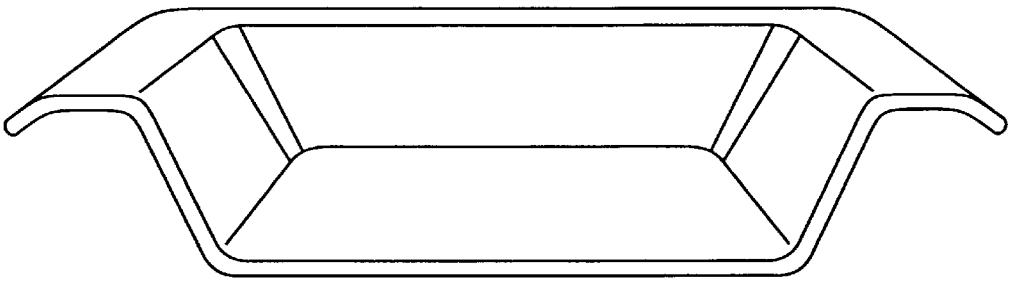
FIGS. 22A and B are drawings of a rectangular take-out container of this invention formed from the paperboard of this invention.
Figure 22B:
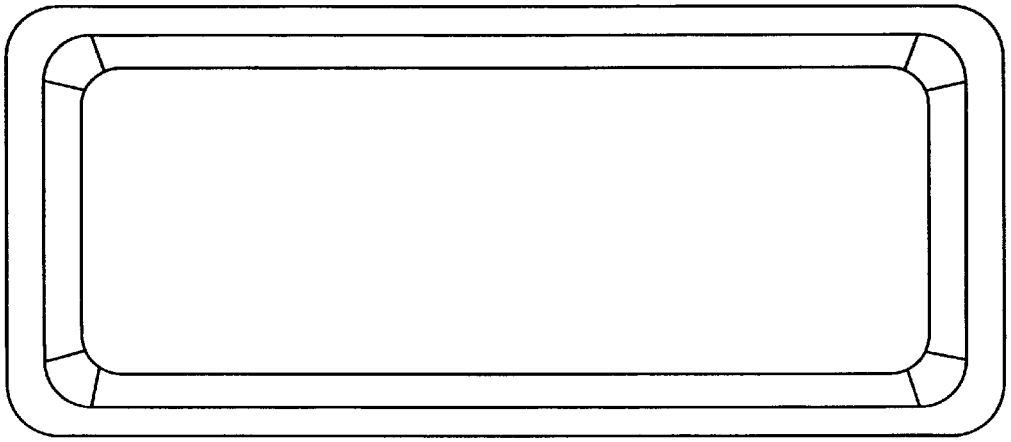
Figure 23A:
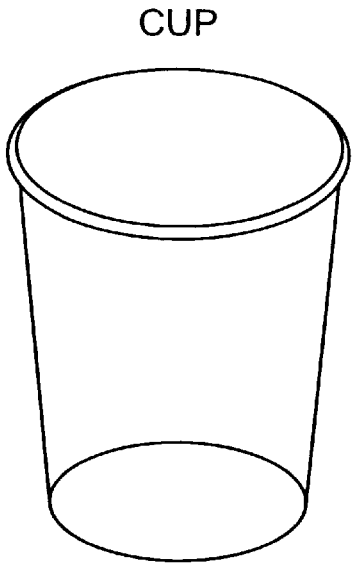
FIGS. 23A and B are drawings of a cup of this invention formed from the paperboard of this invention.
Figure 23B:
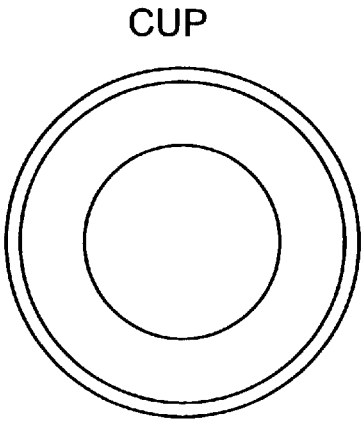
Figure 24A:
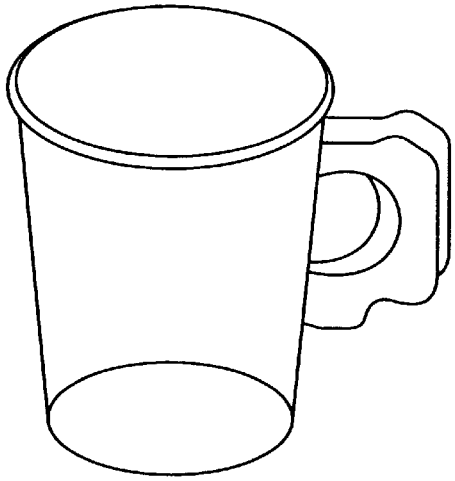
FIGS. 24A and B are drawings of the cup shown in FIG. 23 to which handles have been attached.
Figure 24B:
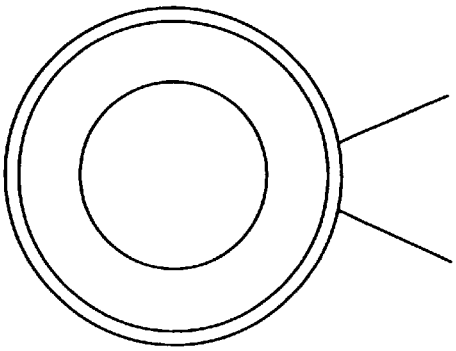

In FIG. 2 the paperboard from reel (73) is fed into the die press (74) where the paperboard is scored and cut. This blank is fed into the die (75) which is capable of forming the desired articles of manufacture such as cups, FIGS. 23, 24, and 28; plates, FIG. 16; compartmented plates, FIG. 17; bowls, FIG. 18; canisters, FIG. 19; French fry sleeves, FIG. 20; hamburger clam shells, FIG. 21; rectangular take-out containers, FIG. 22; food buckets, FIG. 25; and other consumer products including cartons and folding paper boxes.

The paperboard material is coated with a useful coating polymer prior to formation of the paperboard shells used in forming the containers in accordance with the present invention. Polymers suitable for this purpose are polymers having a melting point below 270° C. and having a glass transition temperature (Tg) in the range of −150° to +120° C. Suitable polymers are polyolefins such as polyethylene and polypropylene, nitrocellulose, polyethylene terephthalate, Saran and styrene acrylic acid copolymers. Representative coating polymers include methyl cellulose, carboxymethyl cellulose acetate copolymer, vinyl acetate copolymer, styrene butadiene copolymer, and styrene-acrylic copolymer. The preferred polymer is a high density polyethylene for cups and other articles of manufacture set forth in FIGS. 16–25, and FIG. 18.

As noted herein above, an additional means in aiding in the passing of the paperboard material into the forming die is the addition of a lubricant to the polyolefin or polyethylene coating which is applied to the paperboard material. By adding such lubricant, the leading edge of the paperboard material will not be prematurely caught in the forming die and thus permitted to pass completely into the forming die before the initial buckling takes place. It should also be noted that a lubricant may also be applied to the forming die itself.

In conventional containers, polyolefin coating, suitably polyethylene coating is applied to the paperboard material by way of an extruder and it is imperative that the polyolefin or polyethylene coating adhere to the paperboard material. To this end, one of three methods are generally used. These being one of a corona treatment, flame treatment, or polyethylene imine treatment better known in the art as a PEI treatment. Optionally the paperboard material is subjected both to a PEI treatment and a flame treatment in accordance with the present invention. This allows the lubricant containing polyolefin or polyethylene coating to adhere to the paperboard material resulting in a paperboard shell which passes further into the forming die when urged thus aiding in the control of the initial buckling point during formation of the brim curl in cups and other articles of manufacture having brims.

Figure 26A:
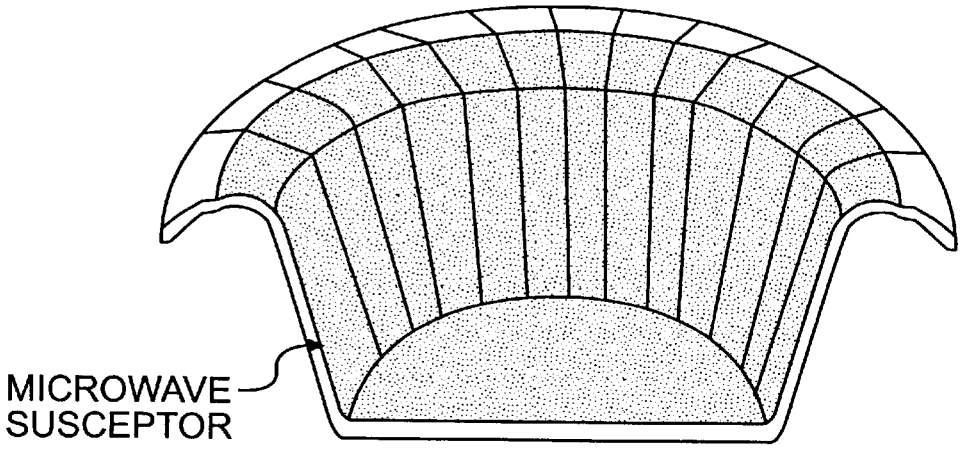
FIGS. 26A and B are drawings of a bowl with a microwave susceptor layer.
Figure 26B:
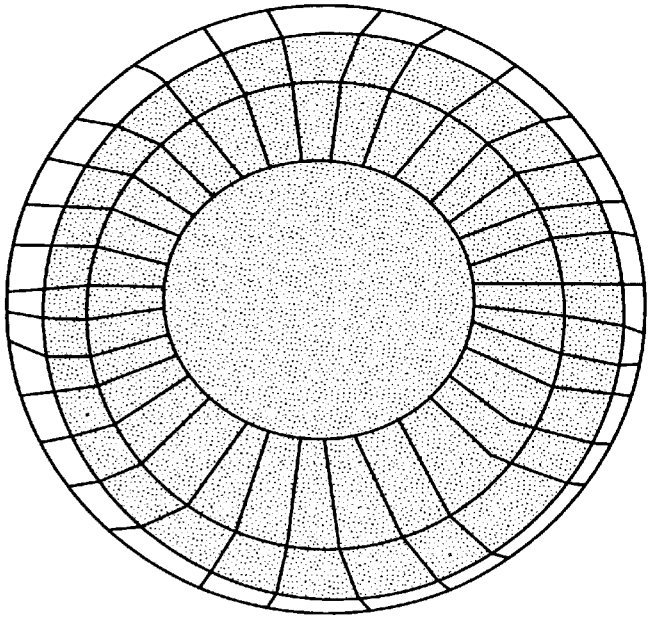
Figure 27A:
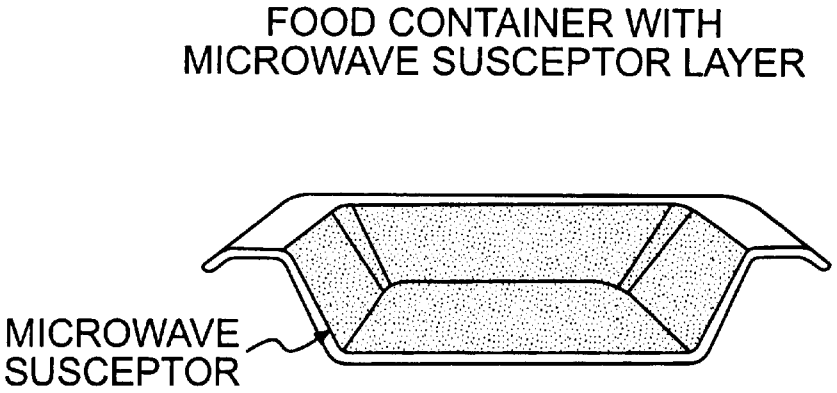
FIGS. 27A–D are drawings of a food container with a microwave susceptor.
Figure 27B:
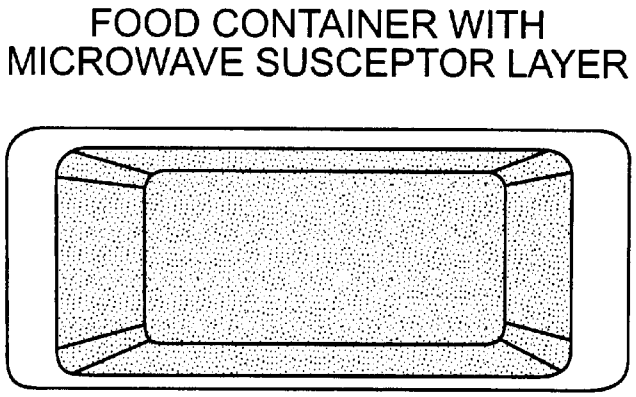
Figure 27C:
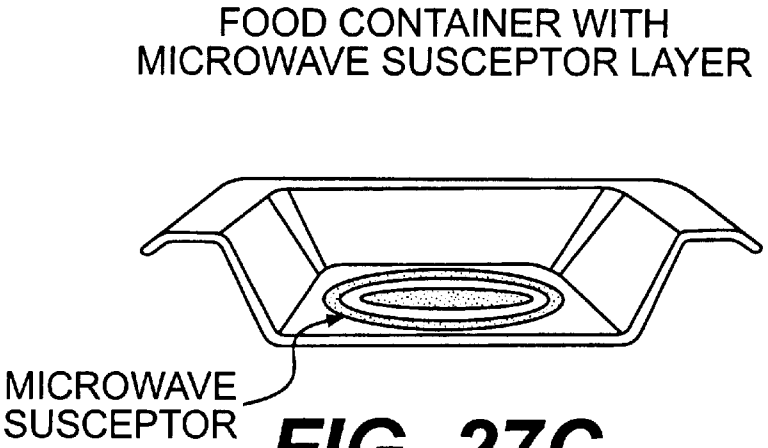
Figure 27D:
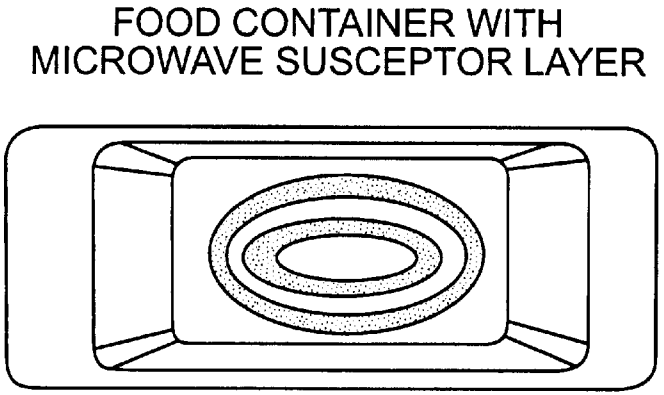

Conveniently for microwave applications as shown in FIGS. 26 and 27, a microwave susceptor layer is laminated on top of the paperboard substrate on which a pigment has been coated. The microwave susceptor layer comprises alumina and polyester compositions. Polyethylene terephthalate is the preferred polyester composition, THERMX® copolyester PCIA 6761 resin is also useful. The films in general are metalized polyesters wherein the metal is aluminum. For non microwave applications one or both sides of the paperboard including any pigment layers may be coated with polyolefins such as polyethylene, and polypropylene or polyesters such as polyethylene terephthalate. On top of the polyolefin layer it may be desirable to insert an aluminum foil type layer which either is directly in contact with the liquid in a container or is covered with a polyolefin layer. Products of this type are useful as juice containers.

The cooking of food and heating of substances with microwave radiation has become increasingly popular and important in recent years because of its speed, economy, and low power consumption. With food products, however, microwave heating has drawbacks. One of the major drawbacks is the inability to brown or sear the food product to make it similar in taste and appearance to conventionally cooked food.

One method involves the use of a metalized coating on paperboard. In this method, first, metal particles are vacuum deposited onto a film, preferably a polyester film. The film is then laminated onto the paper. The thus metalized paper, typically, must then be positioned onto a particular part of the food package requiring a windowing operation. The windowing operation requires that the metalized paper be slit before entering the process.

A microwave interactive coating which is capable of being printed on a substrate is also suitable. This coating overcomes the problems inherent in vacuum deposited metal coatings because the coatings can be printed exactly where they are required. Furthermore, coating patterns, coating formulations, and coating thicknesses can all be varied using conventional printing processes. A printing process also allows the use of materials besides metals as microwave reactive materials, as well as providing the possibility for a wide range of heating temperatures and a wide variety of applications.

The microwave interactive printable coating composition comprises a microwave reactive material selected from a conductor or semiconductor, a dielectric, or a ferromagnetic and a binder.

The microwave interactive printable coating is coated onto a film which is further laminated to a microwave transparent substrate.

In another embodiment, a method of manufacturing a microwave interactive coated substrate is provided. This substrate comprises coating a substrate using a conventional printing process with a microwave interactive printable coating composition comprising a microwave reactive material selected from a conductor or semiconductor, a dielectric, or a ferromagnetic, and a binder.

Microwave reactive materials (MRM) are capable of converting microwave energy to heat. This is accomplished using either the conductive or semiconductive properties, dielectric properties, or ferromagnetic properties of the microwave reactive materials. The materials having these properties will hereafter be referred to as conductors, semiconductors, dielectrics or ferromagnetics.

The microwave reactive materials included within the scope of this invention include any material which has suitable conductive or semiconductive, dielectric or ferromagnetic properties so that the material is capable of converting microwave radiation to heat energy. The materials can have any one of the above properties or can have a combination of the above properties. Furthermore, the properties of the substrate on which the material is coated, such as the orientation, heatset temperature, and melting point, as well as the adhesion between the coating and the substrate will affect the reactiveness of the materials to microwave energy.

The type and amount of microwave reactive materials used in the coating composition generally determines the degree of interaction with the microwaves and hence the amount of heating. In a preferred embodiment where the material used is conductive, the amount of heat generated is a function of the product of the conductivity of the material and the thickness of the material. In one aspect of this embodiment, when the microwave reactive material is carbon, the microwave reactive material combined with binder will preferably have a resistivity ranging from 50 ohms per square to 10,000 ohms per square inch. The microwave operations are usually conducted at temperatures in excess of 212° F., usually at temperatures of about 212° F. to 500° F.

Generally any metal, alloy, oxide, or any ferrite material which has microwave reactive properties as described above can be used as a microwave reactive material. Microwave reactive materials include suitable compositions comprising aluminum, iron, nickel, copper, silver, carbon, stainless steel, nichrome, magnetite, zinc, tin, iron, tungsten, titanium, and the like. The materials can be used in a powder form, flake form, or any other finely divided form which can be suitably used in printing processes. The microwave reactive materials can be used individually or can be used in combination with other microwave reactive materials.

In the preferred embodiment, the microwave reactive material will be suitable for food packaging. Alternatively, the microwave reactive material will be separated from the food by a film or other protective means.

It is preferred that the microwave reactive materials demonstrate rapid heating to a desired temperature, with subsequent leveling off of the temperature, without arcing during the material's exposure to microwave radiation. The temperature, at which the microwave reactive material levels off is hereinafter referred to as the operating temperature. Generally the microwave reactive material will operate at a temperature ranging from about 212° F. to 480° F.

The microwave reactive material is combined with a binder to form a coating composition. Any binder listed in this application is suitable. The binder must have good thermal resistance and suffer little or no degradation at the temperatures generated by the microwave reactive material. It must also have an adhesive ability which will allow it to adhere to the substrate.

In one preferred embodiment of this invention, an important aspect is that the microwave reactive material coated substrate must shrink during the heating process at a controlled rate so that the temperature of the coating rises rapidly and then remains at a constant level. In this embodiment it is important that the binders chosen be adhesive enough to bind the microwave reactive material to the substrate during the treatment with microwave energy.

The binder and the microwave reactive material are generally combined in a suitable ratio such that the microwave reactive material, in the form of a thin film, can convert the microwave radiation to heat to raise the temperature of a food item placed thereon, yet still have sufficient binder to be printable and to adhere to the film. There should also be sufficient binder present to prevent arcing of the microwave reactive material.

Generally the ratio of the microwave reactive material to binder, on a solids basis, will depend upon the microwave reactive material and binder chosen. In a preferred embodiment where the microwave reactive material is nickel, the microwave reactive material to binder ratio, on a weight basis, should be about 2:1 or higher.

Other materials can be included in the coating composition such as surfactants, dispersion aids, and other conventional additives for printing compositions, The coating can be applied using conventional printing processes such as rotogravure, flexography, and lithography. After the coating composition has been applied, it can be dried using conventional printing ovens normally provided in a printing process.

Generally, any amount of coating can be used. The amount of heat generated will vary according to the amount and type of coating applied to the substrate. In a suitable embodiment, when the coating material is nickel, the amount of coating will range from about 3 to about 11 pounds per 3000 square foot ream.

The coating composition is coated upon the paperboard of this invention or any suitable film material which does not melt at temperatures of about 212° F. to 500° F. and is attached to the paperboard of this invention.

A desirable feature for the microwave reactive coated substrates is that the substrate should either shrink during the heating process at a controlled rate or in some other manner the interparticle network of the coating should be disrupted so that the temperature of the coating rises rapidly and then remains at a constant level.

In a preferred embodiment of this invention, the coating composition is printed onto an oriented film. The film can be selected from any known films such as polyesters, nylons, polycarbonates, and the like. The film used generally should be shrinkable at the operating temperatures of the microwave reactive material but any film material which shrinks can be used. The film must also have a melting point above the operating temperature of the microwave reactive material. That is, it must melt above 212° F. to 500° F. A particularly preferred class of films include oriented polyester films such as Mylar®.

The thus coated film is then applied to a microwave transparent bulk enhanced paperboard of this invention. The substrate, preferably, is also dimensionally stable at the operating temperature of the microwave reactive material. Suitable substrates are paperboards of this invention.

The film is attached to the substrate using conventional adhesives. The adhesives used must be able to withstand heating temperatures within the operating range of the microwave reactive material that is a temperature of about 212° F. to 480° F. The adhesive must also be able to control the rate at which the film shrinks.

Suitable microwaveable packages comprise a dielectric substrate substantially transparent to microwave radiation having at last a portion of at least one surface thereof coated with a coating composition comprising a dielectric polymeric matrix having incorporated therein (a) particles of a microwave susceptor material; and (b) particles of a blocking agent.

In general, the dielectric substrate may be any material having sufficient thermal and dimensional stability to be useful as a packaging material at the high temperatures which may be desired for browning or rapidly heating foods in a microwave oven (e.g., at temperatures in excess of 212° F.). Useful substrates include polymeric terephthalate films as well as polymethylpentene films and films of other thermally stable polymers such as polyacrylates, polyamides, polycarbonates, polyetherimides, polyimides, and the like.

The dielectrical properties at 915 megahertz and 2450 megahertz of the matrix formed by the deposition of the polymeric material upon the packaging substrate is an important variable in terms of the heat generated in unit time at 2450 Mhz. Specifically, the dielectric matrix should, in general, possess a relative dielectric constant of between about 2.0 and about 10, preferably of between about 2.1 and 5, and should generally possess a relative dielectric loss index of between about 0.001 and about 2.5, preferably of between about 0.01 to 0.6. The matrix also preferably displays adhesive characteristics to the substrate, i.e., the bulk enhanced paperboard of this invention, as well as to any additional substrate to which the composite may be laminated to increase dimensional stability.

The microwave susceptor materials employed include any materials which are capable of absorbing the electric or magnetic portion of the microwave field energy and converting that energy into heat. Suitable materials include metals such as powdered nickel, antimony, copper, molybdenum, bronze, iron, chromium, tin, zinc, silver, gold, and aluminum. Other conductive materials such as graphite and semi-conductive materials such as silicon carbides and magnetic material such as metal oxides (if available in particulate form) may also be utilized. Suitable susceptor materials include alloys of copper, zinc, and nickel sold under the designation SF-401 by Obron; as well as leafing aluminum powder.

Suitable susceptor materials employed are in particulate form. Such particles may be flakes or powders. The size of such particles will vary in accordance with a number of factors, including the particular susceptor material selected, the amount of heat to be generated, the manner in which the coating composition is to be applied, and the like.

Typically, however, when such coating compositions are to be applied in the form of inks, due to limitations of the printing processes, such powders will have diameters of no more than about 50 microns. In general, in such circumstances, particle sizes of between about 0.1 and about 25 microns are preferably employed. When the susceptor materials are employed in the form of flakes (e.g., such as in the form of leafing aluminum), such flakes are typically of those sizes of flakes routinely used in the gravure ink art for the printing of metallic coatings.

A suitable blocking agent employed comprises at least one member of the group consisting of calcium salts, zinc salts, zinc oxide, lithopone, silica, and titanium dioxide. Preferred blocking agents include calcium carbonate, calcium sulfate, zinc oxide, silica, and titanium dioxide, and calcium carbonate, with calcium carbonate being most preferred.

Suitable blocking agents are typically employed in particulate form. The particle size of such blocking agents is generally limited by the particular coating process employed, and when such coating is applied in the form of an ink, such particle size is typically less than about 50 microns, with particle sizes of between about 0.1 and about 25 microns being preferred for most blocking agents. When calcium carbonate is employed as the blocking agent, particle sizes of between about 1 and about 10 microns are more preferred, with particle sizes of between about 3 and about 7 microns being most preferred.

It is believed that the presence of such blocking agents control the amount of heat generated by the susceptor material. By controlling the ratio and amount of blocking agent and susceptor, and/or by varying the thickness of the ink applied, the amount of heat generated by a preselected dosage of microwave radiation may be consistently controlled within a preselected range. In applications contemplated by this invention, the temperature will be in excess of 212° F.

Variables which must be taken into account for determining the precise ratios of susceptor to blocking agent needed for any particular use include the physical size shape, and surface characteristics of the susceptor and blocking agent particles contained in the coating composition, the amount of coating composition to be applied to the bulk enhanced paperboard of this invention, and the portion side as well as the food to be cooked in such application. By so altering these variables as well as the susceptor:blocking agent ratio employed, one of ordinary skill can easily regulate the compositions utilized herein to heat to high temperatures in a controlled manner in relatively short periods of time in conventional microwave ovens, e.g., to temperatures above 212° F. in 120 seconds when subjected to microwave energy generated in dosages typically produced by such ovens, e.g., at 550 watts at 2450 megahertz.

The susceptor level in the matrix will generally range from about 3 to about 80% by weight of the combined susceptor blocking agent/matrix composition. As noted above, the optimum levels of susceptor material and of blocking agent incorporated into the coating compositions will depend upon a number of factors, depending upon the ultimate end use employed. However, it has been found that, in many instances, weight ratio of 1:4 or more of blocking agent:susceptor material will effectively prevent heating of the coating composition when subjected to dosages of microwave radiation generated by conventional microwave ovens. Lower ratios of blocking agent to receptor material will result in higher temperatures.

One of ordinary skill in the art can easily determine optimum ratios for any particular application using routine experimentation.

In addition to the blocking agent, polymeric material liquid carrier and susceptor material the coating composition employed in the microwaveable package may optionally contain other conventional additives such as surface modifiers such as waxes and silicones, antifoam agents, surfactants, colorants such as dyes and pigments and the like, which additives are well known to those of ordinary skill in the art.

Suitable microwaveable packaging ink composition comprises a liquid carrier having dispersed or dissolved therein (A) a matrix-forming dielectric polymeric material substantially transparent to microwave radiation; (B) particles of a susceptor material; and (C) particles of a blocking agent.

The liquid carriers which may be employed include those organic solvents conventionally employed in the manufacturers of ink as well as water and mixtures of one or more of the foregoing. Illustrative of such solvents are liquid acetates such as isopropyl acetate and the like; alcohols such as isopropanol, butanol, and the like; ketones such as methyl ethyl ketone and the like. Particularly preferred solvents include water, isopropyl acetate, and mixtures of isopropyl acetate.

The coating formulation may also include a mineral filler to increase the solids level of the polymeric binder mixture. The mineral filler should be present at a level of about 0 to 50 percent by weight and more preferably about 20 to 40 percent by weight. Suitable mineral fillers include, for example, kaolin clays, calcium carbonate, titanium dioxide, zinc oxide, chalk, barite, silica, talc, bentonite, glass powder, alumina, graphite, carbon black, zinc sulfide, alumina silica, and mixtures thereof. Hydrafine clay, which is a hydrated aluminum silicate or kaolin with 0.9–2.5% titanium dioxide manufactured by J.M. Huber Corp. of Macon, Ga., is one preferred mineral filler.

The paperboard of this invention is suitably coated with a binder and an inorganic or organic pigment. The binder is selected from the group consisting of aliphatic acrylate acrylonitrile styrene copolymers, n-butyl acrylate acrylonitrile styrene copolymer, n-amyl acrylate acrylonitrile styrene copolymer, n-propyl acrylate acrylonitrile styrene copolymer, n-ethyl acrylate acrylonitrile styrene copolymer, aliphatic acrylate styrene copolymers, n-butyl acrylate styrene copolymers, n-amyl acrylate styrene copolymer, n-propyl acrylate styrene copolymer, n-ethyl acrylate styrene copolymer, cationic starch, anionic starch, amphoteric starch, starch latex copolymers, animal glue, gelatin, methyl cellulose, carboxymethylcellulose, polyvinyl alcohol, ethylene-vinyl acetate copolymer, vinyl acetate-acrylic copolymer, styrene-butadiene copolymer, ethylene-vinyl chloride copolymer, vinyl acetate polymer, vinyl acetate-ethylene copolymer, acrylic copolymer, styrene-acrylic copolymer, stearylated melamine, hydrophilic epoxy esters and mixtures of these. The pigment is selected from the group consisting of a clay, chalk, barite, silica, talc, bentonite, glass powder, alumina, titanium dioxide, graphite, carbon black, zinc sulfide, alumina silica, calcium carbonate and mixtures of these.

In another embodiment of this invention, heat insulating containers such as cups are produced as shown in FIG. 28. A paper composite container comprising a body member comprising an inner and an outer surface and a bottom panel member, wherein at least one surface of the container body wall is suitably coated or laminated with a thermoplastic synthetic resin film. Suitable synthetic resins are polyolefins such as high and low density polyethylenes, polypropylenes, and polyethylene polypropylene copolymers. The other surface of the body wall is suitably coated or laminated with a thermoplastic synthetic resin film utilized in coating the first surface or an aluminum foil. Advantageously, both surfaces of the body wall are laminated or coated with some material, in order to avoid direct escape of moisture from the paperboard into atmosphere when the fabricated container is heated.

The heat-insulating paperboard container is prepared by blanking a container body member from a paperboard sheet of this invention, one surface of which is coated or laminated with a thermoplastic synthetic resin film, and the other surface of which is coated or laminated with the same or different thermoplastic synthetic resin film or an aluminum foil and blanking a container bottom member from this paperboard sheet or another paperboard sheet having no lamination or coating and then fabricating them into a paperboard container using a conventional cup-forming machine and heating the so-fabricated paperboard container to foam the film coating or lamination.

A paperboard container having one surface of the body member laminated or coated with a thermoplastic film and the other surface coated or laminated with the same or different thermoplastic film or an aluminum foil may be prepared by other methods, for example, as disclosed in U.S. Pat. No. 3,390,618, a container body member is blanked out from a sheet one surface of which is coated or laminated with a thermoplastic synthetic resin film or an aluminum foil and a container bottom panel member is blanked out from this sheet or another sheet having no film or foil. They are fabricated into a container by using a conventional cup-forming machine so that the coated surface faces outward. A thermoplastic synthetic resin film which has been softened by heating is positioned in the opening of the container and the film is drawn by applying suction to line the inner surface of the container.

The thermoplastic synthetic resin layer of the so-manufactured container is then heated to foam it and form a heat-insulating layer on the wall surface of the container.

Alternatively, as taught by U.S. Pat. No. 4,206,249, a paper container is fabricated from a body member and bottom panel member blanked out from a sheet having no thermoplastic synthetic resin film or other layer. The inner and outer surfaces of the container are coated with a pre-polymer of thermoplastic synthetic resin by spraying it and then the prepolymer is cured by applying ultra-violet rays to form a film in situ. The film on the wall surfaces of the so-formed paper container is then heated to foam it and form a heat-insulating layer on the wall surfaces.

Alternatively, a heat-insulating paper container of this invention may be prepared as follows:

(i) a body blank is cut out from a paperboard sheet of this invention one surface of which is coated or laminated with a thermoplastic synthetic resin film and the other surface of which is coated or laminated with the same or different thermoplastic synthetic film or an aluminum foil and then heated to foam the thermoplastic synthetic resin film to thereby form a heat-insulating layer, or alternatively, said sheet is heated to foam the thermoplastic synthetic resin film, and a body blank having a foamed heat-insulating layer is cut out from the heated sheet;

(ii) a bottom blank is cut out from a paperboard sheet of this invention at least one surface of which is coated or laminated with a thermoplastic synthetic resin film or an aluminum foil or one surface of which is coated or laminated with a thermoplastic synthetic resin film and the other surface of which is coated or laminated with the same or different thermoplastic synthetic resin film or an aluminum foil or which is neither coated nor laminated with such materials, and then said blank is optionally heated. If the sheet has the thermoplastic synthetic resin film or alternatively a paper sheet, one surface of which is coated or laminated with a thermoplastic synthetic resin film and the other surface of which is coated or laminated with the same or different thermoplastic synthetic resin film or an aluminum foil, is optionally heated to foam the thermoplastic synthetic resin film to thereby form a heat-insulating layer, and a bottom blank having a foamed heat-insulating layer is cut out from the heated sheet; and (iii) the body blank having a heat-insulating layer on at least one surface and the bottom blank having or not having a heat-insulating layer are then fabricated into a heat-insulating paper container with a conventional cup-making machine.

Thermoplastic synthetic resin films which may be used in this invention include polyethylene, polypropylene, polyvinyl chloride, polystyrene, polyester, nylon and the like. Polyethylene is preferred. The term "polyethylene" includes low, medium and high density polyethylenes.

The paperboard sheet which is used to form the heat insulating paper container has a fiber weight of at least 40, preferably 60 to 320, pounds per 3000 square foot ream. The cellulosic paperboard useful for the manufacture of the composite containers, including the cup shown in FIG. 28, has at a fiber mat density of 3, 4.5, 6.5, 7, 8.3, and 9 pounds per 3000 square foot ream at a fiberboard thickness of 0.001 inch, a GM Taber stiffness respectively of at least 0.00716 $w^{2.63}$ grams-centimeter/fiber mat density$^{1.63}$ pounds per 3000 square foot ream at a fiberboard thickness of 0.001 inch, and a GM tensile of 1890+24.2 w pounds per inch. The preferred GM Taber stiffness value is 0.00501 $w^{2.63}$ grams-centimeter/fiber mat density$^{1.63}$ pounds per 3000 square foot ream at a fiberboard thickness of 0.001 inch, and the preferred GM tensile stiffness is 1323+24.2 w pounds per inch. The GM Taber stiffness values for a paperboard having a fiber mat density of 3, 4.5, 6.5, 7, and 8.3 pounds per 3000 square foot ream at a fiberboard thickness of 0.001 inch, are 0.00120 $w^{2.63}$ grams-centimeter/fiber mat density$^{1.63}$ pounds per 3000 square foot ream at a fiberboard thickness of 0.001 inch, 0.00062 $w^{2.63}$ grams-centimeter/fiber mat density$^{1.63}$ pounds per 3000 square foot ream at a fiberboard thickness of 0.001 inch, 0.00034 $w^{2.63}$ grams-centimeter/fiber mat density$^{1.63}$ pounds per 3000 square foot ream at a fiberboard thickness of 0.001 inch, 0.00030 $w^{2.63}$ grams-centimeter/fiber mat density$^{1.63}$ pounds per 3000 square foot ream at a fiberboard thickness of 0.001 inch, and 0.00023 $w^{2.63}$ grams-centimeter/fiber mat density$^{1.63}$ pounds per 3000 square foot ream at a fiberboard thickness of 0.001 inch, at a GM tensile of 1890+24.2 w pounds per inch. The preferred GM Taber stiffness values for a board having a fiber mat density of about 3, 4.5, 6.5, 7, and 8.3 pounds per 3000 square foot ream at a fiberboard thickness of 0.001 inch are 0.0084 $w^{2.63}$ grams-centimeter/fiber mat density$^{1.63}$ pounds per 3000 square foot ream at a fiberboard thickness of 0.001 inch, 0.00043 $w^{2.63}$ grams-centimeter/fiber mat density$^{1.63}$ pounds per 3000 square foot ream at a fiberboard thickness of 0.001 inch, 0.00024 $w^{2.63}$ grams-centimeter/fiber mat density$^{1.63}$ pounds per 3000 square foot ream at a fiberboard thickness of 0.001 inch, 0.00021 $w^{2.63}$ grams-centimeter/fiber mat density$^{1.63}$ pounds per 3000 square foot ream at a fiberboard thickness of 0.001 inch, and 0.00016 $w^{2.63}$ grams-centimeter/fiber mat density$^{1.63}$ pounds per 3000 square foot ream at a fiberboard thickness of 0.001 inch, at GM tensile of 1323+24.2 w pounds per inch. At a fiber mat density of 3, 4.5, 6.5, and 7 pounds per 3000 square foot ream at a fiberboard thickness of 0.001 inch, the GM Taber stiffness values are 0.00120 $w^{2.63}$ grams-centimeter/fiber mat density$^{1.63}$ pounds per 3000 square foot ream at a fiberboard thickness of 0.001 inch, 0.00062 $w^{2.63}$ grams-centimeter/fiber mat density$^{1.63}$ pounds per 3000 square foot ream at a fiberboard thickness of 0.001 inch, 0.00034 $w^{2.63}$ grams-centimeter/fiber mat density$^{1.63}$ pounds per 3000 square foot ream at a fiberboard thickness of 0.001 inch, and 0.00030 $w^{2.63}$ grams-centimeter/fiber mat density$^{1.63}$ pounds per 3000 square foot ream at a fiberboard thickness of 0.001 inch, at a GM tensile stiffness of 1890+24.2 w pounds per inch. The preferred GM Taber stiffness values are 0.0084 $w^{2.63}$ grams-centimeter/fiber mat density$^{1.63}$ pounds per 3000 square foot ream at a fiberboard thickness of 0.001 inch, 0.00043 $w^{2.63}$ grams-centimeter/fiber mat density$^{1.63}$ pounds per 3000 square foot ream at a fiberboard thickness of 0.001 inch, 0.00024 $w^{2.63}$ grams-centimeter/fiber mat density$^{1.63}$ pounds per 3000 square foot ream at a fiberboard thickness of 0.001 inch, and 0.00021 $w^{2.63}$ grams-centimeter/fiber mat density$^{1.63}$ pounds per 3000 square foot ream at a fiberboard thickness of 0.001 inch, at a GM tensile of 1323+24.2 w pounds per inch. Utilizing the paperboard of this invention improves the thermal properties of the container disclosed in U.S. Pat. No. 4,435,344 which is incorporated by reference herein in its entirety. FIG. 28 illustrates the heat insulating paperboard container in the form of a cup. This cup has an inner and outer surface which when filled with a liquid at 190° F. exhibits thermal insulative properties such that at room temperature and one atmosphere pressure, the temperature of the outer surface does not reach 140° F.–145° F. in less than thirty seconds. The article by B. I. Dussan et al. entitled *Study of Burn Hazard in Human Tissue and Its Implication on Consumer Product Design*, presented at the Heat Transfer Division of the American Society of Mechanical Engineers at the ASME Winter Annual Meeting, Washington, D.C., Nov. 28–Dec. 2, 1971, discusses skin necrosis and thermal insulation.

The paperboard should have a moisture content of about 2 to about 10%, i.e., at least about 2%, preferably about 4 to about 8.5%, and most preferably about 4.5 to 8%. Though the heating temperature and heating time will vary depending on the type of the paper sheet and the thermoplastic synthetic resin film used, the heating temperature generally varies from about 110° C. to about 200° C., and the heating time varies from about 20 seconds to about 4 minutes. By way of example, when a polyethylene film is used as a thermoplastic synthetic resin film for coating or lamination, the optimum result will be obtained if the moisture content of the paperboard is between about 5 to about 8% and the heating temperature is from 110° C. to 150° C., and the heating time is between 50 seconds to 2.5 minutes.

Suitably a cellulosic insulating container, preferably a cup, is manufactured from a cellulosic paperboard comprising (a) predominantly cellulosic fibers; (b) bulk and porosity enhancing additives selected from the group consisting of expanded or unexpanded uncoated microspheres, expanded or unexpanded coated microspheres, expanded or unexpanded microspheres coated discontinuously, high bulk additive (HBA) fibers, and thermally and/or chemically treated cellulosic fibers rendered anfractuous or mixtures of expanded or unexpanded coated, uncoated, or discontinuously coated microspheres and HBA fibers, and thermally or chemically treated anfractuous fibers and mixtures of all or some of the additives interspersed with said cellulosic fibers in a controlled distribution throughout the thickness of said paperboard; and (c) retention aids selected from the group consisting of coagulation agents, flocculation agents, and entrapment agents dispersed within the bulk and porosity enhancing additives cellulosic fibers. The amount of size press binder applied optionally including a pigment is in the range of about 0 to 6 lbs./3000 square foot ream. The useful binders and pigments are all the ones disclosed herein. The useful fiber weight of the web is in the range of about 40 to 320 lbs./3000 square foot ream. The cellulosic container formed from the web comprising two surfaces and a bottom panel member is coated or laminated with a thermoplastic synthetic resin film on one surface thereof and coated or laminated with the same or different thermoplastic synthetic resin film or aluminum film on the other surface thereof, wherein the bottom panel member is formed of paperboard which may or may not be coated or laminated with a thermoplastic synthetic resin film or aluminum foil and wherein heating is performed at a temperature and for a time sufficient to form a heat-insulating layer on at least one surface of the container body member by a foaming action of at least one of the thermoplastic films of the container body through the action of the moisture in the paper of the container body member. Suitably thermoplastic resins are polyolefins such as polyethylenes. To insure thermal insulation and appropriate handling, preferably the outer wall of the container is coated with a polyolefin which is weaker than the polyolefin which is applied to the inner coating. Thus low density polyethylene is applied to the outer coating while high density polyethylene is applied to the inner coating.

Any heating means such as hot air, electric heat microwaves or infrared heating can be used. Heating, by hot air or electric heat, in a tunnel having transporting means such as conveyor is preferred for commercial production. The heat-insulating paperboard container of this invention may also be prepared batchwise by heating in a microwave or electric oven.

The thickness of the thermoplastic synthetic resin film coated or laminated on the paperboard sheet of this invention is not critical to this invention. As a non-limiting guideline, a film having a thickness of about 15$\mu$ to about 80$\mu$, preferably about 20$\mu$ to about 50$\mu$, most preferably 20$\mu$ to 40$\mu$ may be used.

One can provide a foamed layer on a desired surface by changing the type and nature of the thermoplastic synthetic resin films to be coated or laminated on the paperboard surface. For example, when a film material having a relatively high melting point, for example high density polyethylene film, is used on the inner surface of the container body wall and a film material having a relatively low melting point, for example low density polyethylene film is used on the outer surface of the container body member, only the low density polyethylene film on the outer wall surface is foamed and the high density polyethylene film on the inner wall surface may remain unfoamed. Also, when the inner wall surface of container body member is coated or laminated with an aluminum foil and the outer surface is coated or laminated with a thermoplastic film, the film layer on the outer wall surface can be effectively foamed to form a heat-insulating layer. It should be noted that the reverse is possible.

A key aspect in obtaining the advantageous properties of the paperboard of this invention is the utilization of appropriate retention aids for the bulk-enhancing additives to retain a significant percentage of the additive in the middle of the paperboard and not in the periphery. Suitable retention aids function through coagulation, flocculation, or entrapment of the bulk additive. In FIG. 1 the retention aids are charged through line (53). Coagulation comprises a precipitation of initially dispersed colloidal particles. This precipitation is suitably accomplished by charge neutralization or formation of high charge density patches on the particle surfaces. Since natural particles such as fines, fibers, clays, etc., are anionic, coagulation is advantageously accomplished by adding cationic materials to the overall system. Such selected cationic materials suitably have a high charge to mass ratio. Suitable coagulants include inorganic salts such as alum or aluminum chloride and their polymerization products (e.g. PAC or poly aluminum chloride or synthetic polymers); poly(diallyldimethyl ammonium chloride) (i.e., DADMAC); poly (dimethylamine)-co-epichlorohydrin; polyethylenimine; poly(3-butenyltrimethyl ammoniumchloride); poly(4-ethenylbenzyltrimethylammonium chloride); poly(2,3-epoxypropyltrimethylammonium chloride); poly(5-isoprenyltrimethylammonium chloride); and poly (acryloyloxyethyltrimethylammonium chloride). Other suitable cationic compounds having a high charge to mass ratio include all polysulfonium compounds, such as, for example the polymer made from the adduct of 2-chloromethyl; 1,3-butadiene and a dialkylsulfide, all polyamines made by the reaction of amines such as, for example, ethylenediamine, diethylenetriamine, triethylenetetraamine or various dialkylamines, with bis-halo, bis-epoxy, or chlorohydrin compounds such as, for example, 1-2 dichloroethane, 1,5-diepoxyhexane, or epichlorohydrin, all polymers of guanidine such as, for example, the product of guanidine and formaldehyde with or without polyamines. The preferred coagulant is poly(diallyldimethyl ammonium chloride) (i.e., DADMAC) having a molecular weight of about ninety thousand to two hundred thousand and polyethylenimene having a molecular weight of about forty thousand to five hundred thousand.

Another advantageous retention system suitable for the manufacture of paperboard of this invention is flocculation. This is basically the bridging or networking of particles through oppositely charged high molecular weight macromolecules. Alternatively, the bridging is accomplished by employing dual polymer systems. Macromolecules useful for the single additive approach are cationic starches (both amylase and amylopectin), cationic polyacrylamide such as for example, poly(acrylamide)-co-diallyldimethyl ammonium chloride; poly(acrylamide)-co-acryloyloxyethyl trimethylammonium chloride, cationic gums, chitosan, and cationic polyacrylates. Natural macromolecules such as, for example, starches and gums, are rendered cationic usually by treating them with 2,3-epoxypropyltrimethylammonium chloride, but other compounds can be used such as, for example, 2-chloroethyl-dialkylamine, acryloyloxyethyl-dialkyl ammonium chloride, acrylamidoethyltrialkylammonium chloride, etc. Dual additives useful for the dual polymer approach are any of those compounds which function as coagulants plus a high molecular weight anionic macromolecule such as, for example, anionic starches, CMC (carboxymethylcellulose), anionic gums, anionic polyacrylamides (e.g., poly(acrylamide)-co-acrylic acid), or a finely dispersed colloidal particle (e.g., colloidal silica, colloidal alumina, bentonite clay, or polymer micro particles marketed by Cytec Industries as Polyflex). Natural macromolecules such as, for example, cellulose, starch and gums are typically rendered anionic by treating them with chloroacetic acid, but other methods such as phosphorylation can be employed. Suitable flocculation agents are nitrogen containing organic polymers having a molecular weight of about one hundred thousand to thirty million. The preferred polymers have a molecular weight of about ten to twenty million. The most preferred have a molecular weight of about twelve to eighteen million. Suitable high molecular weight polymers are polyacrylamides, anionic acrylamide-acrylate polymers, cationic acrylamide copolymers having a molecular weight of about five hundred thousand to thirty million and polyethylenimenes having molecular weights in the range of about five hundred thousand to two million.

The third method for retaining the bulk additive in the fiberboard is entrapment. This is the mechanical entrapment of particles in the fiber network. Entrapment is suitably achieved by maximizing network formation such as by forming the networks in the presence of high molecular weight anionic polyacrylamides, or high molecular weight polyethyleneoxides (PEO). Alternatively, molecular nets are formed in the network by the reaction of dual additives such as, for example, PEO and a phenolic resin.

Preferably, the cellulosic web has been subjected to sizing and contains a sizing agent. Any suitable sizing technique known in the art may be used. By way of example, suitable sizing techniques include surface sizing and internal sizing. In FIG. 1 the surface sizing agent is added through line 64 to size press 65. In some special applications, 0–6 pounds of sizing agent is used for each three thousand square foot ream. For paperboards having a fiber mat density of about 3 to 8.3 pounds per 3000 square foot ream at a fiberboard thickness of 0.001 inch, suitably 1 to 30 pounds of surface sizing is added to a three thousand square foot ream. For paperboards having a fiber mat density of greater than 8.3 pounds per 3000 square foot ream at a fiberboard thickness of 0.001 inch, advantageously 6 to 30 pounds of surface sizing agent is added for each three thousand square foot ream. Advantageously. 15 to 30 pounds of surface agents are added for each 3000 square foot ream and preferably 16 to 19 pounds of the surface sizing agent is added for each 3000 square foot ream. The sizing agent functions to keep the GM tensile stiffness of the paperboard within the required parameters. By way of example, suitable surface sizing agents include starch, starch latex copolymers, animal glue, methyl cellulose, carboxymethyl cellulose, polyvinyl alcohol, and wax emulsions. Preferably, starch or a starch latex copolymer is employed as a sizing agent. By way of example, suitable commercially available sizing agents containing starch include "PENFORD® GUMS 200," "PENFORD® GUMS 220," "PENFORD® GUMS 230," "PENFORD® GUMS 240," "PENFORD® GUMS 250," "PENFORD® GUMS 260," "PENFORD® GUMS 270," "PENFORD® GUMS 280," "PENFORD® GUMS 290," "PENFORD® GUMS 295," "PENFORD® GUMS 300," "PENFORD® GUMS 330," "PENFORD® GUMS 360," "PENFORD® GUMS 380," "PENFORD® GUMS PENCOTE®," "PENFORD® GUMS PENSPRAE® 3800," "PENFORD® GUMS PENSURF," "PENGLOSS®," "APOLLO® 500," "APOLLO® 600," "APOLLO® 600-A," "APOLLO® 700," "APOLLO® 4250," "APOLLO® 4260," "APOLLO® 4280," "ASTRO® GUMS 3010," "ASTRO® GUMS 3020," "ASTROCOTE® 75," "POLARIS® GUMS LV," "ASTRO® x 50," "ASTRO® x 100," "ASTRO® x 101," "ASTRO® x 200," "ASTRO® GUM 21," "CALENDER SIZE 2283," "DOUGLAS®-COOKER 3006," "DOUGLAS®-COOKER 3007," "DOUGLAS®-COOKER 3012-T," "DOUGLAS®-COOKER 3018," "DOUGLAS®-COOKER 3019," "DOUGLAS®-COOKER 3040," "CLEARSOL® GUMS 7," "CLEARSOL® GUMS 8," "CLEARSOL® GUMS 9," "CLEARSOL® GUMS 10," "DOUGLAS®-ENZYME 3622," "DOUGLAS®-ENZYME E-3610," "DOUGLAS®-ENZYME E-3615," "DOUGLAS®-ENZYME 3022," "DOUGLAS®-ENZYME 3023," "DOUGLAS®-ENZYME 3024," "DOUGLAS®-ENZYME E," "DOUGLAS®-ENZYME EC," "CROWN THIN BOILING X-10," "CROWN THIN BOILING X-18," "CROWN THIN BOILING XD," "CROWN THIN BOILING XF," "CROWN THIN BOILING XH," "CROWN THIN BOILING XJ," "CROWN THIN BOILING XL," "CROWN THIN BOILING XN," "CROWN THIN BOILING XP," "CROWN THIN BOILING XR," "DOUGLAS®-UNMODIFIED PEARL," and "DOUGLAS®-UNMODIFIED 1200." These sizing agents are all commercially available from Penford Products Co. "PENFORD®," "PENCOTE®," "PENSPRAE®," "PENGLOSS®," "APOLLO®," "ASTRO®," "ASTROCOTE®," "POLARIS®," "DOUGLAS®," and "CLEARSOL®," are all registered trademarks of Penford Products Co. Other suitable starches, including "SILVER MEDAL PEARL™," "PEARL B," "ENZO 32 D," "ENZO 36W," "ENZO 37D," "SUPERFILM 245D," "SUPERFILM 270W," "SUPERFILM 240DW," "SUPERFILM 245D,"

"SUPERFILM 270W," "SUPERFILM 280DW," "PERFORMER 1," "PERFORMER 2," "PERFORMER 3," "CALIBER 100," "CALIBER 110," "CALIBER 124," "CALIBER 130," "CALIBER 140," "CALIBER 150," "CALIBER 160," "CALIBER 170," "CHARGE +2," "CHARGE +4," "CHARGE +7," "CHARGE +9," "CHARGE +88," "CHARGE +99," "CHARGE +110," "FILMFLEX 40," "FILMFLEX 50," "FILMFLEX 60," and "FILMFLEX 70," are all commercially available from Cargill, Inc.

The cationic wet strength agent used in the invention can be selected from among those cationic wet strength agents known in the art such as dialdehyde starch, polyethylenimine, mannogalactan gum, glyoxal, and dialdehyde mannogalactan. A particularly useful class of wet strength agent is cationic glyoxylated vinylamide wet strength resins.

In FIG. 1 the wet strength agent is optionally added to the feedstock through line (43) at the machine chest (44).

Glyoxylated vinylamide wet strength resins useful herein are described in U.S. Pat. No. 3,556,932 to Coscia. These resins are typically reaction products of glyoxal and preformed water soluble vinylamide polymers. Suitable polyvinylamides include those produced by copolymerizing a vinylamide and a cationic monomer such as 2-vinylpyridine, 2-vinyl-N-methylpyridinium chloride, diallyldimethyl ammonium chloride, etc. Reaction products of acrylamide diallyldimethyl ammonium chloride in a molar ratio of 99:1 to 75:25 glyoxal, and polymers of methacrylamide and 2-methyl-5-vinylpyridine in a molar ratio of 99:1 to 50:50, and reaction products of glyoxal and polymers of vinyl acetate, acrylamide and diallyldimethyl ammonium chloride in a molar ratio of 8:40:2 are more specific examples provided by Coscia. These vinylamide polymers may have a molecular weight up to 1,000,000, but polymers having molecular weights less than 25,000 are preferred. The vinylamide polymers are reacted with sufficient glyoxal to provide a water soluble thermoset resin. In most cases the molar ratio of glyoxal derived substituents to amide substitutes in the resin is at least 0.06:1 and most typically 0.1:1 to 0.2:1. A commercially available resin useful herein is Parez 631NC sold by Cytec Industries.

The cationic wet strength agent is generally added to the paperboard web in an amount up to about 8 pounds per ton or 0.4 wt %. Generally, the cationic wet strength agent is provided by the manufacturer as an aqueous solution and is added to the pulp in an amount of about 0.05 to 0.4 wt % and more typically in an amount of about 0.1 to 0.2 wt %. Unless otherwise indicated, all weights and weight percentages are indicated herein on a dry basis. Depending on the nature of the resin, the pH of the pulp is adjusted prior to adding the resin. The manufacturer of the resin will usually recommend a pH range for use with the resin. The Parez 631NC resin can be used at a pH of about 4 to 8.

Other wet strength agents used in practicing the invention can be selected from among those aminoplast resins (e.g., urea-formaldehyde and melamine-formaldehyde) resins and those polyamine-epichlorohydrin, polyamine epichlorohydrin or polyamide-amine epichlorohydrin or polyamide-amine epichlorohydrin resins (collectively "PAE resins") conventionally used in the papermaking art. Representative examples of these resins are described throughout the literature. See, for example, *Wet Strength in Paper and Paperboard*, TAPPI Monograph Series No. 29, TAPPI Press (1952) John P. Weidner, Editor, Chapters 1, 2 and 3 and U.S. Pat. Nos. 2,345,543 (1944); 2,926,116 (1965); and 2,926,154 (1960). Typical examples of some commercially available resins include the PAE resins sold by Hercules under the name Kymene, e.g., Kymene 557H and by Georgia Pacific under the name Amres, e.g., Amres 8855.

Kymene type wet strength agent is added to the paper fiber in an amount up to about 8 pounds per ton or 0.4 wt % and typically about 0.01 to 0.2 wt % and still more typically about 1 to 2 pounds per ton or 0.5 to 0.1 wt %. The exact amount will depend on the nature of the fibers and the amount of wet strength required in the product. These resins are generally recommended for use within a predetermined pH range which will vary depending upon the nature of the resin. For example, the Amres resins are typically used at a pH of about 4.5 to 9. It should be understood that since the use of the bulk enhanced paperboard of the invention will be used to make articles used in connection with food service, all the wet strength additives used to make articles for food service products should have FDA approval if the wet strength agents come into direct contact with the food products.

Advantageously the binder is applied, as shown in FIG. 1, at the coating section (67). Suitable binders include cationic starches, anionic starches, amphoteric starches, starch latex copolymers, animal glue, gelatin, methyl cellulose, carboxymethylcellulose, polyvinyl alcohol, ethylene-vinyl acetate copolymer, vinyl-acetate-acrylic copolymer, styrene butadiene copolymer, vinyl acetate-ethylene copolymer, acrylic copolymer, styrene acrylic copolymer, stearylated melamine, hydrophilic epoxy esters. Preferred binders include aliphatic-acrylate-acrylonitrile styrene copolymers such as the n-butyl-acrylate-acrylonitrile styrene copolymer, the n-amyl-acrylate-acrylonitrile styrene copolymer, the n-propyl-acrylate-acrylonitrile styrene copolymer, the n-ethyl-acrylate acrylonitrile styrene copolymer, and aliphatic acrylate styrene copolymers such as n-butyl acrylate styrene copolymer, n-amyl acrylate styrene copolymer, n-propyl acrylate styrene copolymer, or n-ethyl acrylate styrene copolymers. The preferred styrene-acrylic-acrylonitrile binder is BASF Acronal S 504. Suitable styrene-acrylic-acrylonitrile binders manufactured by BASF include Acronal S 888 S, and Acronal DSA 2285 X. Suitable styrene acrylonitrile binders manufactured by Dow Chemical Company include Latex XU 30879.50, Latex XU 30978.51, and Latex XU 30955.50. Suitable styrene acrylic polymers manufactured by BASF include Acronal S 304, Acronal S 760, Acronal 296 D, Acronal S 400, Acronal NS 567, Acronal S 702, Acronal S 728, and Acronal NX 4786. Styrene acrylic polymers manufactured by B.F. Goodrich include Carboset® GA-1086, Carboset® GA-2137, Carboset(E) GA-1161, and Carboset® XPD-2299. Styrene acrylic polymers manufactured by Morton International include Morton 4350, Morez® 101LS, Morez® 200, Morcryl® 132, Morcryl® 134, Morcryl® 350, Lucidene® 202, Lucidene® 361, and Lucidene® 371. Styrene acrylic polymers manufactured by Reichhold International include Reichhold Pa. 7002.

In FIG. 1, the binder, optionally in conjunction with the pigment, is applied in the coating section (67). Advantageously the clay pigment may be any suitable clay known to the art. For example, suitable pigments include kaolin clay, engineered clays, delaminated clays, structured clays, calcined clays, alumina, silica, aluminosilicates, talc, zinc sulfide, bentonite, glass powder, calcium sulfate, ground calcium carbonates, precipitated calcium carbonates, barite, titanium dioxide, and hollow glass or organic spheres. These pigments may be used individually or in combination with other pigments. Preferably the clay is selected from the group consisting of kaolin clay and conventional delaminated pigment clay. A commercially available delaminated pigment clay is "HYDRAPRINT" slurry, supplied as a dispersion with a slurry solids content of about 68%. "HYDRAPRINT" is a trademark of Huber.

The pigment composition may also comprise other additives that are well known in the art to enhance the properties of coating compositions or are well known in the art to aid in the manufacturing process. For example, suitable additives include defoamers, antifoamers, dispersants, lubricants, film-formers, crosslinkers, thickeners and insolubilizers.

A suitable defoamer includes "Foamaster DF122NS" and "Foamaster VF." "Foamaster DF122NS" is a trademark of Henkel.

A suitable organic dispersant includes "DISPEX N-40" comprising a 40% solids dispersion of sodium polycarboxylate, "DISPEX N-40" is a trademark of Allied Colloids and Berchem® 4290; a complex organic dispersant; and Berchem® 4809, a polyacrylate dispersant supplied by Berchem Inc. Other suitable dispersants are Accumer® 9000 and Accumer® 9500, polyacrylate dispersants; Tamol® 731; Tamol® 850, a sodium salt of polymeric carboxylic acid; Tamol® 960, a sodium salt of a carboxylated acrylic polyelectrolyte; and Tamol® 983, an organic polyacid dispersant. The Tamol dispersants are supplied by the Rohm & Haas Company. Polyphosphates and hexametaphosphates are also suitable dispersants.

A suitable coating lubricant includes "BERCHEM 4095" which is a 100% active coating lubricant based on modified glycerides. "BERCHEM 4095" is a trademark of Berchem. Other suitable lubricants are Berchem® 4000, a polyethylene emulsion; Berchem® 4060, a polyethylene emulsion; Berchem® 4110; Berchem® 4113, a modified diglyceride; Berchem® 4300, a fatty acid dispersion; Berchem® 4320, a fatty acid dispersion; and Berchem® 4569, a diglyceride emulsion, all supplied by Bercen Inc. In addition, the following lubricants are utilized: HTI Lubricant 1000, calcium stearate; HTI Lubricant 1100, a calcium stearate/polyethylene co-emulsion; and HTI Lubricant 1050, a polyethylene/carnauba wax co-emulsion supplied by Hopton Technologies, Inc.; and Sunkote® 455, calcium stearate supplied by Sequa Chemicals, Inc.

Suitable thickeners including the sodium alginate moiety are: Kelgin® LV, Kelgin® XL, Kelgin® RL, and Kelgin® QL; SCOGIN® QH, SCOGIN™ LV, and SCOGIN™ QL. Other suitable thickeners are propylene glycol alginates such as Kelcolloid® LVF; treated sodium alginates such as Kelgin® QM and Kelgin® QL. The Kelgin products are supplied by Merck & Co., Inc., and the Scogin products are supplied by Pronova Biopolymer, Inc.

Figure 20:
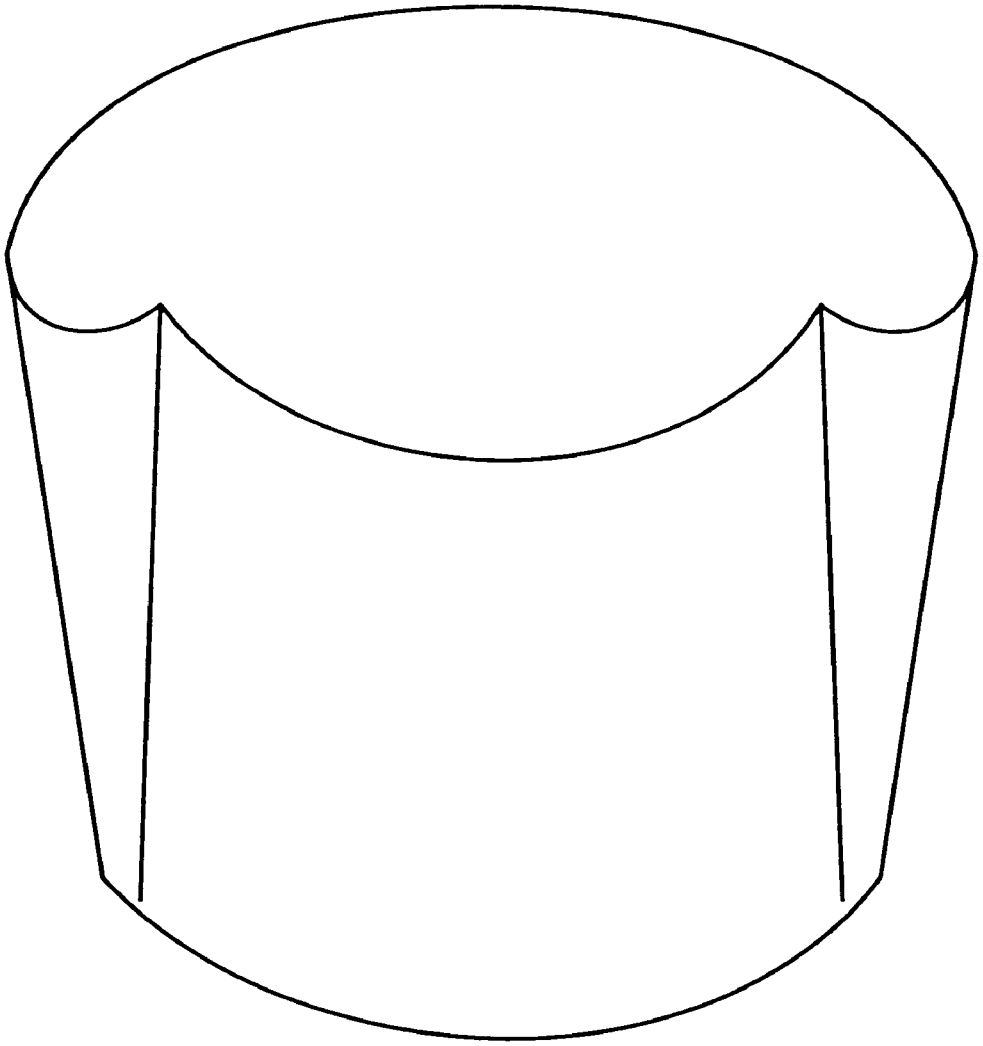
FIG. 20 is a drawing of a French fry sleeve of this invention formed from the paperboard of this invention.
Figure 21A:
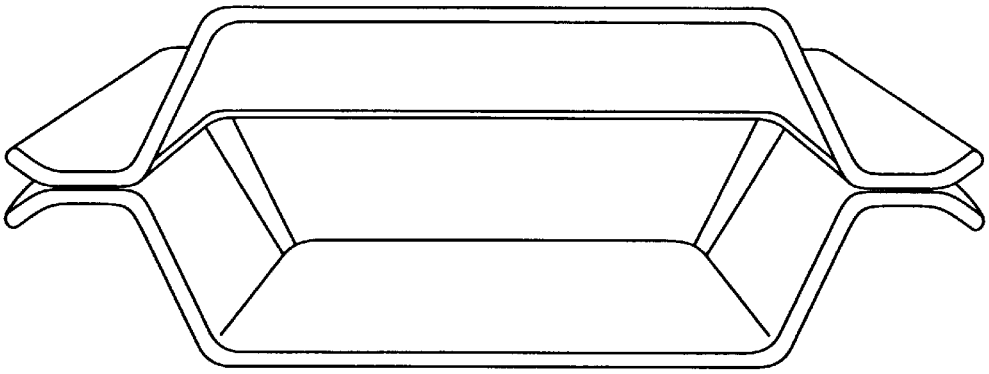
FIGS. 21A and B are drawings of a hamburger clam shell of this invention formed from the paperboard of this invention.
Figure 21B:
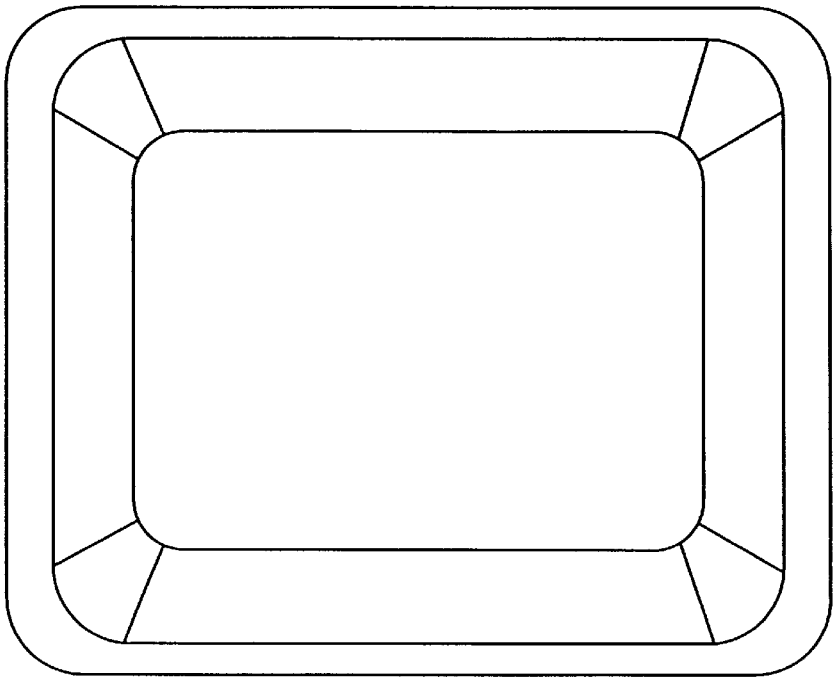
Figure 25A:
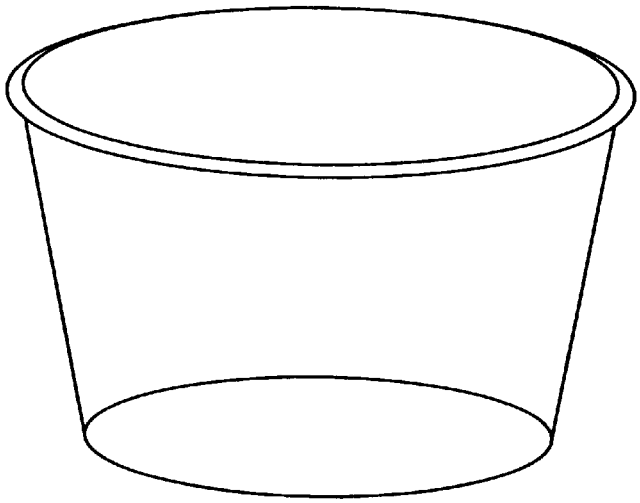
FIGS. 25A and B are drawings of the food bucket of this invention formed from the paperboard of this invention.
Figure 25B:
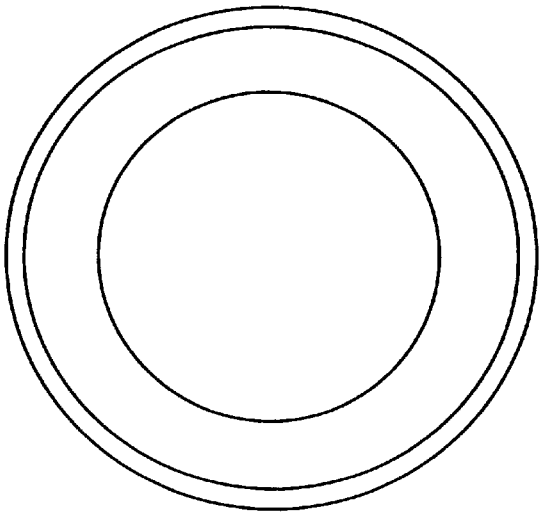

For applications where grease resistance is required such as in the formation of French fry sleeves, FIG. 20; hamburger clam shells, FIG. 21; and food buckets, FIG. 25; a coating of a fluorine containing polymer moiety is advantageously utilized. This coating is applied to the paperboard in the coating section, FIG. 1 (67). By way of example, suitable fluorine containing moiety polymers include fluorochemical copolymers. A preferable fluorochemical copolymer is ammonium di-[2-(N-ethyl-heptadecafluorosulfonamido)ethyl]phosphate. Ammonium di-[2-(N-ethyl-heptadecafluorosulfonamido)ethyl] phosphate is commercially available as "SCOTCHBAN FC-807" or "SCOTCHBAN FC-807A" (trademarks of 3M). "SCOTCHBAN FC-807 can be formed by the reaction of 2,2-bis[Γ,ω-perfluoro $C_{4-20}$ alkylthio)methyl]-1,3-propanediol, polyphosphoric acid and ammonium hydroxide. Other suitable fluorine containing moiety polymers include fluorochemical phosphates. A commercially available fluorochemical phosphate includes "SCOTCHBAN FC-809" (a trademark of 3M). "SCOTCHBAN FC-809" is an ammonium salt of a fluoroaliphatic polymer. Other suitable fluorine containing moiety polymers include fluoroalkyl polymers. Preferable fluoroalkyl polymers are poly(2-(N-methyl-heptadecafluorosulfonamido)ethylacrylate)-co-(2,3-epoxypropylacrylate)-co-(2-ethoxyethylacrylate)-co-(2-(2-methylpropenyloyloxy)ethyl-trimethylammonium chloride), and poly(2-(N-methyl-heptadecafluorosulfonamido)ethylacrylate)-co-(2,3-epxypropylacrylate)-co-(2-ethoxyethylacrylate)-co-(2-(2-methylpropenyloyloxy)ethyl-trimethylammonium chloride) commercially available as "SCOTCHBAN FC-845" or "SCOTCHBAN FX-845" (a trademark of 3M). "SCOTCHBAN FC-845" contains 35 to 40 weight percent fluorine and can be produced by the copolymerization of ethanaminium, N,N,N-trimethyl-2-[(2-methyl-1-oxo-2-propenyl)-oxy]-, chloride; 2-propenoic acid, 2-methyl-, oxiranylmethylester; 2-propenoic acid, 2-ethoxyethyl ester; and 2-propenoic acid, 2[[(heptadecafluoro-octyl) sulfonyl]methyl amino]ethyl ester. Another suitable commercially available fluorine containing moiety polymer includes "SEQUAPEL 1422" (a registered trademark of Sequa Chemicals, Inc.). Other suitable commercially available fluorine containing moiety polymers include "LODYNE® P-201" and "LODYNE® P-208E." "LODYNE® P-201" and "LODYNE" P-208E" are registered trademarks of Ciba-Geigy Corporation, Greensboro, N.C. "LODYNE® P-201" comprises a fluorinated organic acid diethanolamine salt having a 34% solids content, the remaining 66% comprising water. "LODYNE® P-208E" comprises a fluorinated alcohol phosphate ester salt having a 24% solids content, a 10% propylene glycol content, and a 66% water content.

In FIG. 1 it is shown that internal sizing agents are added to the feedstock along line 41 prior to the feedstock being pumped into the machine chest (44). The paperboard of this invention can advantageously be produced under acid, alkaline or neutral sizing conditions. Suitable internal sizing agents include rosin and alum, waxes, fatty acid derivatives, hydrocarbon resins, alkyl ketene dimers, and alkenyl succinic anhydrides. Alkenyl succinic anhydrides are organic chemicals comprising an unsaturated hydrocarbon chain containing pendant succinic anhydride moiety. Monocarboxylic fatty acids having a chain length of $C_8$ to $C_{22}$ are also suitable internal sizing agents. The rosin sizing agents include gum rosin, wood rosin, and tall oil rosin. Suitable $C_8$ to $C_{22}$ fatty acids useful as internal sizing agents include coprylic, capric, lauric, myristic, palmitic, stearic, arachidic, betenic, palmitoleic, oleic, ricinoleic, petroselinic, vaccenic, linoleic, linolenic, eleostearic, licenic, paranirac, gadoleic, arachidonic, cetoleic, and erycic.

Alum or aluminum salts used in the invention are water-soluble, and they may be aluminum sulfate, aluminum chloride, aluminum nitrate, or acid aluminum hydrophosphates in which P:Al=1.1:1–3:1.

In FIG. 1 the alum is added to the feedstock along line 41 prior to it being pumped into the machine chest (44). When these aluminum salts or their mixtures are used, a base is added to form aluminum hydroxide having anionic surface charges. The base used is suitably sodium or potassium hydroxide, sodium or potassium carbonate, sodium or potassium metasilicate, sodium or potassium watergases, sodium or potassium phosphate or borate, or sodium or potassium aluminate, or mixtures of these.

Aluminate compounds such as sodium aluminate or potassium aluminate are also used as the water-soluble aluminum salts. In this case, acid is added in order to form, within the pH range 7–9, an aluminum hydroxide having anionic surface charges. The acid used is a mineral acid such as sulfuric acid, hydrochloric acid, nitric acid or phosphoric acid, or organic acids such as oxalic acid, citric acid or tartaric acid. Suitably the acids used may also be acid aluminum salts such as aluminum sulfate, aluminum chloride, aluminum nitrate, or various water-soluble aluminum hydrophosphates.

Suitably water-soluble polymeric aluminum salts, i.e., polyaluminum salts, so-called basic aluminum salts, which are also called polyaluminum hydroxy salts or aluminum hydroxy salts are also used. In addition, the following salts are utilized: polyaluminum sulfate, polyaluminum chloride and polyaluminum chloride sulfate. The polyaluminum salt does suitably, in addition to the chloride and/or sulfate ion, also contain other anions, e.g., phosphate, polyphosphate, silicate, citrate, oxalate, or several of these.

Commercially available polymeric aluminum salts of this type include PAC (polyaluminum chloride), PAS (polyaluminum sulfate), UPAX 6 (silicate-containing polyaluminum chloride), and PASS (polyaluminum sulfate silicate).

The net formula of the water-soluble polyaluminum salt may be, for example:

$$n[Al_2(OH)_m/Cl)_{6-m}]$$

and its alkalinity may vary so that the m-value ranges from 1 to 5 (alkalinity is respectively 16–83% according to the formula (m:6)×100). In this case the ratio Al/OH is 2:1–1:2.5. n is 2 or higher.

When a polyaluminum compound is used, it may be desirable to add a base in order to optimize the Al/OH ratio, even if all of the polyaluminum compounds in accordance with the invention do work as such.

The said base or acid which forms in situ an aluminum hydroxide with the aluminum salt may be added to the fiber suspension, or just before the aluminum salt, or after it, or simultaneously with it.

The aluminum hydroxide may also be formed before the moment of adding, for example in the adding tube, or in advance in sol form.

The amount of the aluminum salt, calculated as $Al_2O_3$, is preferably approximately 0.01–1.0% of the dry weight of the pulp.

The deposition of the mixture onto the wire [FIG. 1 (58)] may be referred to as web laydown and an embryonic paper web is formed thereby. The embryonic web comes off the screen and is carried on various fabrics or felts where it undergoes wet pressing by suitable papermaking apparatus known in the art. After wet pressing, as shown in FIG. 1 (62), the embryonic web is about 60% water and about 40% papermaking fiber and other solid material discussed previously.

The embryonic web then undergoes further drying processes as shown in FIG. 1 (63), such as by means of vacuum boxes, through-air dryers, steam heated dryers, gas-fired dryers, or other suitable methods. When the bulk-enhancing agent comprises expandable microspheres, the drying of the embryonic web is done for a sufficient time and at a sufficient temperature to cause the microspheres to expand by the amount desired for the paperboard-making application. In one preferred laboratory process, after wet-pressing, the paperboard web is further dried using a suitable drying apparatus, such as that of M/K Systems, Inc., Series 8000, advancing the web at 3' per minute and exposing it to a temperature of 125° C., one pass per web side.

After a suitable amount of drying, the paper web passes through a nip where it is size-pressed as shown in FIG. 1 (65). A suitable size-press starch is applied. The size-press starch has solids which have been increased from the more typical 9.8% to between 20% and 40% and, preferably, to about 33%. The increased weight of the size-press starch combined with the decrease in fiber density caused by the expansion of the microspheres generate unexpected and significant improvements in the resulting bulk-enhanced paperboard. For instance, because the expanded microspheres increase the "openness" of the resulting paperboard, there is increased penetration of the size-press solids which allows for a greater amount of size-press starch to be retained within the paperboard, and, in turn, which generates thicker size-press layers having higher moduli of elasticity. The higher moduli and thicker size-press layers, in turn, improve bending and GM tensile stiffness. Improved bending and GM tensile and GM stiffness mean a desired rigidity or stiffness of paperboard may be obtained with a reduced fiber weight of papermaking fibers and other materials. The ability to reduce fiber weight while maintaining a desired rigidity, in turn, reduces material costs and improves productivity. The paperboards of this invention have at a fiber mat density of 3, 4.5, 6.5, 7, 8.3, and 9 pounds per 3000 square foot ream at a fiberboard thickness of 0.001 inch, a GM Taber stiffness of at least about 0.00716 $w^{2.63}$ grams-centimeter/fiber mat density$^{1.63}$ pounds per 3000 square foot ream at a fiberboard thickness of 0.001 inch, and a GM tensile of 1890+24.2 w pounds per inch. The preferred GM Taber stiffness is 0.00501 $w^{2.63}$ grams-centimeter/fiber mat density$^{1.63}$ pounds per 3000 square foot ream at a fiberboard thickness of 0.001 inch, and the preferred GM tensile stiffness is 1323+24.2 w pounds per inch. The GM Taber stiffness values for a paperboard having a fiber mat density of 3, 4.5, 6.5, 7, and 8.3 pounds per 3000 square foot ream at a fiberboard thickness of 0.001 inch are 0.00120 $w^{2.63}$ grams-centimeter/fiber mat density$^{1.63}$ pounds per 3000 square foot ream at a fiberboard thickness of 0.001 inch, 0.00062 $w^{2.63}$ grams-centimeter/fiber mat density$^{1.63}$ pounds per 3000 square foot ream at a fiberboard thickness of 0.001 inch, 0.00034 $w^{2.63}$ grams-centimeter/fiber mat density$^{1.63}$ pounds per 3000 square foot ream at a fiberboard thickness of 0.001 inch, 0.00030 $w^{2.63}$ grams-centimeter/fiber mat density$^{1.63}$ pounds per 3000 square foot ream at a fiberboard thickness of 0.001 inch, and 0.00023 $w^{2.63}$ grams-centimeter/fiber mat density$^{1.63}$ pounds per 3000 square foot ream at a fiberboard thickness of 0.001 inch, at a GM tensile stiffness of 1890+24.2 w pounds per inch. The preferred GM Taber stiffness values for a board having a fiber mat density of about 3, 4.5, 6.5, 7, and 8.3 pounds per 3000 square foot ream at a fiberboard thickness of 0.001 inch, are 0.0084 $w^{2.63}$ grams-centimeter/fiber mat density$^{1.63}$ pounds per 3000 square foot ream at a fiberboard thickness of 0.001 inch, 0.00043 $w^{2.63}$ grams-centimeter/fiber mat density$^{1.63}$ pounds per 3000 square foot ream at a fiberboard thickness of 0.001 inch, 0.00024 $w^{2.63}$ grams-centimeter/fiber mat density$^{1.63}$ pounds per 3000 square foot ream at a fiberboard thickness of 0.001 inch, 0.00021 $w^{2.63}$ grams-centimeter/fiber mat density$^{1.63}$ pounds per 3000 square foot ream at a fiberboard thickness of 0.001 inch, and 0.00016 $w^{2.63}$ grams-centimeter/fiber mat density$^{1.63}$ pounds per 3000 square foot ream at a fiberboard thickness of 0.001 inch, at a GM tensile stiffness of 1323+24.2 w pounds per inch. At a fiber mat density of 3, 4.5, 6.5, and 7 pounds per 3000 square foot ream at a fiberboard thickness of 0.001 inch, the GM Taber stiffness values are 0.00120 $w^{2.63}$ grams-centimeter/fiber mat density$^{1.63}$ pounds per 3000 square foot ream at a fiberboard thickness of 0.001 inch, 0.00062 $w^{2.63}$ grams-centimeter/fiber mat density$^{1.63}$ pounds per 3000 square foot ream at a fiberboard thickness of 0.001 inch, 0.00034 $w^{2.63}$ grams-centimeter/fiber mat density$^{1.63}$ pounds per 3000 square foot ream at a fiberboard thickness of 0.001 inch, and 0.00030 $w^{2.63}$ grams-centimeter/fiber mat density$^{1.63}$ pounds per 3000 square foot ream at a fiberboard thickness of 0.001 inch, at a GM tensile stiffness of 1890+24.2 w pounds per inch. The preferred GM Taber stiffness values are 0.0084 $w^{2.63}$ grams-centimeter/fiber mat density$^{1.63}$ pounds per 3000 square foot ream at a fiberboard thickness of 0.001 inch, 0.00043 $w^{2.63}$ grams-centimeter/fiber mat density$^{1.63}$ pounds per 3000 square foot ream at a fiberboard thickness of 0.001 inch, 0.00024 $w^{2.63}$ grams-centimeter/fiber mat density$^{1.63}$ pounds per 3000 square foot ream at a fiberboard thickness of 0.001 inch, and 0.00021 $w^{2.63}$ grams-centimeter/fiber mat density$^{1.63}$ pounds per 3000 square foot ream at a fiberboard thickness of 0.001 inch, at a GM tensile stiffness of 1323+24.2 w pounds per inch. These values are achieved by controlling the dispersion of bulk and porosity additives throughout the thickness of the paperboard and controlling the extent of penetration of the size press applied binder and optionally pigment. The overall fiber weight of the paperboard is controlled to be at least 40 lbs./3000 square foot ream. This value is usually in the range of 60 to 320 lbs./3000 square foot ream, preferably 80 to 220 lbs./3000 square foot ream.

The paperboard web is calendered by suitable apparatus, as shown in FIG. 1 (68), known in the art to achieve the smoothness appropriate for the requirements of the grade of paperboard for the selected application. The resulting paperboard web may then be further processed and shaped by suitable apparatus, such as is shown in FIG. 2 (75), to form appropriate paper containers such as cartons, folding paper boxes, high quality, cups, FIGS. 23 and 24; plates, FIG. 16; compartmented plates, FIG. 17; bowls, FIG. 18; canisters, FIG. 19; French fry sleeves, FIG. 20; hamburger clam shells, FIG. 21; rectangular take-out containers, FIG. 22; food buckets, FIG. 25; and other consumer products.

In many applications substrates prepared from polyolefins, polyesters, polyaramids, and polyanilates can fully or partially replace the cellulosic moiety. These synthetic fibers should be spunbonded, melt blown, or produced by any other suitable method. This invention includes the use of synthetic fibers in combination with cellulosic fiber formed in the papermaking process. Suitable synthetic fibers include Typan® 3141, a spunbonded polypropylene; Reemay® 2033, a spunbonded polyester; Tyvek® 1079, and a spunbonded high density polyethylene.

Figure 7:
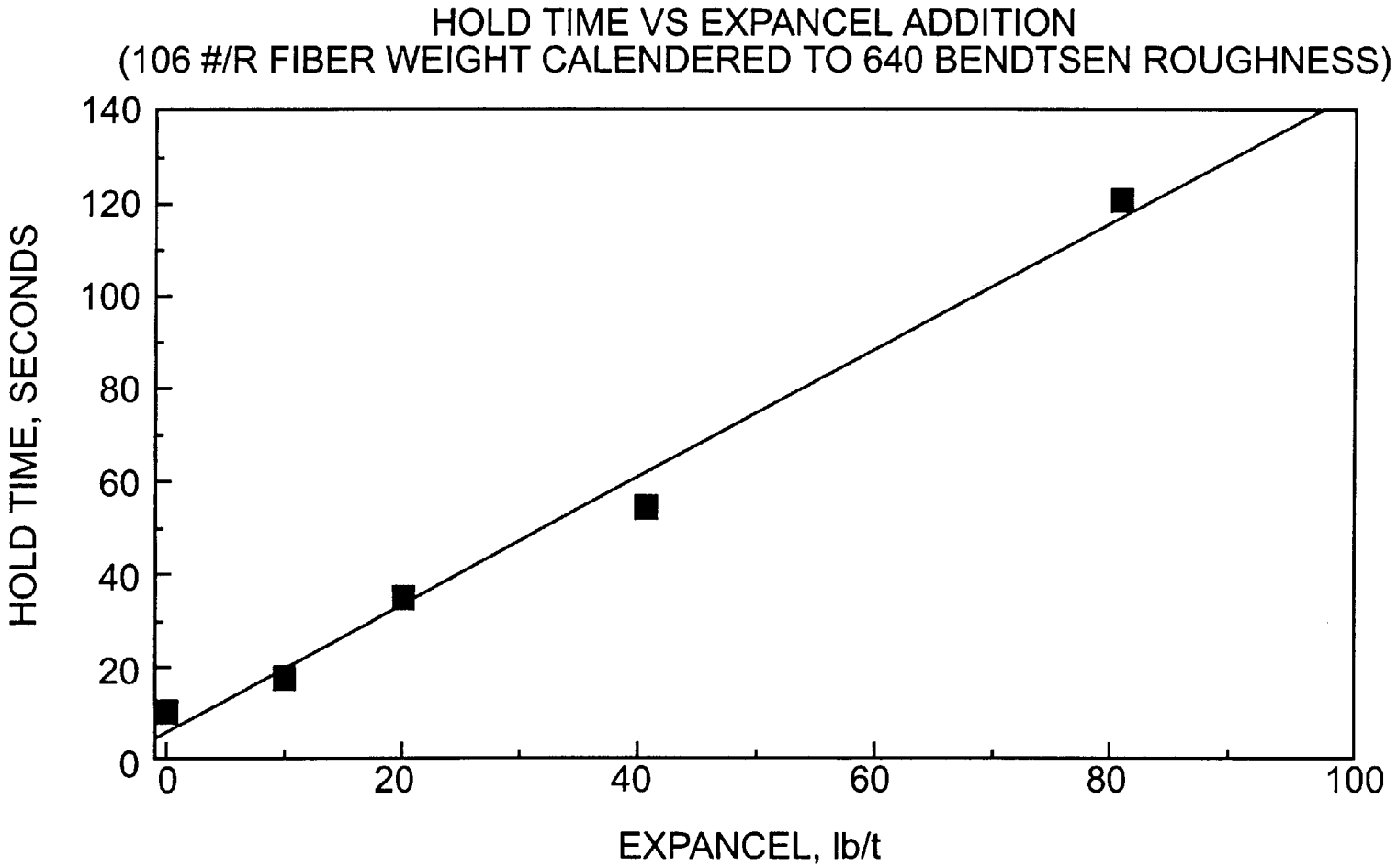
FIG. 7 is a graph depicting the hold time versus amount of bulk enhancing additive added for each ton of paperboard.
Figure 8:
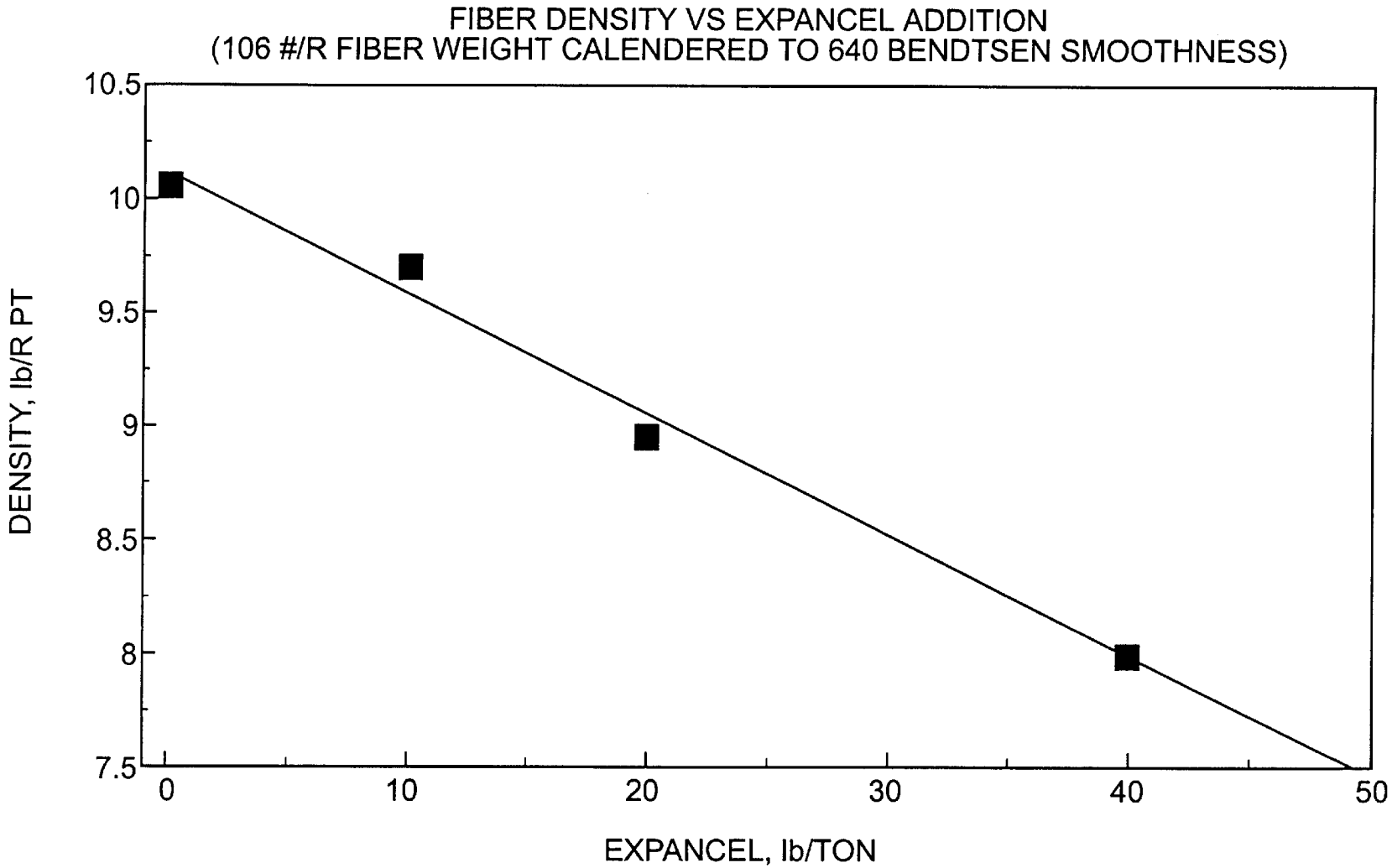
FIG. 8 is a graph depicting the reduction of fiber density versus amount of bulk enhancing additive added for each ton of paperboard.

For certain applications, the resulting paperboard web may be coated on one or both sides with a polyolefin layer, preferably a polyethylene layer. Such a layer is particularly useful inside a paper cup. This cup has an inner and an outer surface which when filled with a liquid at 190° F. exhibits thermal insulation properties such that the outer surface does not reach a temperature of about 140° to 145° F., in less than thirty seconds. The results depicted in the graph of FIG. 7 show that the ability to hold a hot drink cup without discomfort increases as a function of increased addition of expandable microspheres. FIG. 8 shows the effect of density of the paperboard on thermal insulation and hold time. To apply the polyethylene layer, the paper web or paper blank is sprayed with a suitable fast-drying adhesive, as is the polyethylene sheet material, after which the polyethylene sheet material and the paper web or blank are laminated together by any suitable means, such as by a press nip.

The paperboard of this invention has improved formability. The improved formability of the paperboard of this invention is useful in all shaping applications that require deformation of the paperboard. This property of the paperboard is particularly useful in the top curl forming for rolled brim containers such as cups shown in FIGS. 23 and 24. The improved formability of the paperboard also facilitates the drawing of plates, FIGS. 16 and 17, and bowls, FIG. 18.

The paperboard and method for its manufacture according to the present invention has the advantage of producing an excellent distribution of expandable microspheres or other bulk enhancers in the paper fiber network, as described in Examples 3 and 5 through 12. The percentage of added bulk enhancer retained in the paperboard web is also improved significantly as demonstrated in Examples 1, Examples 5 through 12, and FIGS. 31A through 31E.

Improving the distribution and retention rate of the microspheres or other bulk enhancers in the paperboard improves its thermal resistance, smoothness, strength, and rigidity. Uniform distribution also eliminates interference with paper machine apparatus when non-thermal grade papers are run after a process employing the bulk enhancing additives of this invention. The paper machine dryer sticking problems are reduced and dusting or other undesirable interference with printing upon the paperboard is also reduced by virtue of the reduced distribution of microspheres in the periphery of the paperboard.

For aesthetic purposes, the surface of the paperboard may be printed with a design or other printing (not shown).

The preferred die or press, FIG. 2 (75), includes male and female die surfaces which define the shape and thickness of the article of manufacture. Preferably, at least one die surface is heated so as to maintain a temperature during pressing of the blank in the range of about 200° F. to 400° F. Preferably the press imposes pressures on the blank in the range of about 300 psi to 1500 psi.

In many food applications it is desirable to coat either the paperboard or the article of manufacture with a wax having a melting point of about 130° F. to 150° F. The wax treated board or article of manufacture is coated with binders and optionally pigments disclosed herein.

Figure 35:
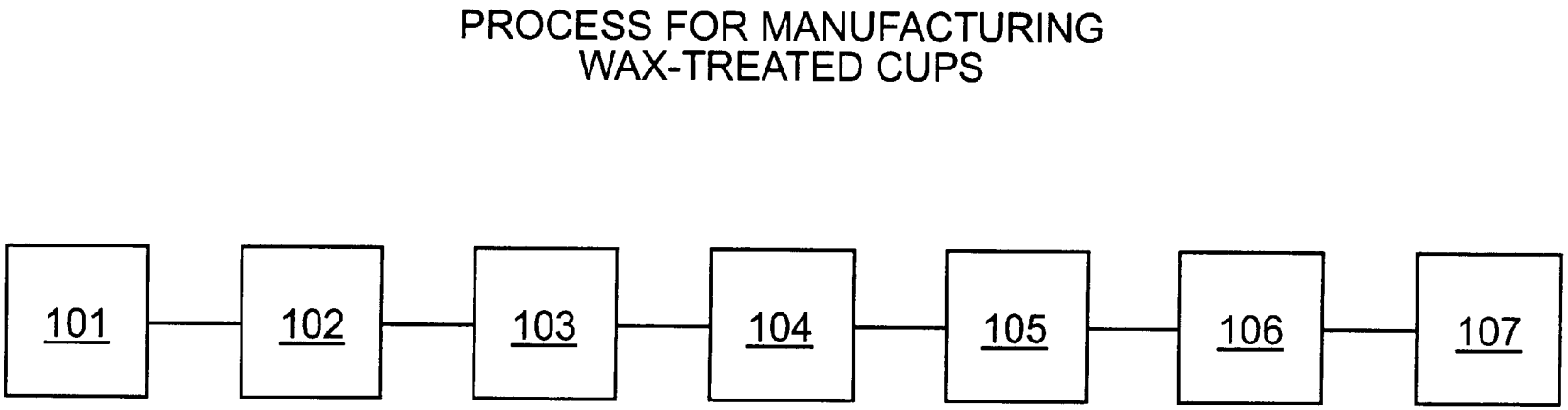
FIG. 35 is a flow diagram depicting the process for the manufacture of cups coated with wax having a melting point of about 130° F. to about 150° F.
Figure 36B:
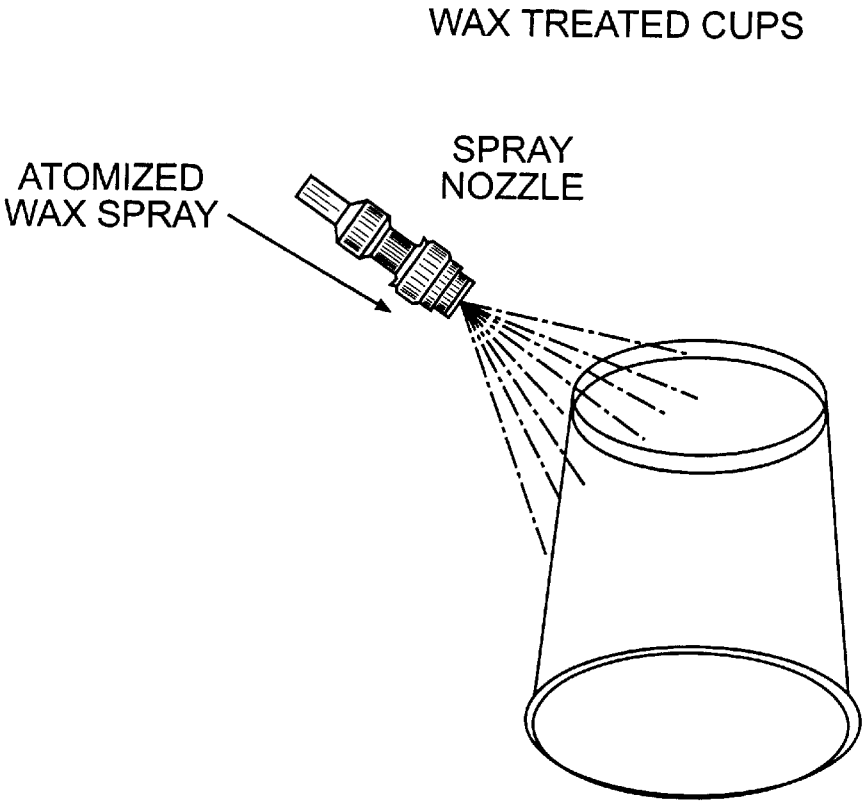
FIGS. 36A and B are drawings of preferred methods for applying the wax to cellulosic cups.
Figure 36A:
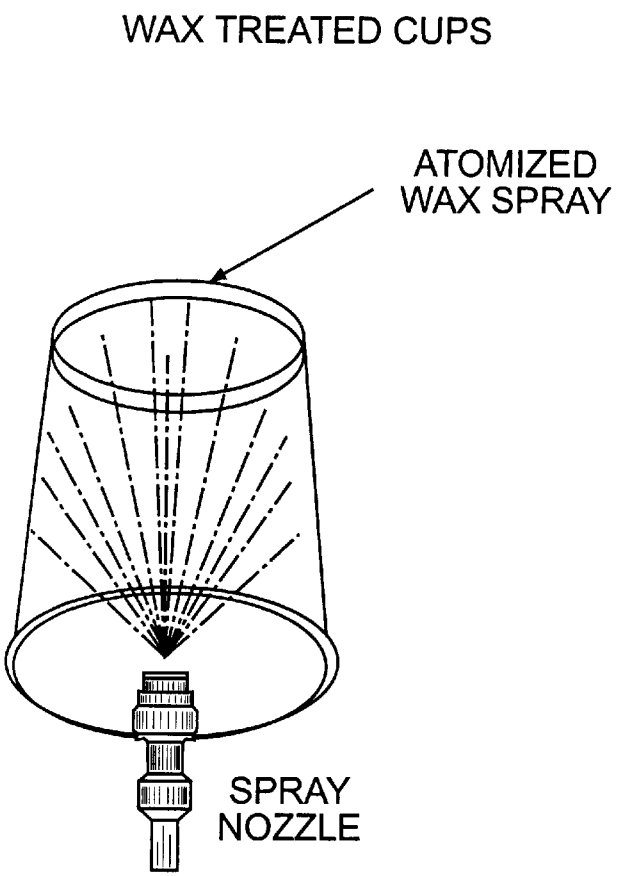

A schematic diagram of the wax treatment process for cups is shown in FIG. 35. The paperboard cups to be treated with wax can be pre-formed on a cup machine (101). A stack of cups is fed into the dispenser (102) in a chute. Single cups are separated from the bottom of a stack of cups by the dispenser and dropped to a conveyor belt for transfer to the treater head where wax is applied (103). The cups are fed onto a turret which revolves the cups through the waxing process. Liquid paraffin or wax is pumped to the spray nozzles for the desired distribution onto the cups. The first spray, FIG. 36A, is located beneath the turret and is positioned to spray the inside of the cup immediately after the start of the spin cycle. Through the spin cycle, the wax is distributed evenly over the inside surface of the cup. A second spray, shown in FIG. 36B, is located just above and outside the spinning cup and is positioned to spray wax on the outside of the cup immediately after the start of the spin cycle. Any excess wax is returned for redistribution through a piping system (104). The treated cups are then returned to a freewheel for transfer to a conveyor belt which is heated to prevent sudden cooling of the wax (105). The cups are then counted either with an automatic electronic counter or a manually operated mechanical counter and then guided into stacks of the desired quantity (106) which are then ready for packing (107).

Waxes suitable for use with the cups conform to the FDA requirements for food packaging and have a melting point in the range of about 130° F. to 150° F. Examples of waxes that are suitable for this application include Parvan 142 and Parvan 145 which are refined food grade waxes supplied by Exxon Co.; Sunwax 200, a blended food grade wax supplied by Sun Co. Inc.; and 1240, a fully refined paraffin wax supplied by the International Group.

Suitably, an article of manufacture such as a carton, container or cup is prepared from a cellulosic paperboard comprising: (a) predominantly cellulosic fiber; (b) bulk and porosity enhancing additives selected from the group consisting of expanded or unexpanded, uncoated microspheres, expanded or unexpanded coated microspheres, expanded or unexpanded microspheres, coated discontinuously, high bulk additive (HBA) fibers, and the thermally and/or chemically treated cellulose fibers rendered anfractuous or mixtures of expanded or unexpanded coated, uncoated, or discontinuously coated microspheres and HBA fibers, and thermally or chemically treated anfractuous fibers interspersed with said cellulosic fibers in a controlled distribution throughout the thickness of said paperboard; and (c) retention aids selected from the group consisting of coagulation agents, flocculation agents, and entrapment agents are dispersed with the bulk and porosity enhancing additives and cellulosic fibers; and (d) the amount of size press binder applied optionally including a pigment is in the range of about 0 to 6 lbs./3000 square foot ream; and (e) suitably the fiber weight of the web is in the range of about 40 to 320 lbs./3000 square foot ream. All binders and pigments disclosed in this application are satisfactory in the manufacture of the article of manufacture such as a carton, container, or cup.

Suitably, one or both sides of the paperboard, article of manufacture, container, or cups are coated with a polyolefin or wax. All the polyolefins and waxes disclosed herein are suitable coatings.

Suitable expandable microspheres are commercially available. Expancel 820WU microspheres, which are manufactured by Expancel Inc. of Sundsvall, Sweden, are presently preferred. These white, spherical particles have a thermoplastic shell encapsulating isobutane gas. The thermoplastic shell consists of a copolymer of vinylidene chloride and acrylonitrile that softens and expands as the encapsulated gas increases in pressure upon heating.

In the unexpanded form, the microspheres can be made in a variety of sizes; those readily available in commerce being most often on the order of 2 to 20 microns, particularly 3 to 10 microns. It is possible to make microspheres in a wider range of sizes, and the present invention is applicable to them as well. Microspheres can vary in size from 0.1 microns to 1 millimeter in diameter before expansion. While variations in shape are possible, the available microspheres are characteristically spherical, with the central cavity containing the blowing agent being generally centrally located. Dry, unexpanded microspheres typically have a displacement density of just greater than 1, typically about 1.1. When such microspheres are expanded, they are typically enlarged in diameter by a factor of 5 to 10 times the diameter of the unexpanded beads, giving rise to a displacement density, when dry, of 0.1 or less often about 0.03 to 0.06.

Suitably commercially available microspheres include the following supplied by Expancel Inc.: Expancel® 051, Expancel® 053, Expancel® 053-80, Expancel® 091-80, Expancel® 461, Expancel® 461-20, Expancel 642, Expancel® 551, Expancel® 551-20, Expancel® 551-80, Expancel 820 WU, and Expancel® KK; and Micropearl Microspheres F-30, F-50, and F-80 supplied by Matsumoto Yushi-Seivaku Co.

The microspheres are optionally coated. The coating must be finely divided enough to be able to effectively blend with and adhere to the surfaces of the microspheres. The maximum major dimension of the particle size should be no larger than about the diameter of the expanded microspheres, and preferably less. The minor dimensions will generally be as small as possible, which imposes a de facto lower limit of effectively about 2 microns.

While the coating may be either organic or inorganic, there are ordinarily considerable advantages to the employment of inorganic materials as at least a substantial component of the coating. Such materials are commonly available in the dimensions of interest, they are common inclusions along with the microspheres in a wide diversity of foam formulations, they pose few problems in compounding and formulating end uses of the microspheres, and they are generally less expensive. It is also generally easier to assure that the coating does not itself develop undesirable characteristics in the processing, i.e., by becoming tacky itself or the like.

The coating materials are desirably materials which are pigments, reinforcing fillers, or reinforcing fibers in polymer formulations and thus are commonly used in the formulations where the microspheres are to be used. For example, talc, barium sulfate, alumina, such as particularly alumina tri-hydrate, silica, titanium dioxide, zinc oxide, and the like and mixtures of these may be employed. Other materials of interest include spherical beads, or hollow beads, of ceramics, quartz, or glass. Among the fibrous materials of interest are glass fibers, cotton flock, carbon and graphite fibers, and the like.

In another embodiment of this invention, retention aids can be coated continuously or discontinuously on the microspheres. The retention aids which function through coagulation, flocculation, or entrapment of the bulk additive can suitably be coated continuously or discontinuously on the microspheres. Mixtures of the coagulation, flocculation, and entrapment agents may advantageously be employed. Suitable coagulants coated on the microspheres include inorganic salts such as alum or aluminum chloride and their polymerization products (e.g. PAC or poly aluminum chloride or synthetic polymers); poly(diallyldimethyl ammonium chloride) (i.e., DADMAC); poly(dimethylamine)-co-epichlorohydrin; polyethylenimine; poly(3-butenyltrimethyl ammoniumchloride); poly(4-ethenylbenzyltrimethylammonium chloride); poly(2,3-epoxypropyltrimethylammonium chloride); poly(5-isoprenyltrimethylammonium chloride); and poly (acryloyloxyethyltrimethylammonium chloride). Other suitable cationic compounds having a high charge to mass ratio which can be coated on microspheres include all polysulfonium compounds, such as, for example the polymer made from the adduct of 2-chloromethyl; 1,3-butadiene and a dialkylsulfide, all polyamines made by the reaction of amines such as, for example, ethylenediamine, diethylenetriamine, triethylenetetraamine or various dialkylamines, with bis-halo, bis-epoxy, or chlorohydrin compounds such as, for example, 1-2 dichloroethane, 1,5-diepoxyhexane, or epichlorohydrin, all polymers of guanidine such as, for example, the product of guanidine and formaldehyde with or without polyamines.

Macromolecules useful for coating the microspheres include cationic starches (both amylose and amylopectin), cationic polyacrylamide such as for example, poly (acrylamide)-co-diallyidimethyl ammonium chloride; poly (acrylamide)-co-acryloyloxyethyl trimethylammonium chloride, cationic gums, chitosan, and cationic polyacrylates. Natural macromolecules such as, for example, starches and gums, are rendered cationic usually by treating them with 2,3-epoxypropyltrimethylammonium chloride, but other compounds can be used such as, for example, 2-chloroethyl-dialkylamine, acryloyloxyethyldialkyl ammonium chloride, acrylamidoethyltrialkylammonium chloride, etc. Dual additives useful for the dual polymer approach coated on the microspheres are any of those compounds which function as coagulants plus a high molecular weight anionic macromolecule such as, for example, anionic starches, CMC (carboxymethylcellulose), anionic gums, anionic polyacrylamides (e.g., poly(acrylamide)-co-acrylic acid), or a finely dispersed colloidal particle (e.g., colloidal silica, colloidal alumina, bentonite clay, or polymer micro particles marketed by Cytec Industries as Polyflex). Natural macromolecules such as, for example, cellulose, starch and gums may be used as coatings for microspheres. These coatings are typically rendered anionic by treating them with chloroacetic acid, but other methods such as phosphorylation can be employed.

Retention agents used in entrapment are suitably coated continuously or discontinuously on the microspheres. Suitable coatings include high molecular weight anionic polyacrylamides or high molecular weight polyethyleneoxides (PEO) and a phenolic resin.

GM tensile stiffness and GM Taber stiffness are measured according to the following procedures. Taber stiffness is defined by the following equation:

$$\text{TENSILE STIFFNESS}=\text{YOUNG}\times\text{MODULUS}\times\text{CALIPER}$$

where $$\text{YOUNG'S MODULUS}=\Delta\sigma/\Delta\epsilon$$

Young's Modulus is defined as the change in specimen stress per unit change in strain. The stress-strain relationship is expressed as the slope of the initial linear portion of the curve where stress is the y-axis and strain is the x-axis. Caliper is the thickness of a single sheet of the paperboard, expressed in inches, and is measured using TAPPI Test Method T411 om 89.

As the economic value for paperboard in many applications in commerce depends on its GM Taber stiffness or flexural rigidity, this is an important property. Taber stiffness values are determined as set forth in TAPPI method T 489 om 92. The Taber-type stiffness test procedure is used to measure the stiffness of paperboard by determining the bending moment, in gram centimeters, necessary to deflect the free end of a 38 mm wide vertically clamped specimen 15° from its center line when the load is applied 50 mm away from the clamp.

Related methods: International Organization for Standardization ISO2493; Technical Association of the Australian and New Zealand Pulp and Paper Industry APPITA P431; British Standard Institution BSI3748; Scandinavian Pulp Paper and Board Testing Committee SCAN P-29. Precision of the GM Taber Stiffness Test TAPPI 52(6): 1136 (1969).

The terms GM Taber stiffness, GM tensile stiffness, Canadian Standard Freeness and Bendtsen Smoothness are defined as follows: GM Taber stiffness is defined as $$\sqrt{T_{MD}\times T_{CD}}$$

where $T_{MD}$ is the Taber stiffness value in the machine direction (MD) and $T_{CD}$ is the Taber stiffness value in the cross machine direction (CD); GM tensile stiffness is defined as $$\sqrt{t_{MD}\times t_{CD}}$$

where $t_{MD}$ is the Taber stiffness value in the machine direction (MD) and $t_{CD}$ is the Taber stiffness value in the cross machine direction (CD); Canadian Standard Freeness measurements were carried out according to TAPPI test method T227 om 94; Bendtsen Smoothness means the smoothness of the paperboard is determined by measuring the volume of air leakage across the narrow contacting ring of a smoothness head resting on the paperboard with a Bendtsen-type tester according to the TAPPI procedure UM 535. Related method: SCAN-P21.

Fiber mat density of the paperboard is expressed in pounds for each 3000 square foot ream at a fiberboard thickness of 0.001 inch. In the paper art, each 0.001 inch board thickness is referred to as a point.

The GM Taber stiffness is expressed as grams-centimeter divided by fiber mat density to the 1.63 power wherein the fiber mat density of the paperboard is expressed as set forth herein above. The GM tensile stiffness is expressed in pounds per inch.

The following examples are illustrative of the present invention. It should be understood that the examples are not intended to limit the invention and that various changes may be made by those skilled in the art without changing the essential characteristics and the basic concept of the invention.

In the following examples, various trademarked chemical compositions are used. The following is a description of these compositions which have been found to be suitable retention aids.

Cytec Accurac® 181 is a cationic polyacrylamide supplied as a water-in-oil emulsion where the oil is a hydrotreated light petroleum distillate. The molecular weight of the polyacrylamide is in the range of ten to twelve million.

Cytec Accurac® 120 is a cationic polyacrylamide supplied as a water-in-oil emulsion where the oil is a hydrotreated light petroleum distillate. The polyacrylamide has a molecular weight of about fifteen million.

Hercules Microform® 2321 is a cationic acrylamide copolymer emulsion mixed with a paraffinic, naphthenic petroleum distillate having a molecular weight in the range of about one hundred thousand to one million.

Hercules Microform® BCS is a modified bentonite (hydrated aluminum silicate) slurry in water.

Hercules Neuphor® 635 is a white anionic rosin emulsion in aqueous solution.

Hercules Reten® 203 is an aqueous dispersion of a cationic poly(diallyldimethyl ammonium chloride) (i.e., DADMAC) having a molecular weight of about one hundred thousand to two hundred thousand.

Nalco® 625 is an anionic acrylamide-acrylate polymer water-in-oil emulsion which is a hydro-treated light distillate and has a molecular weight of about 16 to 18 million.

Nalco® 8674 is a low molecular weight, highly cationic aqueous solution of polyamine.

Nalco Positek® 8678 is a water-soluble anionic micropolymer.

Polymin® PR 971L is a polyethylenimine having a molecular weight in the range of about five hundred thousand to two million being supplied by BASF in an aqueous solution.

EXAMPLE 1

An aqueous suspension of paper fibers and the other additives as summarized in Table 1 was used in this example:

TABLE 1

| Order of Addition | Additive | Level of Addition |
|---|---|---|
| 1 | Hardwood Kraft | 75% (600 CSF) |
| 2 | Softwood Kraft | 25% (600 CSF) |
| 3 | Alum | 10 lb./ton |
| 4 | HCl or NaOH | To pH of 4.8 |
| 5 | Cationized Corn Starch (Apollo 600) | 12 lb./ton |
| 6 | Rosin Size (Neuphor 635) | 6 lb./ton |
| 7 | Poly-DADMAC (Reten 203) | 2 lb./ton |
| 8 | Expandable Microspheres (Expancel 820) | 0, 10, 20, 40, 80 lb./ton |

The above materials (except microspheres) were sheared for about 30 seconds at 1500 rpm using a Britt jar stirrer to form an aqueous suspension and then introduced into the sheet-forming apparatus at a level of about 0.5% by weight solids. The suspension was formed into 106 lbs. per ream (3000 square feet) sheets using a suitable sheet-forming apparatus, preferably M/K Systems, Inc. (Series 8000), which forms one or more hand sheet of about 13" square as described below. The sheet mold was filled with water at 40° C. and a forming temperature of 40° C. was used.

The suspension was inverted, rather than poured into a sheet mold having a 60-mesh count. The suspension was drained, the sheet mold was opened, and the sheet was couched with blotter stock as described in TAPPI Standard T205.

The embryonic sheet was wet-pressed dynamically, that is by means of a suitable wet-press nip at approximately 3' per minute and 60 psi, thereby sandwiching the embryonic sheet between dry blotter stock. After wet-pressing, the hand sheet was dried using suitable drying apparatus, such as that of M/K Systems, Inc. (Series 8000), set at 3' per minute, 125° C., one pass per side, which expanded the expandable microspheres contained in the embryonic sheet.

The paper handsheets were size-pressed with a starch and pigment solution having a solids content of about 33% by weight.

The hand sheet was then calendered on a suitable calender, preferably Beloit Wheeler Model 700 operated at 100' per minute, 400 psi, and 150° F. Although smoothness of the resulting paperboard may be varied to suit particular applications, in this example, a drink cup application was simulated and a smoothness of about 640 Bendtsen was attained using the calender stack as described above.

Polyethylene sheet material, such as product 5727-001 (2 mil thickness) available from Consolidated Thermoplastics Co., was used to coat one side of the hand sheet. The polyethylene sheet material and hand sheet were sprayed with Fast Tack Adhesive 3102 from Spray On, Inc., of Bedford Heights, Ohio. The polyethylene sheet and hand sheet were disposed and registered with each other and laminated together using a suitable press nip at 3' per minute and 50 psig. The laminate was heated with a suitable heating apparatus, such as a heat gun by Master Appliance Corp. of Racine, Wis., to 750° F.–1000° F., thereby enhancing the adhesion and uniformity of the laminate structure.

The resulting hand sheet was cut into nine-ounce cup blanks. A rolled cup brim was formed by top curl forming and other required deformations of the cup blank were accomplished using suitable tooling known in the art.

The above described wet-end chemistry and hand sheet formation steps were conducted with the addition, as noted in Table 1 above, of Expancel 820 microspheres at levels of 10, 20, 40, and 80 pounds per ton and compared with a control which did not include any expandable microspheres.

The reduction of paper density (i.e., its bulk enhancement) is shown in FIG. 8 after calendering to a 640 Bendtsen smoothness. The decrease in paperboard density corresponding to addition of expandable microspheres in a proportion of 20 lbs. per ton is from 8.8 to 6.6 lbs. per ream per point. FIG. 8 illustrates that there is a twenty-seven percent decrease in density for every one percent addition of microspheres.

Figure 10:
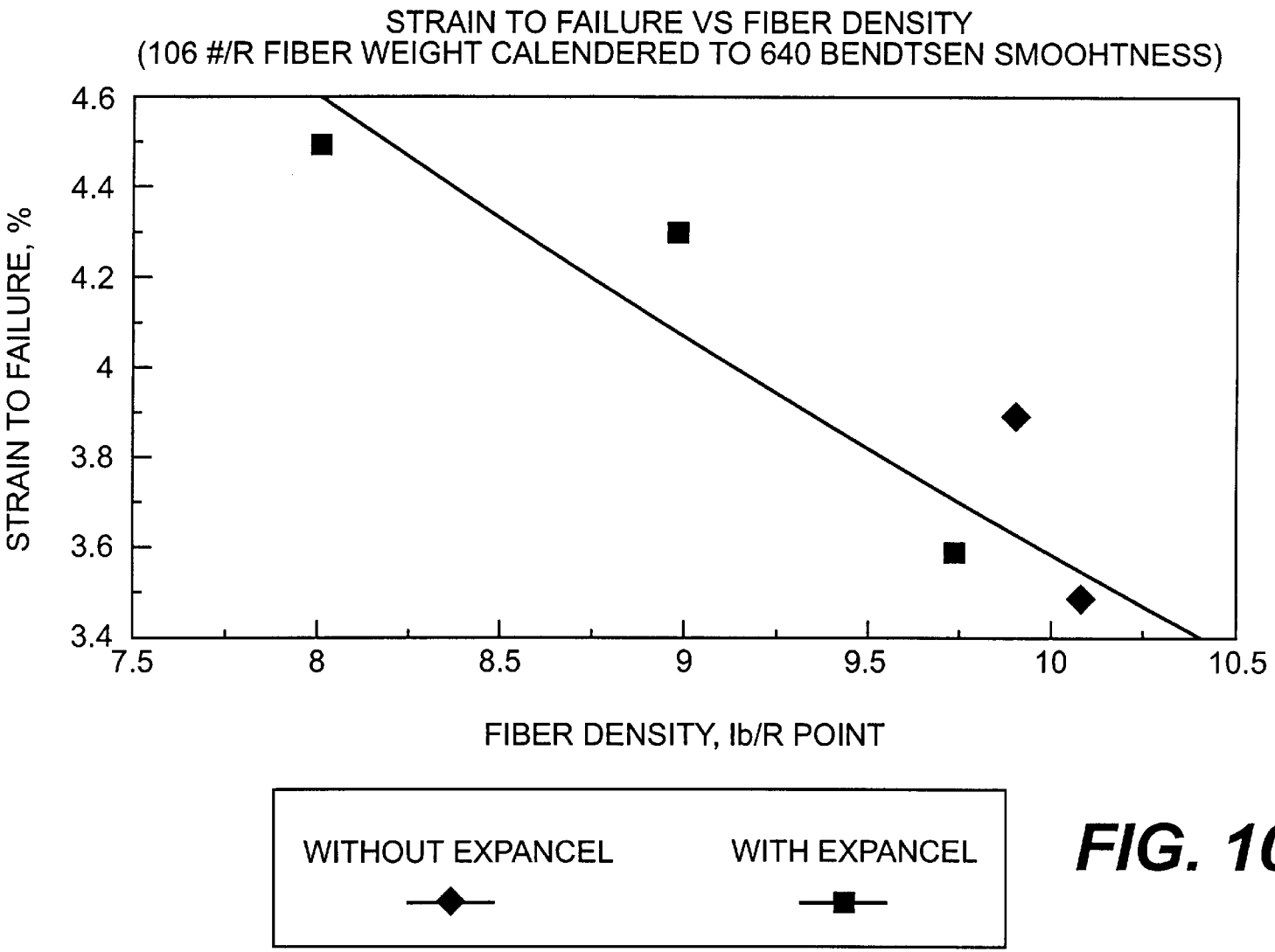
FIG. 10 is a graph depicting the fiber density in pounds for each 3000 square foot ream to percent strain to failure for paperboards prepared according to the present invention and prior art boards.

The bulk-enhanced paperboard was found to exhibit improved strain to failure (also known as stretch), as shown in FIG. 10, where strain to failure is shown as a function of fiber density. Compared to the control paper without microspheres, strain to failure of paper having about 20 to 40 pounds of expandable microspheres per ton have a corresponding increase in strain to failure of at least 7.5%. In one particular case, the control paper had a fiber density of about 10.1 pounds per ream per point (0.001 inch fiberboard thickness) and a strain to failure of about 3.5%, while paper to which microspheres had been added during formation at a proportion of 40 lbs. per ton had a fiber density of about 8 pounds per ream per point (0.001 inch per fiberboard thickness) and a strain to failure of about 4.5%. This is an improvement of 28%. The improved strain to failure improves formability of the paper, such as top curl forming for rolled brim containers, drawing of plates and bowls in forming dies, and all other applications that require deformation of paperboard.

Figure 11:
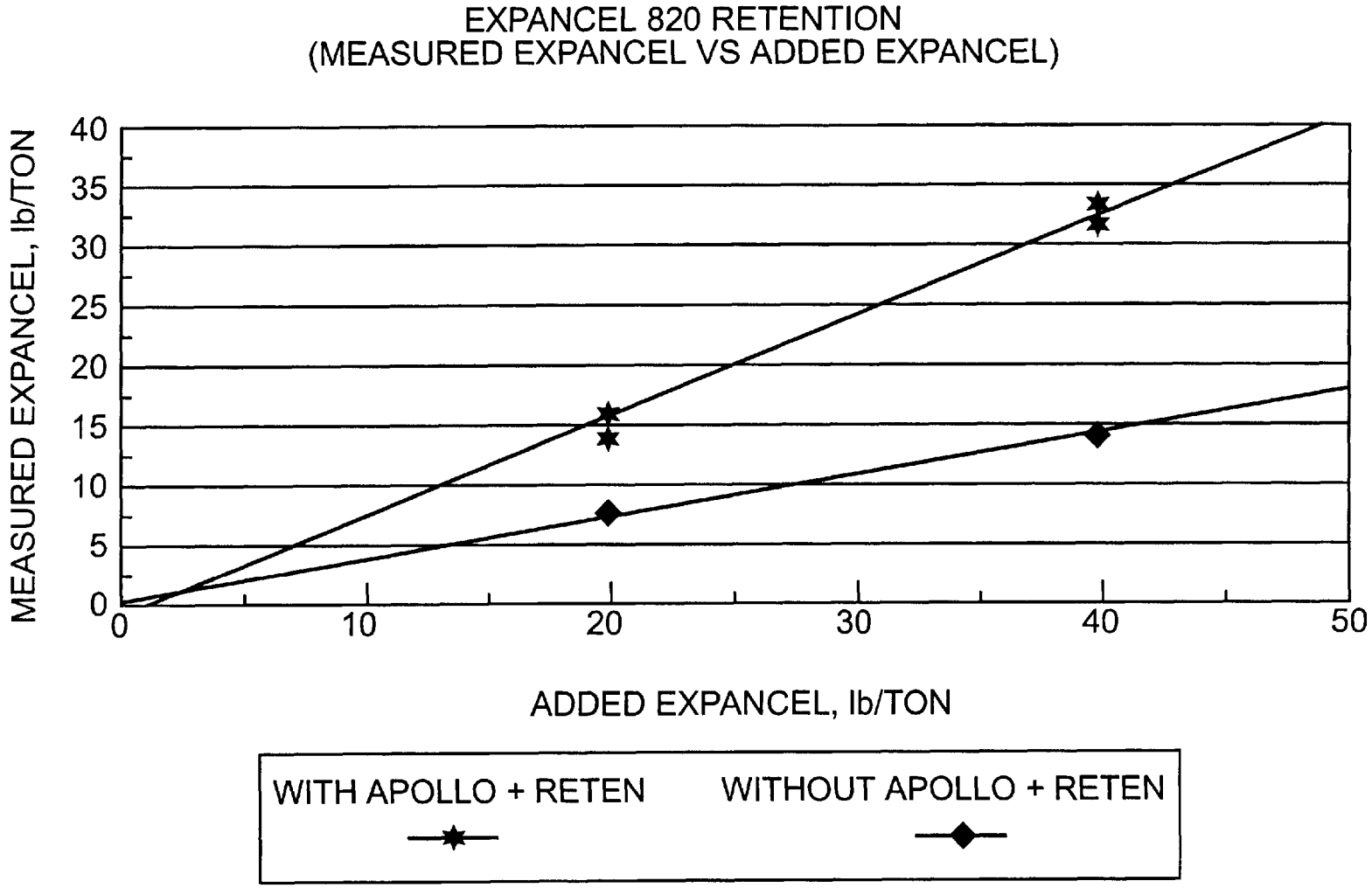
FIG. 11 is a graph depicting the improved retention of the bulk additive in the presence of a retention aid such as Reten 203.

Tests were also performed to show the improved retention of expandable microspheres according to the process of the present invention. The results of these tests are shown in FIG. 11. The rate of retention of expandable microspheres, in particular Expancel 820 microspheres, was only about 36% without usage of the cationized corn starch Apollo 600 in combination with the poly-DADMAC Reten 203, whereas with these two compounds added in the proportions discussed above, retention of expandable microspheres was at a rate of approximately 83%. Retention rates of greater than 50% can be termed to be substantial retention of the expandable microspheres added in the papermaking process. The preferred retention rate is 70% or better.

Figure 12:
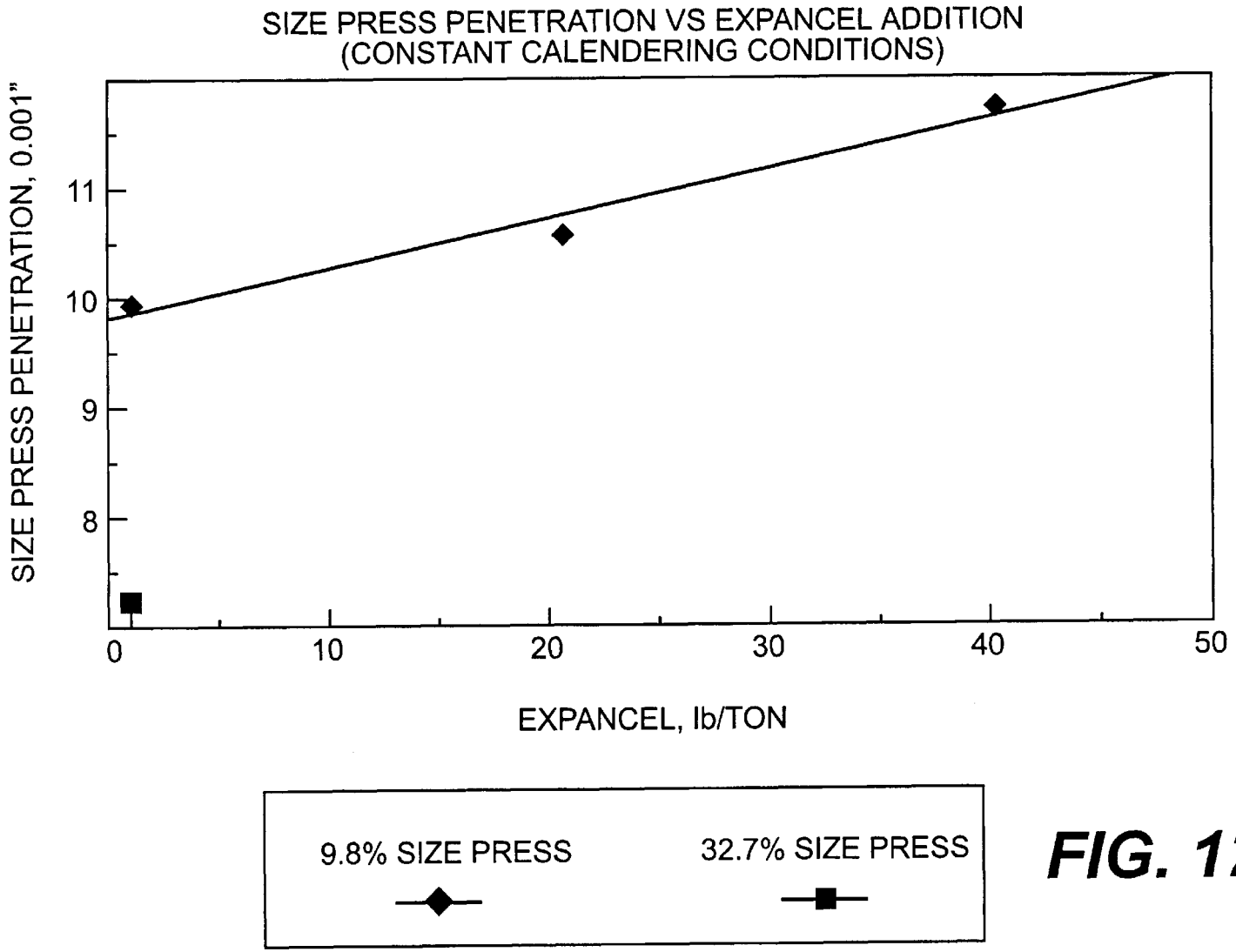
FIG. 12 is a graph depicting increase in the size press penetration into the paperboard versus amount of the bulk enhancing additive added.
Figure 13:
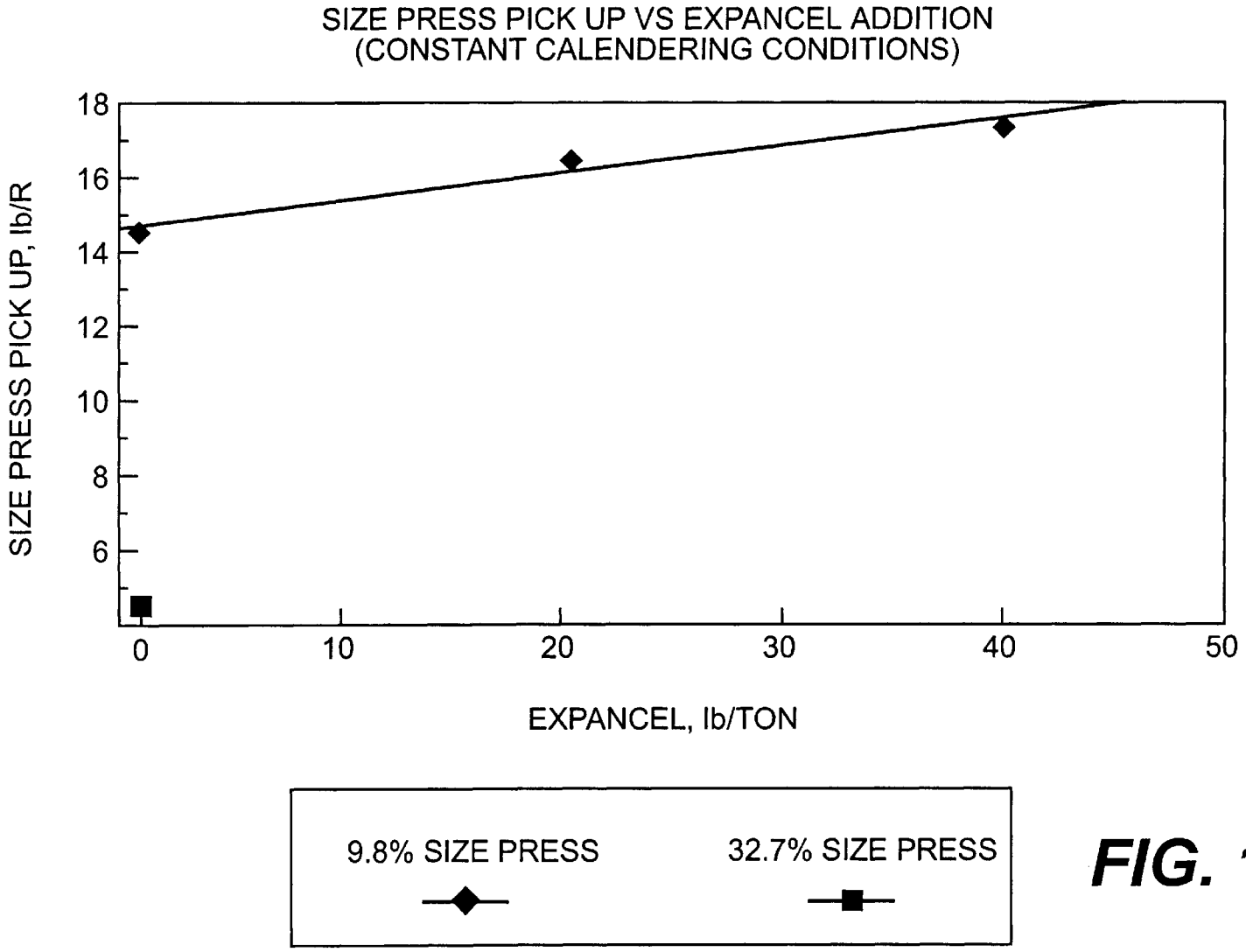
FIG. 13 is a graph depicting the increase in size press pickup versus the amount of the bulk enhancing additive added.

The resulting paper of this example, which was size-pressed with solids at 33%, was also compared to a control sheet which was size-pressed with solids of only about 10%. The size-press penetration and the size-press pick-up is depicted as a function of addition of expandable microspheres in FIGS. 12 and 13 respectively. It was found that both size-penetration and size-press weight increase at constant solids of about 33% with increasing addition of expandable microspheres. This increase is believed to be due to the decreasing density and increased "openness" of the fiber network resulting from expansion of the microspheres during the drawing process.

Figure 14:
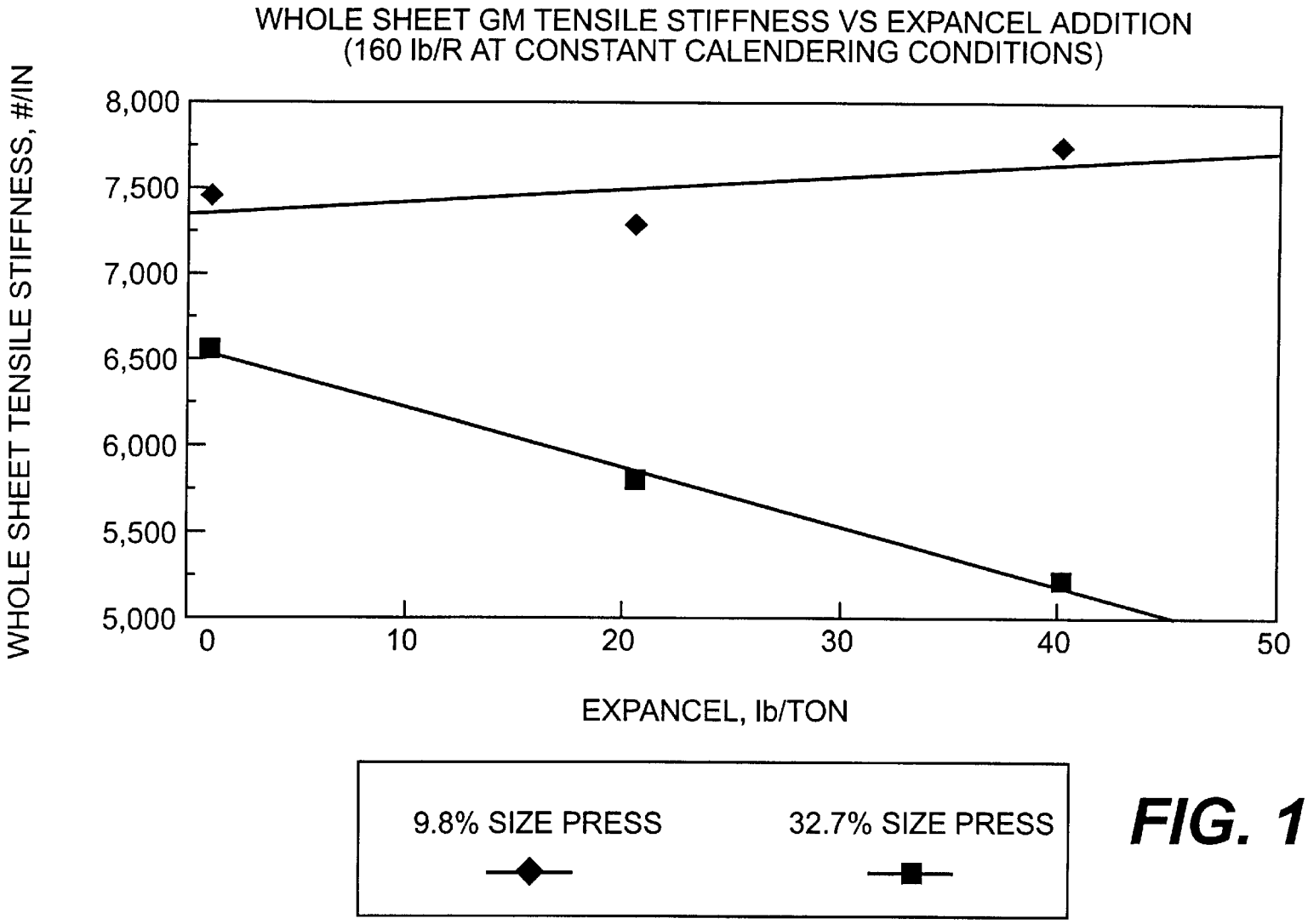
FIG. 14 is a graph depicting whole sheet GM tensile stiffness versus amount of the bulk enhancing additive added.

It was also found that the increased thickness of the size-press layer and increased size-press weight improved the GM tensile stiffness and formability of the size-press layer, and consequently, the paper itself, as compared to the control size-pressing at only 9.8% solids. The results of these tests are depicted in the graph of FIG. 14 where a whole sheet GM tensile stiffness is indicated as a function of addition of expandable microspheres for the control size-pressing at 9.8% versus that of the present invention at 32.7%. As seen in FIG. 14, the reduction in whole sheet GM tensile stiffness at conventional size-press weights is believed to be due to the inability of the size-press layers to compensate for the loss in strength in the base fiber network caused by its disruption from the addition of the expandable microspheres. Thus the increased GM tensile stiffness of the size-press layers resulting from the high size-press weight compensated for these strength losses as indicated in FIG. 14.

Figure 5:
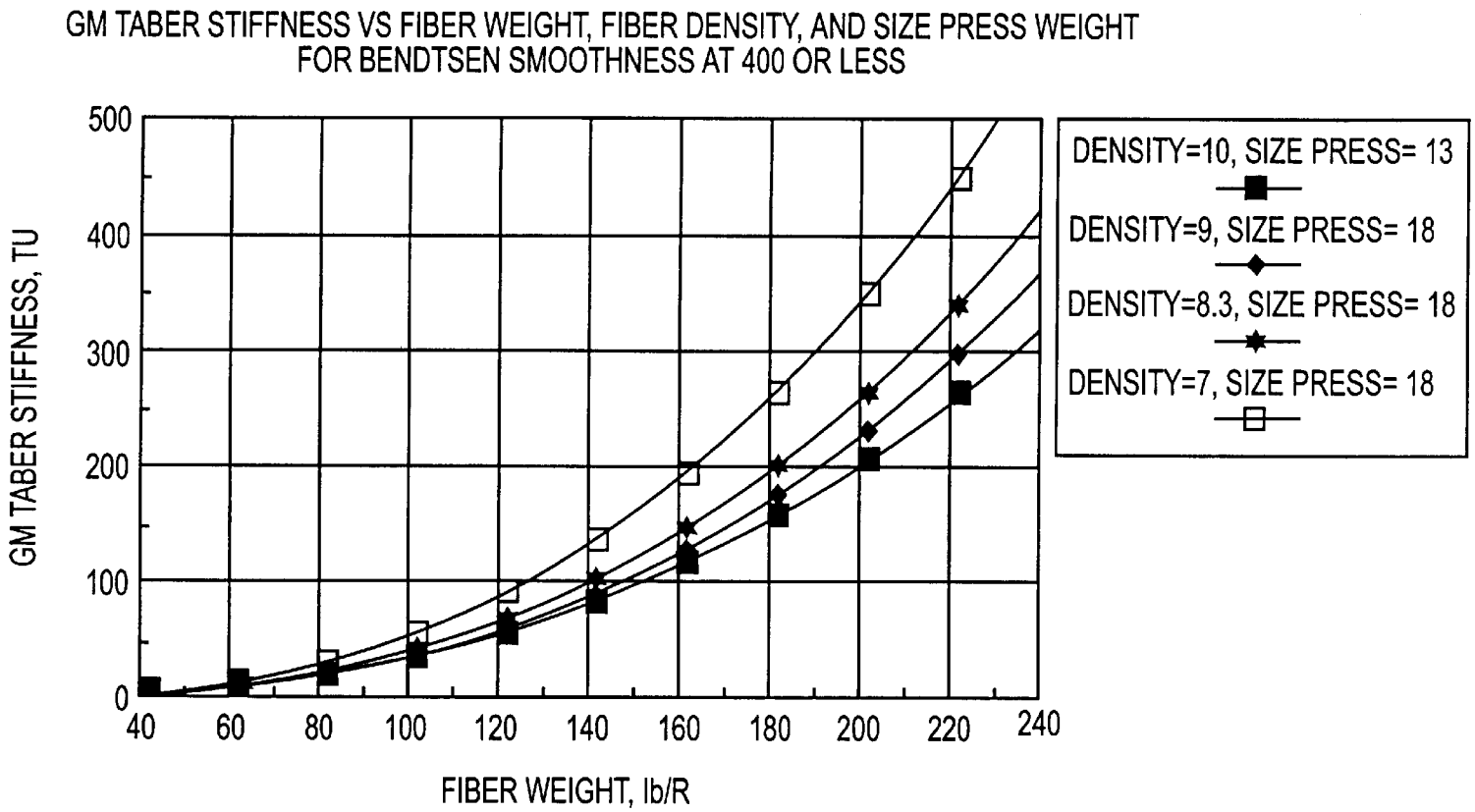
FIG. 5 is a graph depicting the improved GM Taber stiffness values for paperboards prepared according to the present invention with GM Taber stiffness values for boards available on the market.
Figure 6:
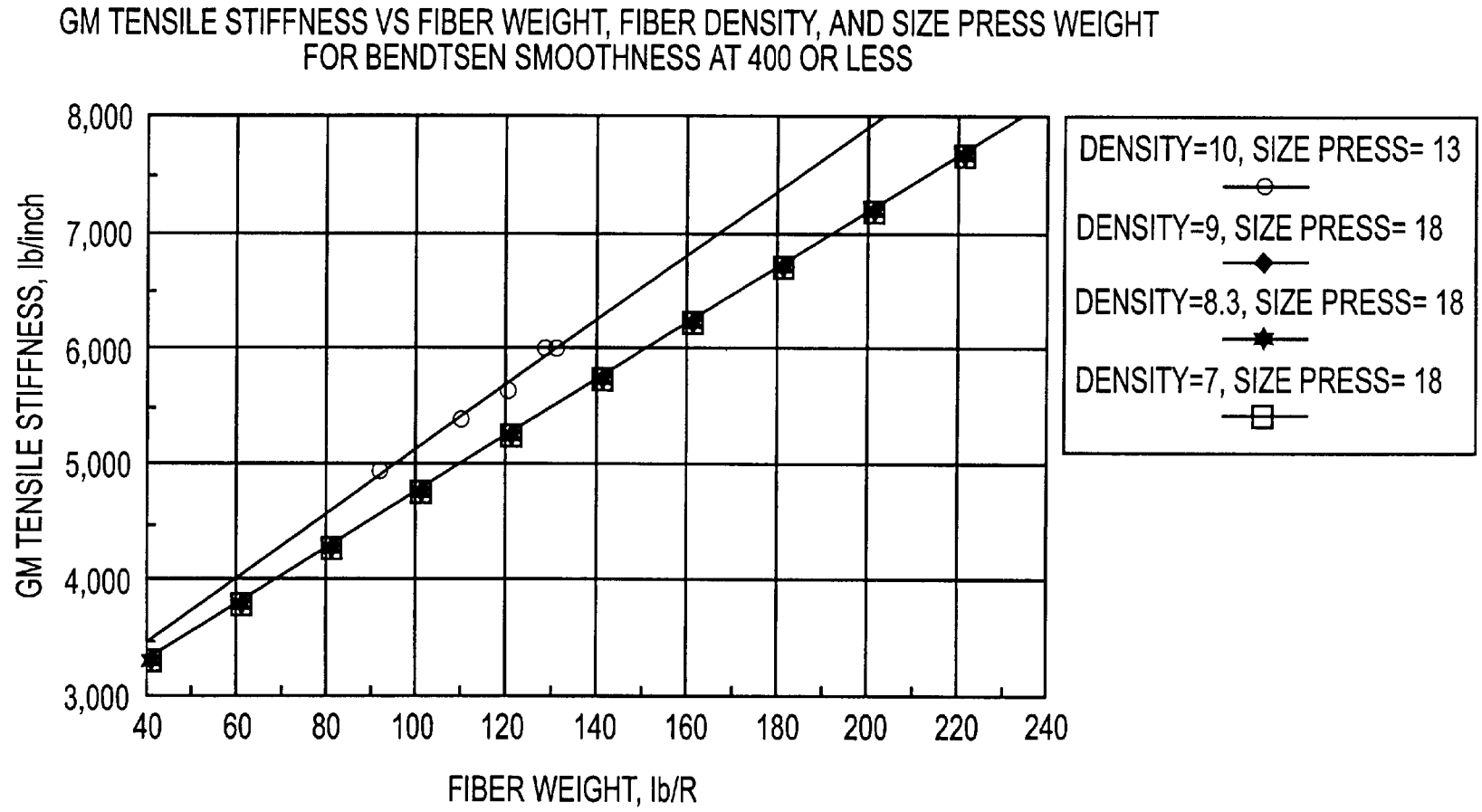
FIG. 6 is a graph depicting the improved GM tensile stiffness values for paperboards prepared according to the present invention with GM tensile stiffness values for boards available on the market.
Figure 15:
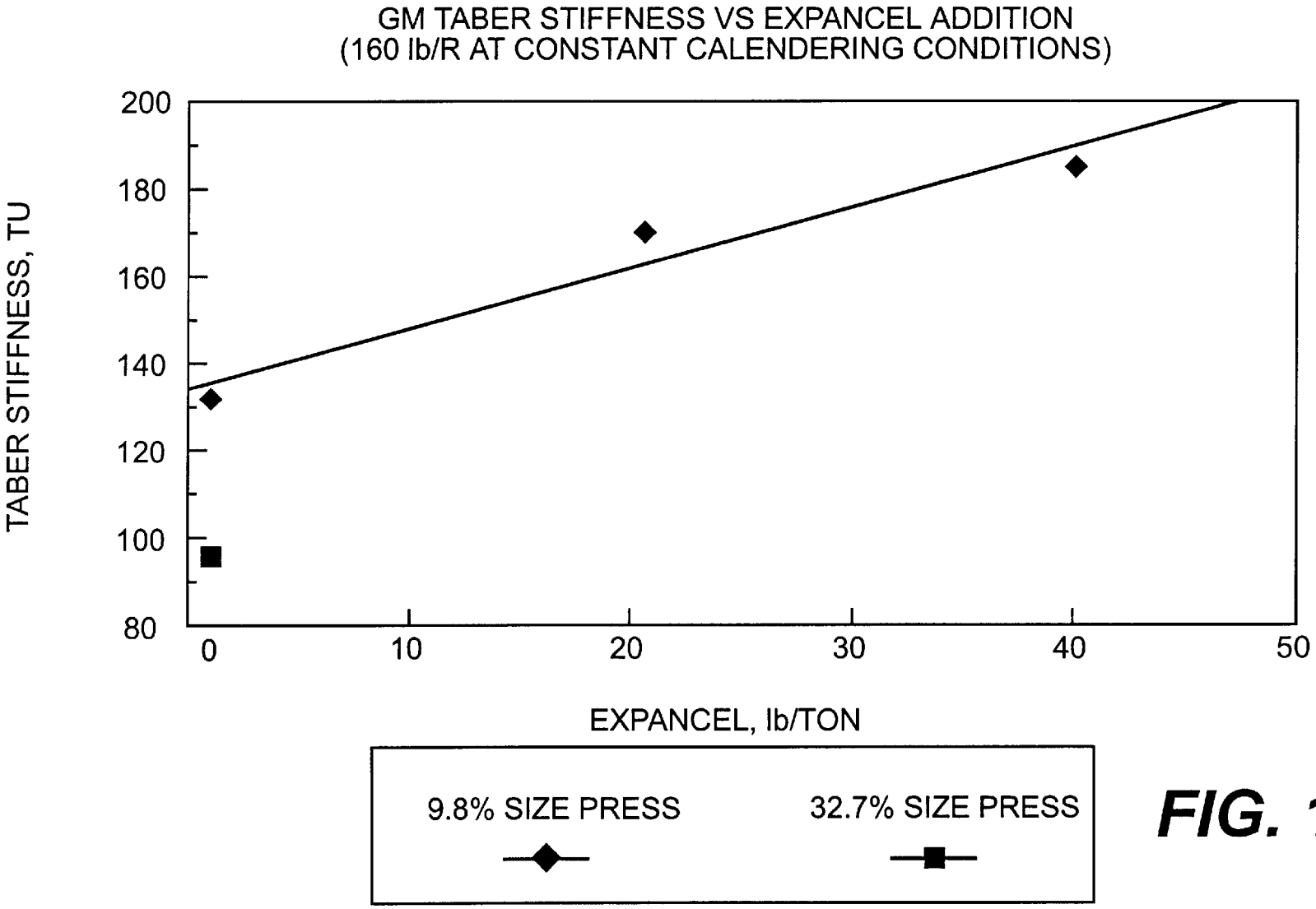
FIG. 15 is a graph depicting GM Taber stiffness versus the amount of the bulk enhancing additive added.

It was also found that GM Taber stiffness (bending stiffness) was improved due to, it is believed, the combined effects of bulk-enhancement and application of the pigmented size at a high solids level. In other words, the combination of a caliper increase and increased moduli of elasticity on the paper is believed to generate an "I-beam" effect that improves bending stiffness as shown in FIG. 15 and FIG. 5.

EXAMPLE 2

The results of various tests conducted on hot drink cups formed from paperboard formed in Example 1 will now be described. The thermal resistance or thermal insulative properties of the paper were calculated in terms of "hold time," which is defined as the amount of time before a temperature of 128° F. is obtained at the outer surface of a hot drink cup filled with liquid at about 190° F. The results are depicted in the graph of FIG. 7 and show that the ability to hold a hot drink cup without discomfort increases as a function of increased addition of expandable microspheres. FIG. 8 shows the relationship of hold time to the density of the paperboard used to make the hot drink cup of the present invention. As seen there, the lower fiber densities resulting from higher proportions of added expandable microspheres are generally associated with longer hold times. Useful cups have a hold time of at least 30 seconds in the temperature range of 140° F.–145° F. or below.

When the paper was formed into a paper cup, as in this example, the above-described improvements in tensile and bending stiffness improved paper cup rigidity and formability which in turn allowed for a significant reduction in fiber weight of the cup for a desired rigidity. The cup is set forth in FIGS. 23 and 24 and the fiberboard at a fiber mat density of 3, 4.5, 6.5, 7, 8.3, and 9 pounds per 3000 square foot ream at a fiberboard thickness of 0.001 inch, had a GM Taber stiffness of at least $0.00716\ w^{2.63}$ grams-centimeter/fiber mat density$^{1.63}$ pounds per 3000 square foot ream at a fiberboard thickness of 0.001 inch, and a GM tensile stiffness of 1890+24.2 w pounds per inch.

EXAMPLE 3

In this example, microsphere distribution in bulk-enhanced paperboard prepared as in Example 1 was compared visually to microsphere distribution in a commercial microsphere enhanced paperboard. They were then examined under ×300 and ×400 magnification and microphotographs were taken. Representative microphotographs are reproduced as FIGS. 3 and 4 with equal outer, middle, and inner regions A, B, C and A', B', C' indicated in dotted lines added to the photographs for comparison purposes.

Figure 3:
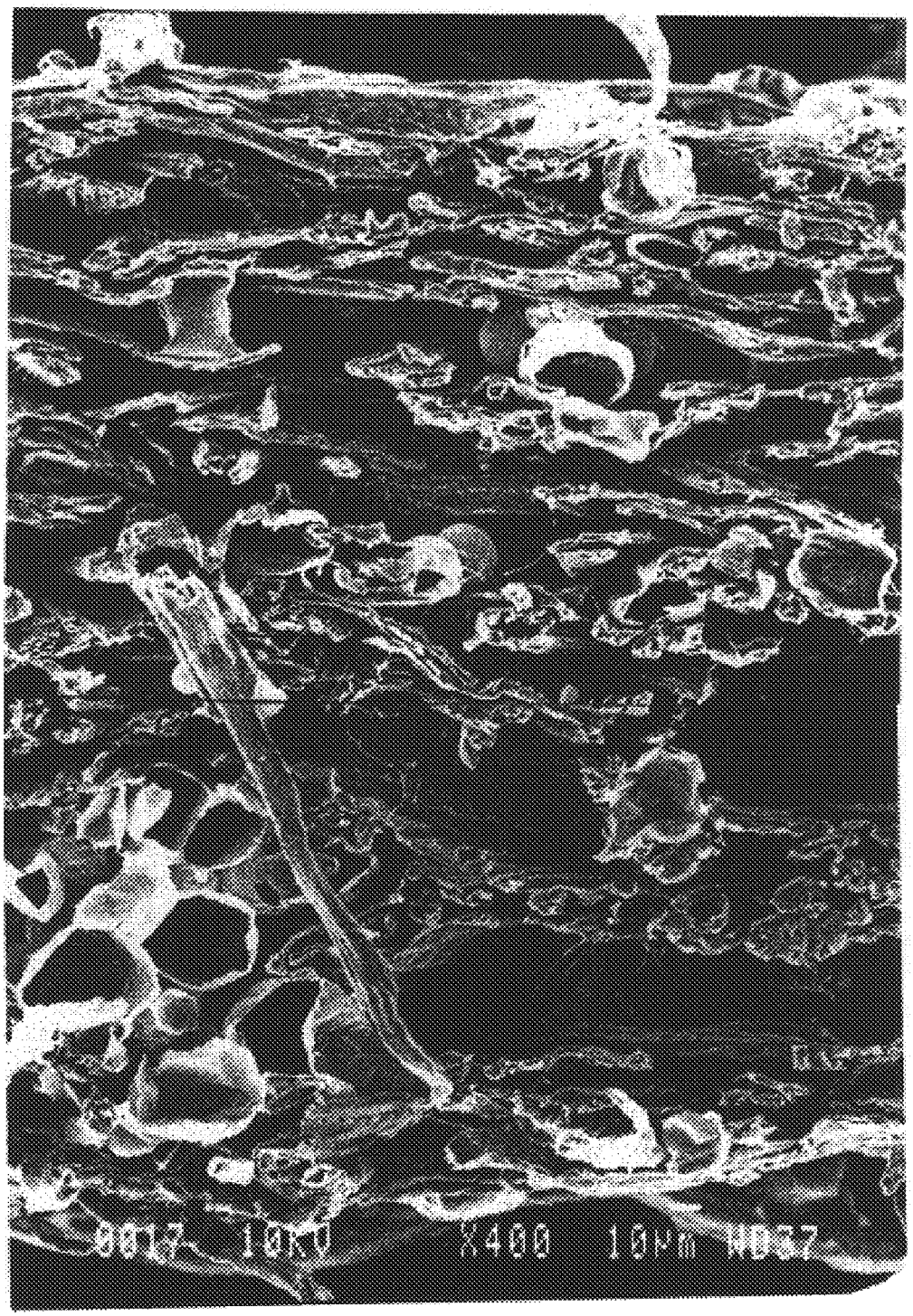
FIG. 3 is a photograph of a cross-sectional view of a paperboard according to the present invention magnified 400 times.
Figure 4:
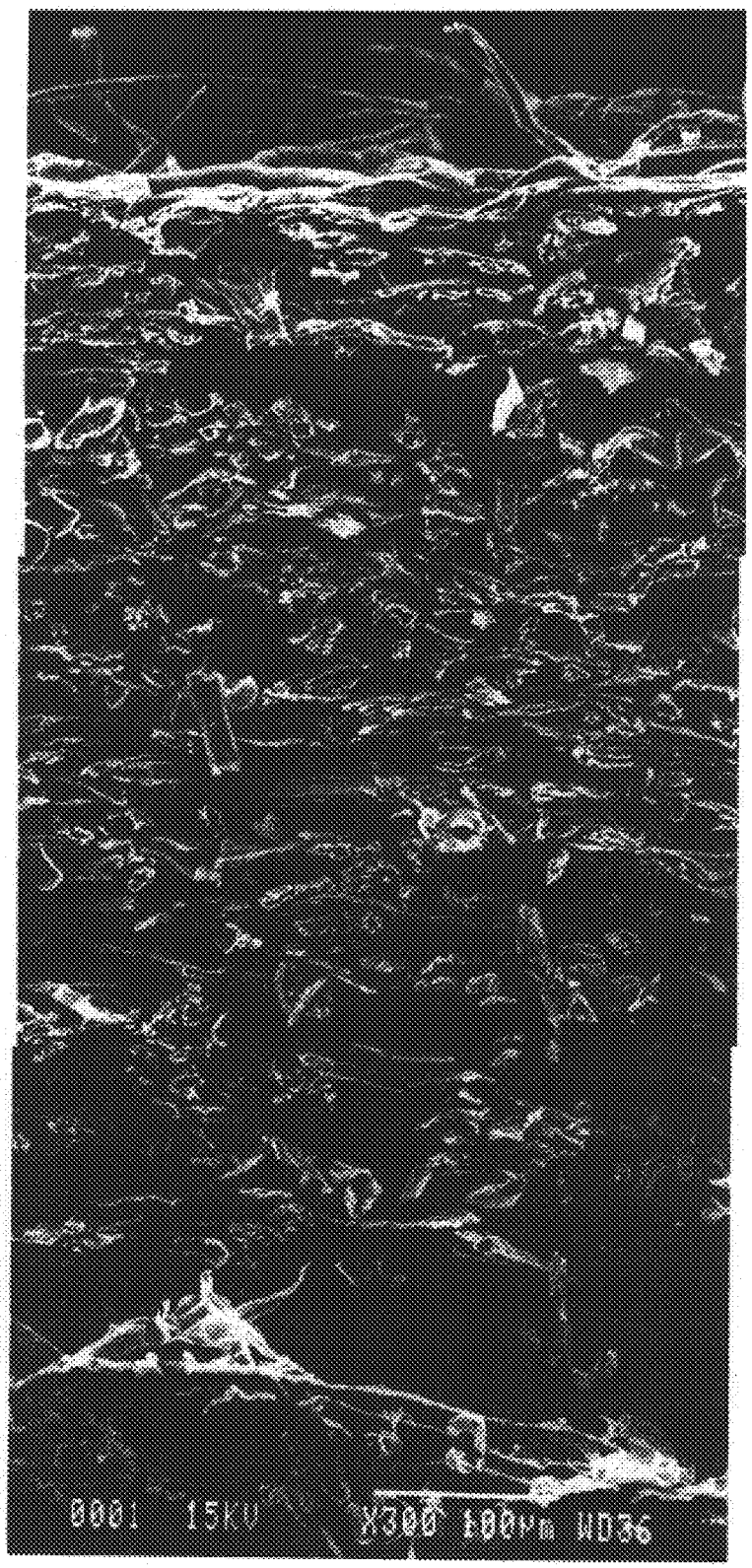
FIG. 4 is a photograph of a cross-sectional view of a paperboard prepared according to the prior art without retention aids magnified 300 times.

FIG. 3, which shows paperboard prepared as in Example 1, at an ×300 magnification reveals 7 microspheres in outer region A, 8 microspheres in middle region B, and 9 microspheres in bottom region C. In contrast, FIG. 4 at ×400 magnification shows that the commercial prior art product had 31 microspheres in outer region A', 7 microspheres in middle region B', and 8 microspheres in bottom region C'.

EXAMPLE 4

These examples were carried out to determine the effect of the expandable microspheres on bulk properties of the paperboard web. This example sets forth the general procedure for carrying out the manufacture of paperboard utilizing different bulk additives and different retention aids. The manufacturing procedure is illustrated in FIG. 29. In subsequent examples specific variations are set forth.

Hardwood Kraft (80) and Softwood Kraft (81) lap pulps (in the ratio of 75%:25%) were pulped and refined together using a Jordan refiner to a Canadian Standard Freeness of 515, pumped to the mix chest (83) and stored in the machine chest (84). Alum (85) was added to the stock and the pH was adjusted to pH 4.8 using sulfuric acid (86) and then rosin size (87) was added. This stock was pumped to the stuff box (88) and then starch (89) and retention aid (90) were added to the stock at the down leg of the stuff box. This stock was then pumped via the fan pump (92) to the headbox of the paper machine (93) to form the web (94) on the wire. This web was then pressed in the press section (95) and drying was started in contact with a Yankee dryer (96), the web was optionally calendered (97) and further drying was carried out using steam-heated drying cans in the drying section (98). The final dry web (~2.0% moisture) was then reeled up (99). The oven-dried fiber weight of the board was 105 lbs./3000 sq. ft. ream.

Run 1. Expancel 820 (91) was added to the stock prepared as described above just ahead of the fan pump (92). The Expancel was added continuously to retain a final ratio of 20 pounds of Expancel for each ton of paperboard. The paperboard formed was tested and it was determined that the caliper had increased.

Figure 30:
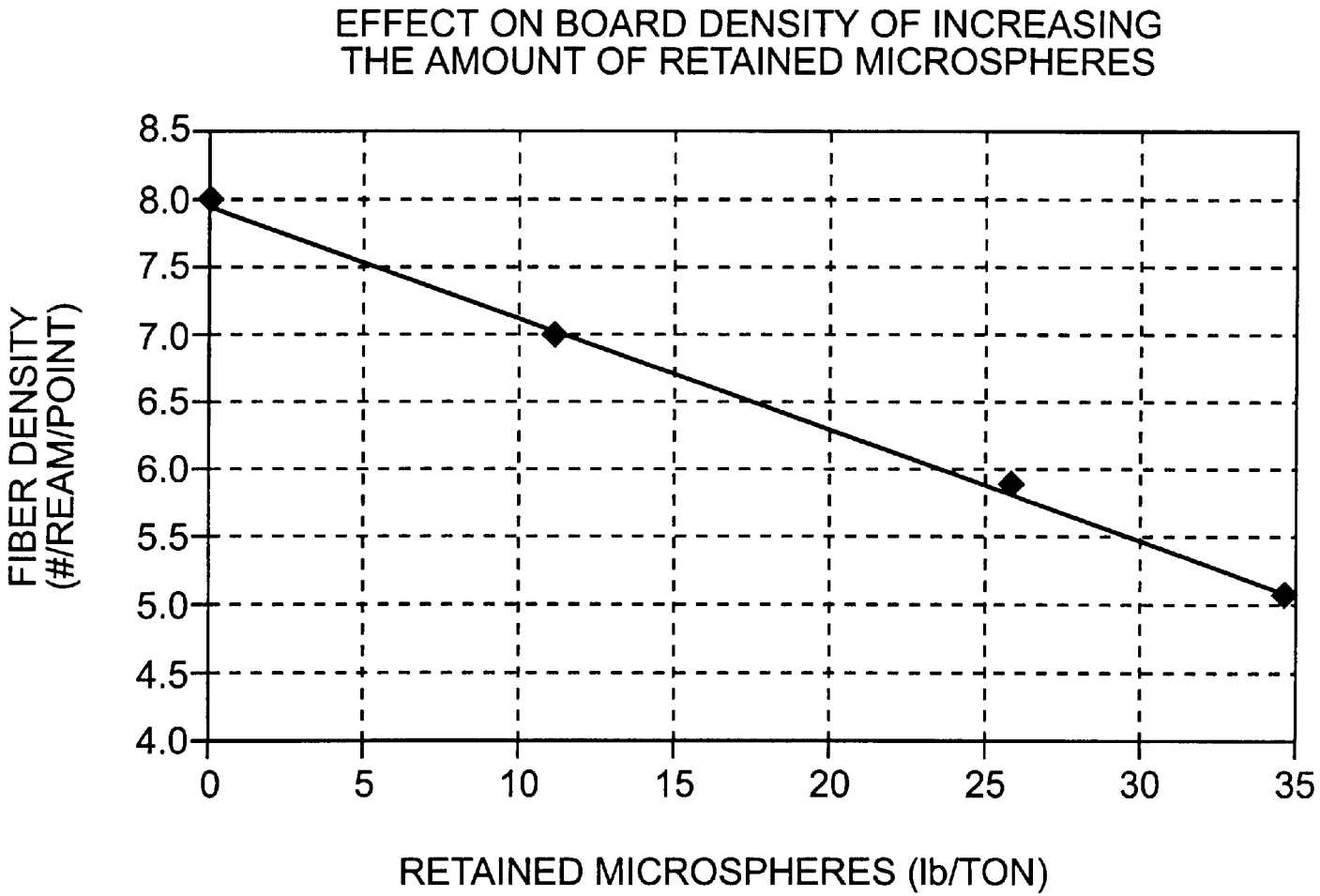
FIG. 30 is a graph depicting the effect of increasing the amount of retained microspheres on the paperboard density.

Runs 2 and 3. Runs 2 and 3 are identical to Run 1 except that in Run 2, 40 pounds of the microspheres per ton of paperboard were used while in Run 3, 50 pounds of microspheres were utilized. In all three runs, the caliper of the paperboard increased as is shown in Table 2 and a graphical plot showing the relationship between bulk and the amount of retained microspheres is shown in FIG. 30.

TABLE 2

| | Control | Run 1 | Run 2 | Run 3 |
|---|---|---|---|---|
| Fiber weight (pounds per 3000 sq. ft. ream) | 112 | 112 | 112 | 112 |
| Expancel ® addition (lb./ton) | 0.0 | 20.0 | 40.0 | 50.0 |
| Retention Aid (lb./ton) | 0.0 | 11.1 | 25.8 | 34.6 |
| Retention (%) | 0.0 | 55.5 | 64.5 | 69.2 |
| Caliper ($\mu$) | 14.0 | 16.0 | 19.0 | 22.0 |
| Density (lb./3000 sq. ft. ream/$\mu$) | 8.0 | 7.0 | 5.9 | 5.1 |

EXAMPLE 5

This example illustrates the percent retention of the microspheres in the paperboard when Reten 203 retention aid is utilized. The paperboard was prepared according to the procedure described in Example 4. The data as set forth in FIG. 31A demonstrates that when the retention aid is added just before the formation of the nascent web, such as at the stuff box [FIG. 29A (88)], the retention was 73.4 percent; however, when the retention aid was added at the machine chest [FIG. 29A (84)], the microsphere retention was reduced to 57.1 percent.

Figure 29A:
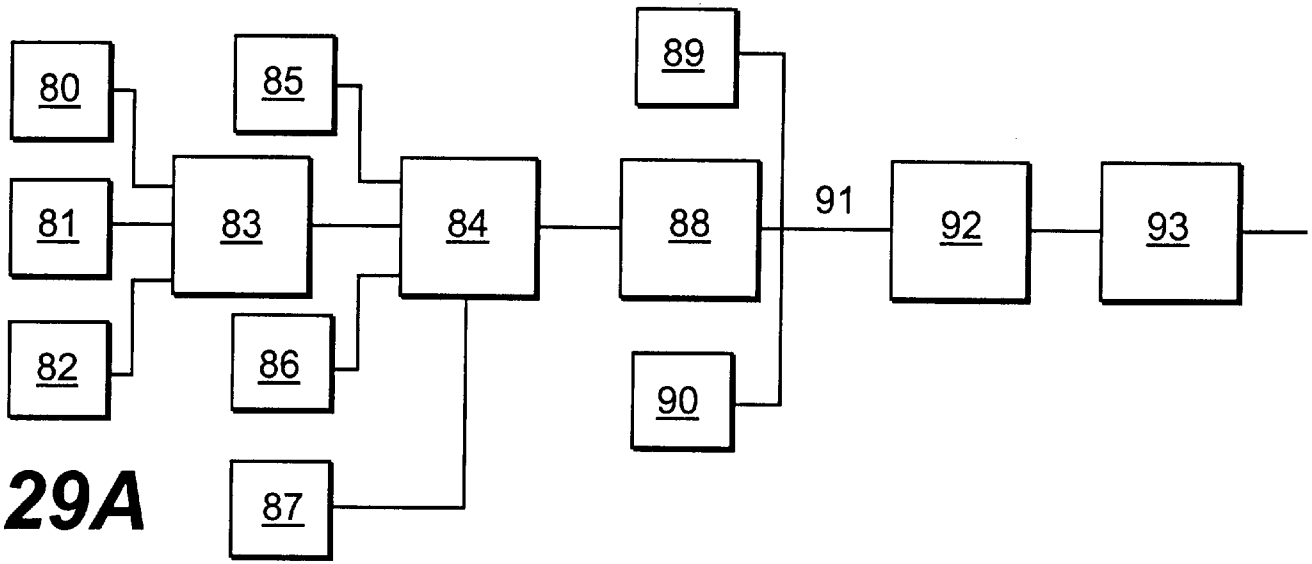
FIGS. 29A and B are flow diagrams depicting a small scale process for the manufacture of the paperboard.
Figure 29B:
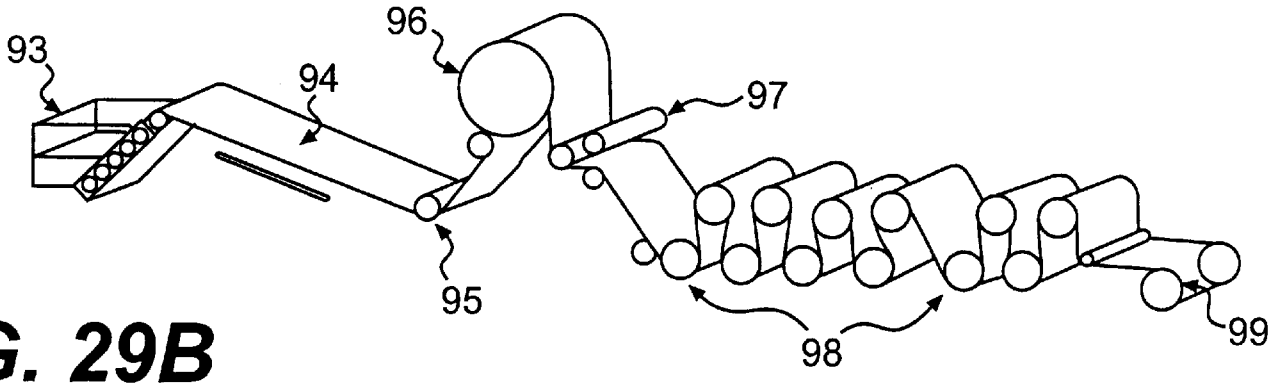

In this Run 1 at the machine chest [FIG. 29A (84)], the following chemicals were charged per ton of cellulosic feedstock: Alum, ten pounds; Apollo 600, eight pounds; Neuphor 635, six pounds; Reten 203, one half pound; Expancel 820WU, forty pounds.

In this Run 2 at the stuff box, [FIG. 29A (88)], the following chemicals were charged per ton of cellulosic feedstock: Apollo 600, eight pounds; Reten, one half pound; at the fan pump [FIG. 29A (92)], 40 pounds of Expancel per ton cellulosic feedstock were added; at the machine chest [FIG. 29A (84)], ten pounds of alum and eight pounds of Neuphor 635 were added for each ton of cellulosic feedstock.

Run 3 is the same as Run 2 except that a total of 50 pounds of Expancel 820 per ton of cellulosic fiber was charged to the system.

EXAMPLE 6

This example illustrates the percent retention of the microspheres in the paperboard when various retention aids were used such as inorganic colloids and organic colloids. The paperboard was prepared according to the procedure described in Example 4. The data are set forth in FIG. 31B. This figure shows that the best retention was obtained with inorganic colloids but that organic colloids and Reten 203 also give superior results. In Run 1 designated Reten 203 in FIG. 31B at the machine chest [FIG. 29A (84)] the following chemicals were charged per ton of cellulosic feedstock. Alum, ten pounds; Apollo 600, eight pounds; Neuphor 635, six pounds; Reten 203, one half pound; Expancel 820WU, forty pounds.

Figure 31A:
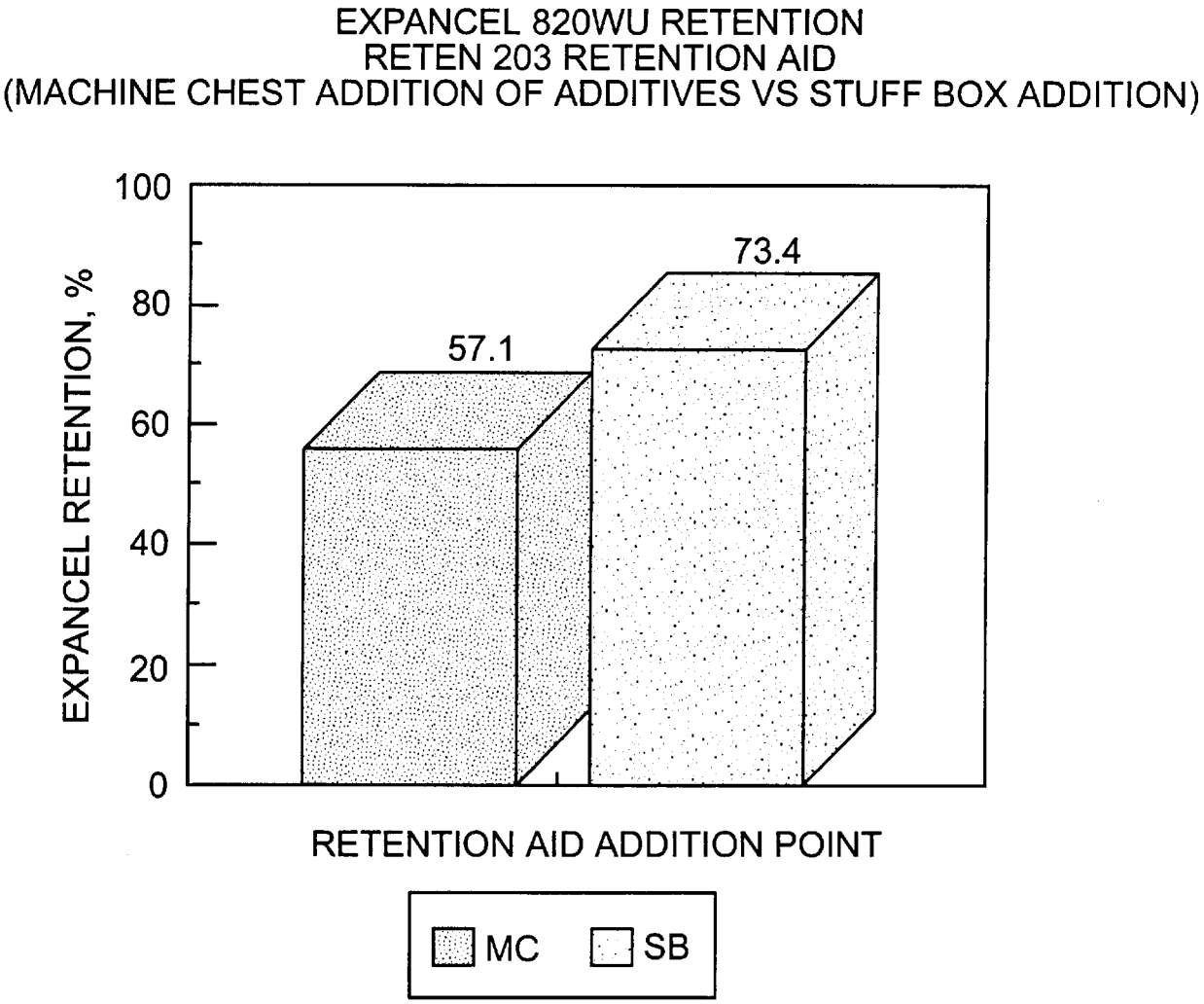
FIG. 31A is a bar graph depicting the advantage of adding the retention aid to the stuff box [FIG. 29 (88)] versus earlier addition at the machine chest [FIG. 29 (84)].
Figure 31B:
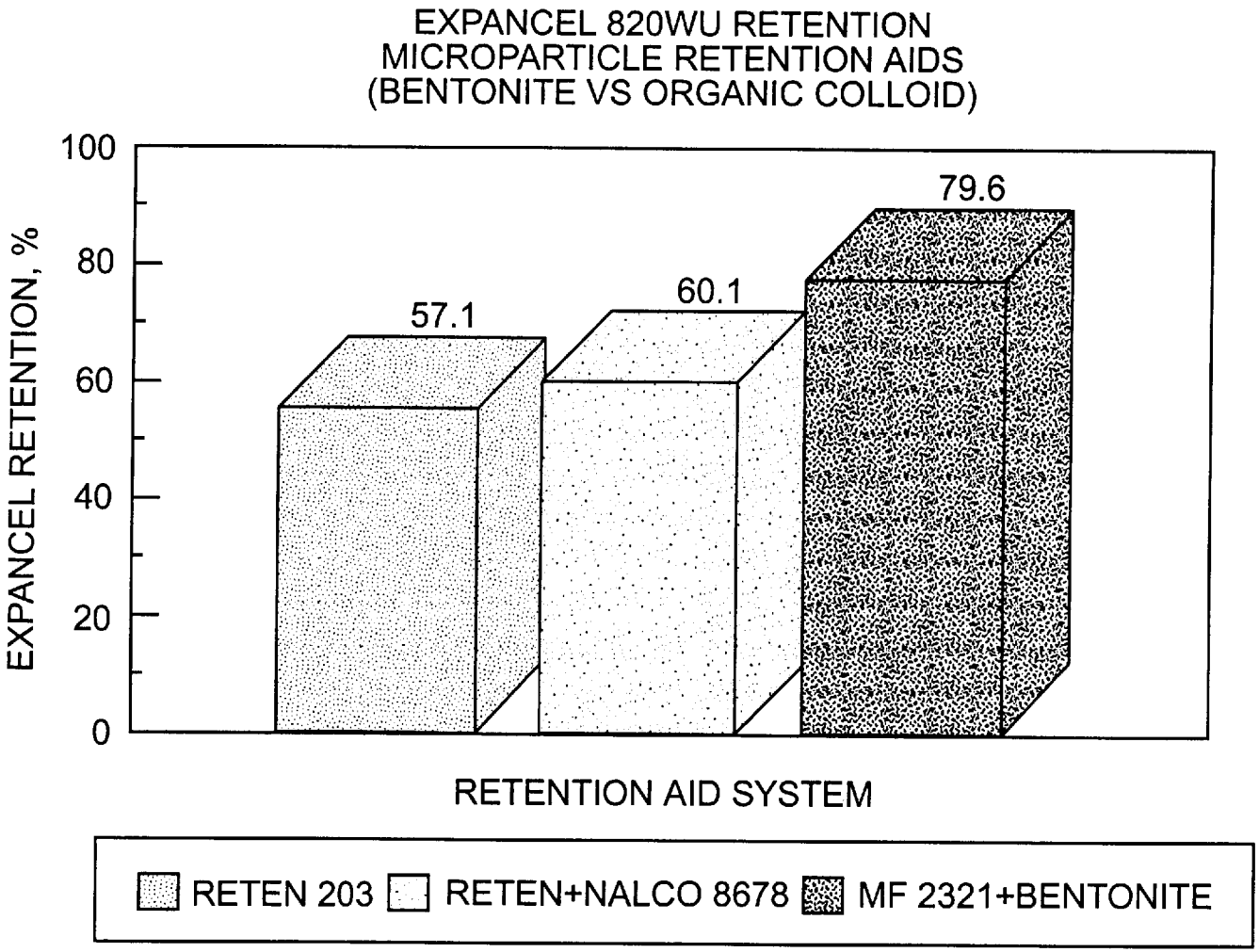
FIG. 31B is a bar graph depicting the percent microspheres retained utilizing different retention aids.

In Run 2, designated Reten+Nalco 8678 in FIG. 31B, 1.5 pounds of Nalco 8678 for each ton of cellulosic feedstock was charged after the fan pump [FIG. 29A (92)]. In this Run 2, the following chemicals per ton of cellulosic feedstock were charged at the machine chest [FIG. 29A (84)]: Alum, ten pounds; Apollo 600, eight pounds; Reten 203, one half pound; and Expancel 820WU, forty pounds.

In Run 3, designated MF2321+Bentonite in FIG. 31B, 1.5 pounds of Microform BCS were charged after the fan pump [FIG. 29A (92)]. In this Run 3, the following chemicals per ton of cellulosic feedstock were charged at the machine chest [FIG. 29A (84)]: Alum, ten pounds; Apollo 600, eight pounds; and Neuphor 635, six pounds. In this Run 3, the following chemicals per ton of cellulosic feedstock were charged at the stuff box [FIG. 29A (88)]: Expancel 820WU, forty pounds, and Microform 2321, one pound.

EXAMPLE 7

This example illustrates the percent retention of the microspheres in the paperboard when high molecular weight retention aid Accurac 120 functioning as a flocculant was used. The paperboard was prepared according to the procedure described in Example 4. The data are set forth in FIG. 31C. The figure shows that the best retention was obtained with Accurac 120, but Reten 203 also gave superior results.

Figure 31C:
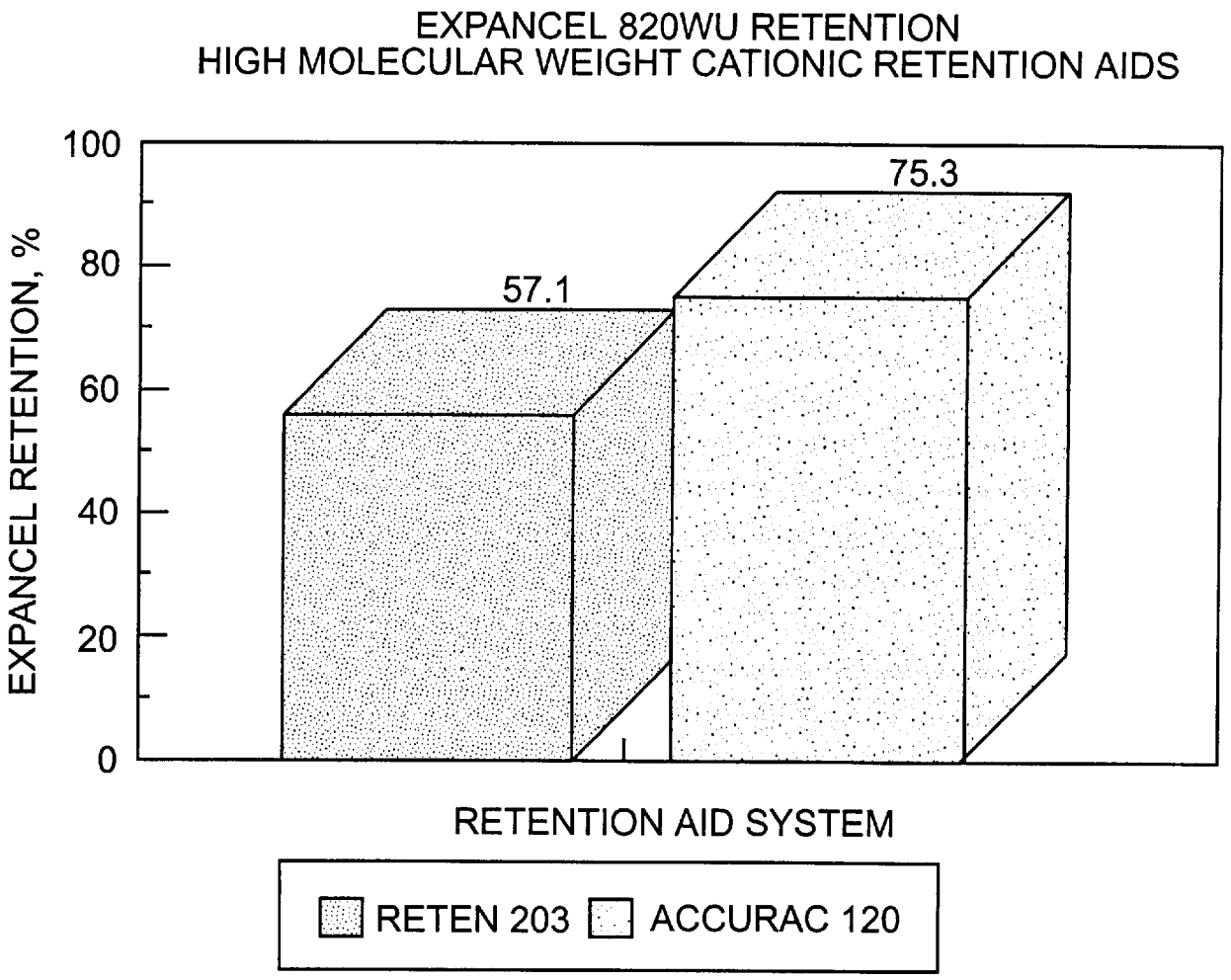
FIG. 31C is a bar graph depicting the percent microspheres retained utilizing two different retention aid systems.

In Run 1, designated Reten 203 in FIG. 31C, at the machine chest [FIG. 29A (84)], the following chemicals were charged per ton of cellulosic feedstock: Alum, ten pounds; Apollo 600, eight pounds; Neuphor 635, six pounds; Reten 203, one half pound; and Expancel WU, forty pounds.

In Run 2, designated Accurac 120 in FIG. 31C, the following chemicals per ton of cellulosic feedstock were charged at the machine chest [FIG. 29A (84)]: Alum, ten pounds; Apollo 600, eight pounds; and Neuphor 635, six pounds.

In Run 2, one pound of Accurac 120 was charged at the stuff box [FIG. 29A (88)] for each ton of cellulosic feedstock, and forty pounds of Expancel 820WU for each ton of cellulosic feedstock were charged at the fan pump [FIG. 29A (92)].

EXAMPLE 8

This example illustrates the percent retention of the microspheres in the paperboard when various retention aids were used such as dual polymers. The paperboard was prepared according to the procedure described in Example 4. The data are set forth in FIG. 31D. This figure shows that the best retention was obtained with a Nalco 625 and Reten 203 combination. Reten 203 also gives superior results.

Figure 31D:
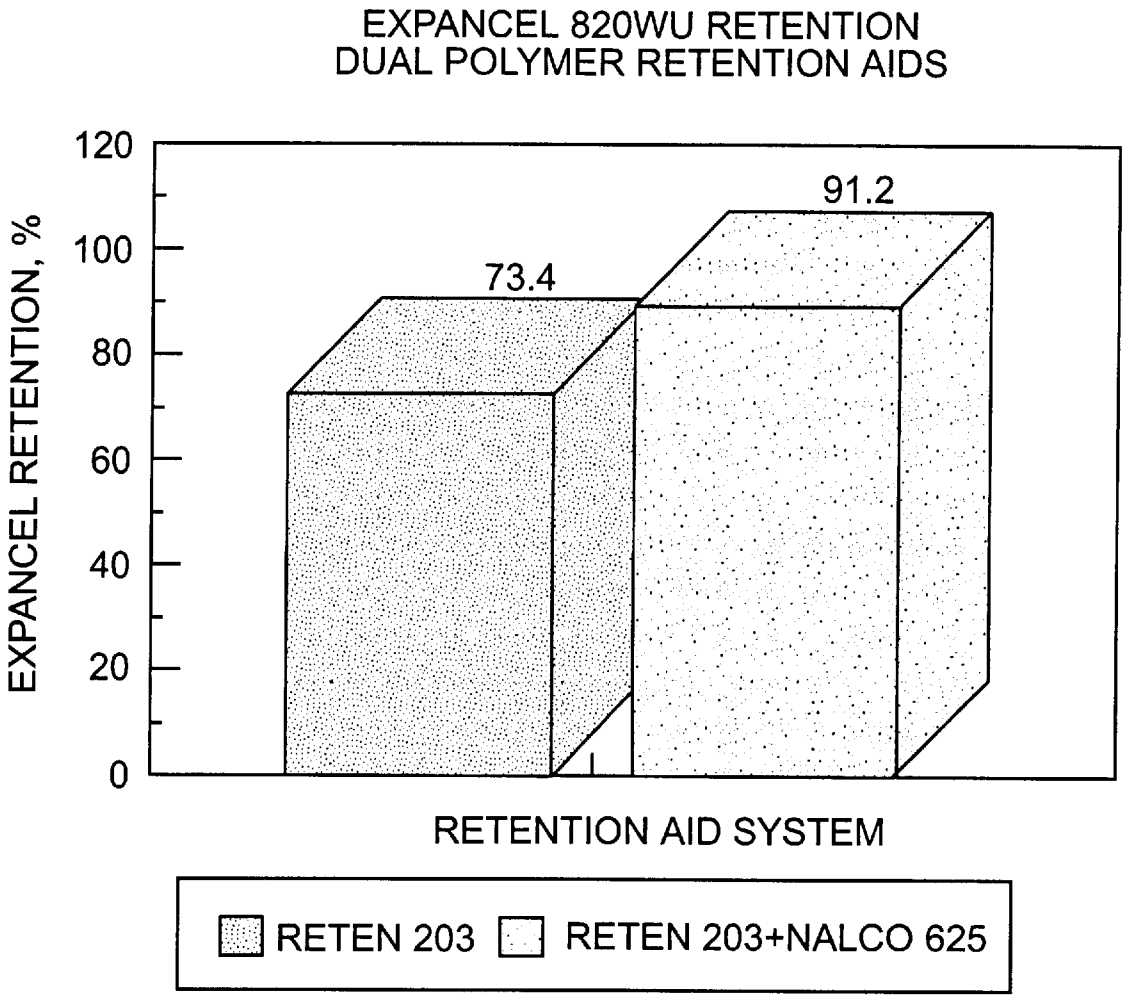
FIG. 31D is a bar graph depicting the percent microspheres retained when dual polymer retention aids are utilized.

In Run 1, designated Reten 203 in FIG. 31D at the machine chest [FIG. 29A (84)], the following chemicals were charged per ton of cellulosic feedstock: Alum, ten pounds, and Neuphor 635, six pounds. Eight pounds of Apollo 600 and one half pound of Reten 203 for each ton of cellulosic fiber were charged at the stuff box [FIG. 29A (88)]. In this Run 1, forty pounds of Expancel 820WU per ton of cellulosic fiber was added at the fan pump [FIG. 29 (92)].

Run 2 is the same as Run 1 except that fifty pounds of Expancel 820WU were charged per ton of cellulosic fiber.

In Run 3, designated Reten 203+Nalco 625, the following chemicals per ton of cellulosic feedstock were charged at the machine chest [FIG. 29A (84)]: Alum, ten pounds, and Neuphor 635, six pounds. In this Run 3, the following chemicals per ton of cellulosic feedstock were charged at the stuff box [FIG. 29A (88)]: Apollo 600, eight pounds, and Reten 203, one half pound. In Run 3, forty pounds of Expancel 820WU were charged at the fan pump [FIG. 29A (92)], and one pound of Nalco 625 was charged after the fan pump [FIG. 29A (92)].

Run 4 is the same as Run 3 except that fifty pounds of Expancel 820WU per ton of cellulosic fiber were charged at the fan pump [FIG. 29A (92)].

EXAMPLE 9

This example illustrates the percent retention of the microspheres in the paperboard when various retention aids were used such as chemically or thermally rendered anfractuous cellulosic fibers and Reten 203 in combination with the thermal fibers or by itself. The paperboard was prepared according to the procedure described in Example 4. The data are set forth in FIG. 31E. The figure shows that the best retention was obtained with anfractuous fibers based on hardwood in combination with Reten 203. In this instance, as shown by the bar graph in FIG. 31E, ninety percent of the Expancel microspheres were retained in the fiberboard. For the softwood combination, the retention was an excellent 80.6 percent. For Reten 203, the retention was also an excellent 73.4 percent.

Figure 31E:
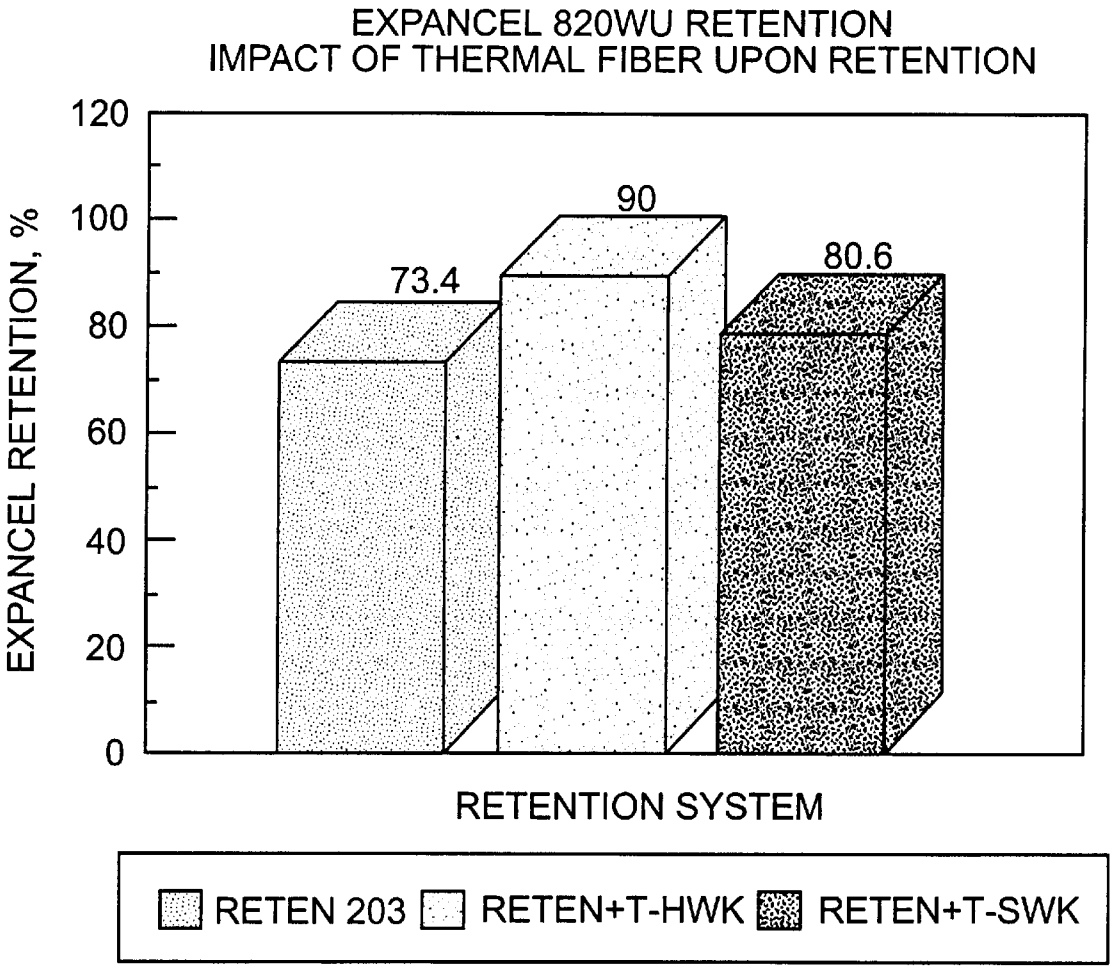
FIG. 31E is a bar graph depicting the percent microspheres retained into fiber board when thermal fibers in combination with Reten 203 are utilized.
Figure 32:
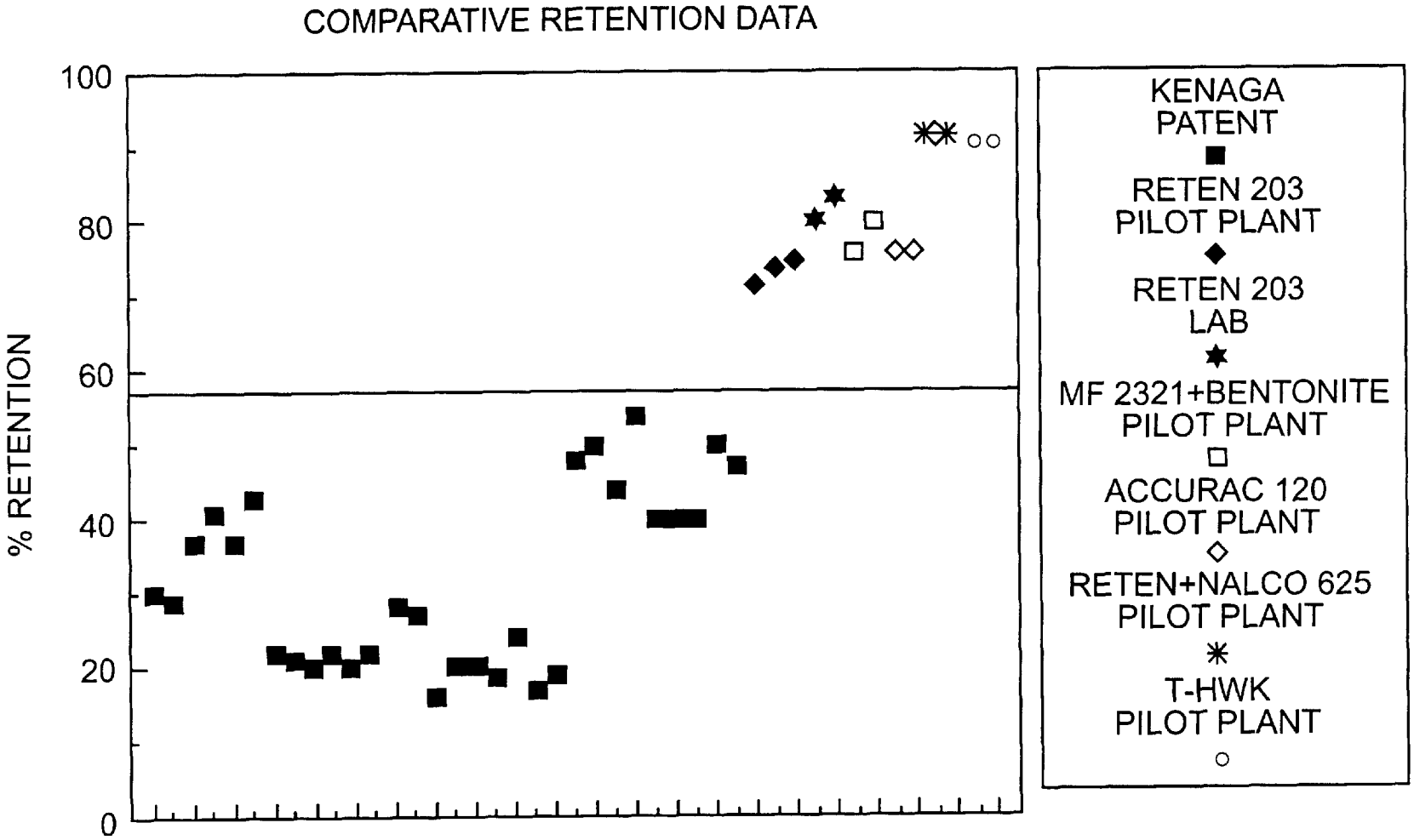
FIG. 32 is a graph depicting the percent microspheres retained in the fiber board when using the retention aids of this invention in comparison with the retention of microspheres in paper as shown by the prior art.
Figure 33:
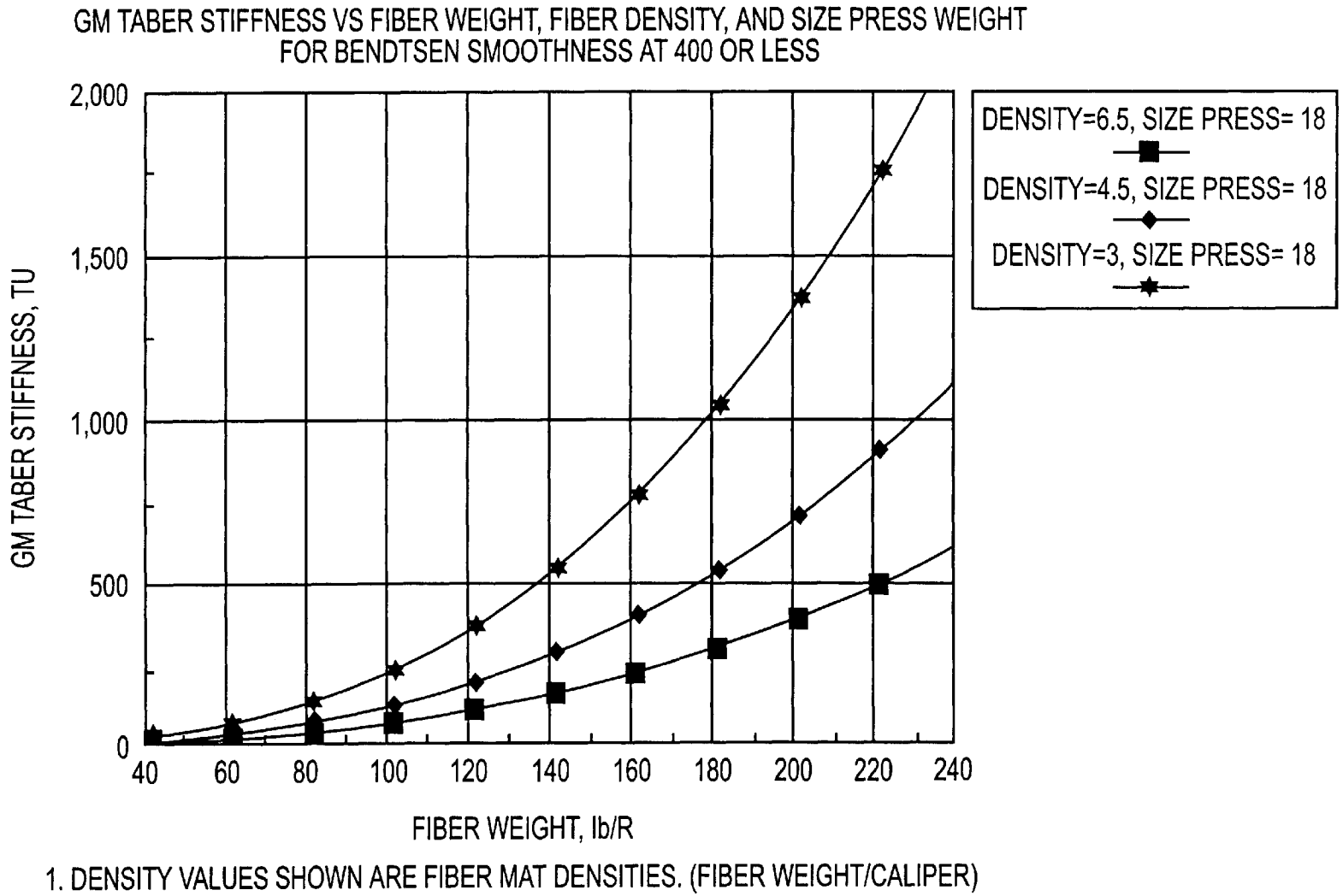
FIG. 33 is a graph depicting the improved GM Taber stiffness values for paperboards prepared according to the present invention with GM Taber stiffness values for boards available on the market.
Figure 34:
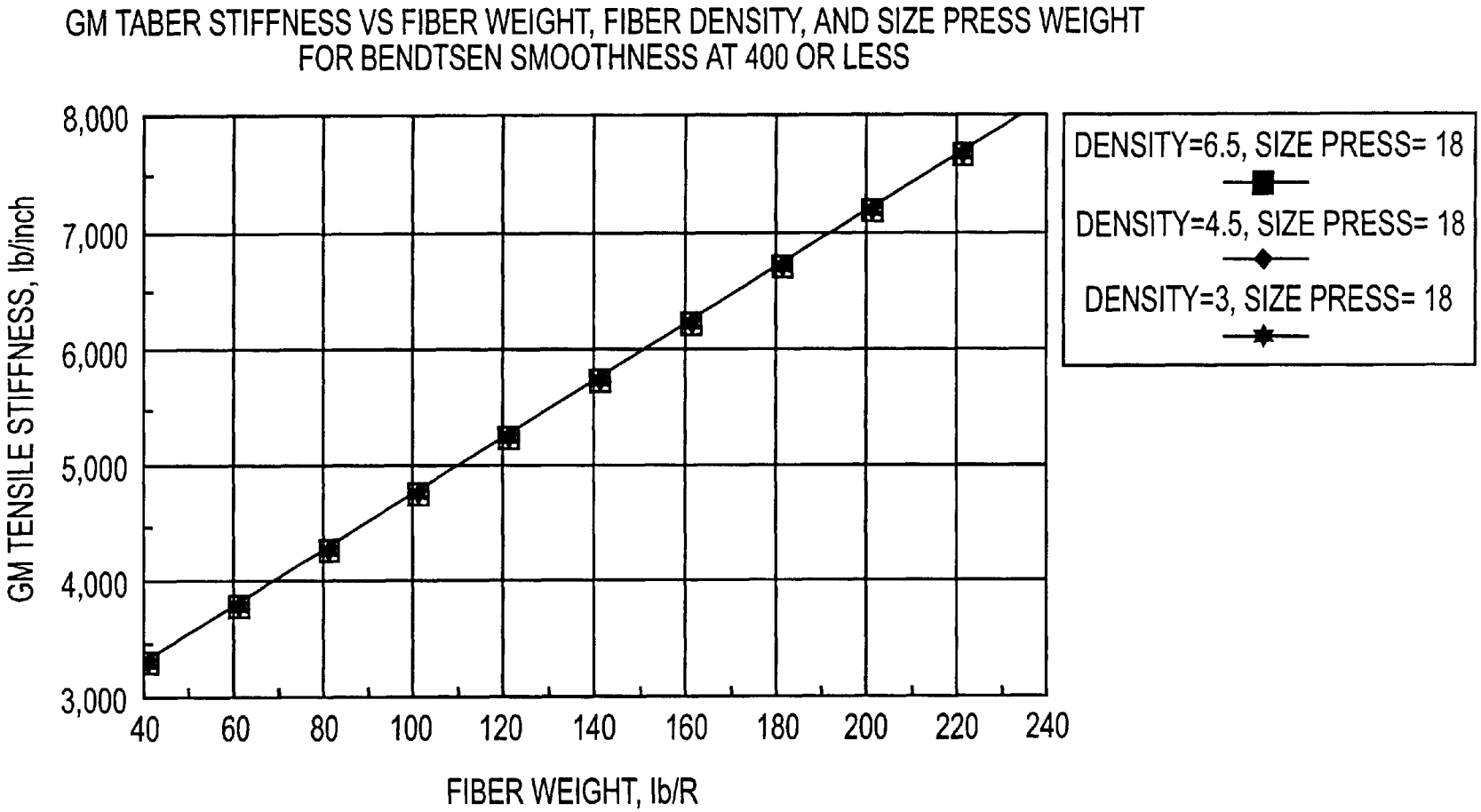
FIG. 34 is a graph depicting the improved GM tensile stiffness values for boards prepared according to the present invention with boards available on the market.

In Run 1, designated in FIG. 31E as Reten 203, the following chemicals per ton of cellulosic feedstock were charged at the machine chest [FIG. 29A (84)]: Alum, ten pounds, and Neuphor 635, six pounds. In this Run 1, the following chemicals per ton of cellulosic feedstock were charged at the stuff box [FIG. 29A (88)]: Apollo 600, eight pounds, and Reten 203, one half pound. In this Run 1, forty pounds of Expancel 820WU were charged at the fan pump [FIG. 29A (92)] for each ton of cellulosic feedstock.

Run 2 was a repetition of Run 1 except that fifty pounds of Expancel 820WU were also charged at the fan pump [FIG. 29A (92)] for each ton of cellulosic feedstock.

In Run 3, designated in FIG. 31E as Reten+T-HWK, the following chemicals per ton of cellulosic feedstock were charged at the machine chest [FIG. 29A (84)]: Alum, ten pounds; thermal hardwood fiber (T-HWK), four hundred pounds, and Neuphor 635, six pounds. In this Run 3, the following chemicals per ton of cellulosic feedstock were charged at the stuffbox [FIG. 29A (88)]: Apollo 800, eight pounds, and Reten 203, one half pound. Fifty pounds of Expancel 820WU for each ton of cellulosic feedstock were charged at the fan pump [FIG. 29A (92)].

In Run 4, designated in FIG. 31E as Reten+T-SWK, the following chemicals per ton of cellulosic feedstock were charged at the machine chest [FIG. 29A (84)]: Alum, ten pounds, thermal softwood fiber (S+HWK), four hundred pounds, and Neuphor 635, six pounds. In this Run 4, the following chemicals per ton of cellulosic feedstock were charged at the stuff box [FIG. 29A (88)]: Apollo 800, eight pounds, and Reten 203, one half pound. Fifty pounds of Expancel 820WU for each ton of cellulosic feedstock were charged at the fan pump [FIG. 29A (92)].

EXAMPLE 10

Runs were carried out to determine the increase in bulk properties of the paperboard achieved by the addition of the expandable microspheres.

Run 1. Please refer to FIG. 29. Hardwood Kraft (80) and Softwood Kraft (81) lap pulps (in the ratio of 75%:25%) were pulped and refined together using a Jordan refiner to a Canadian Standard Freeness of 523, pumped to the mix chest (83) and stored in the machine chest (84). Alum (85) was added to the stock and the pH was adjusted to pH 4.8 using sulfuric acid (86), and then rosin size (87) was added. This stock was pumped to the stuff box (88) and then starch (8 lb./ton) (89) and retention aid (0.5 lb./ton) (90) were added to the stock at the down leg of the stuff box (88). Expancel® 820 (90) was added to the stock just ahead of the fan pump (92) at the rate of 50 lb./ton of cellulosic feedstock. This stock was then pumped via the fan pump (90) to the headbox of the paper machine (93) to form the web on the wire. This web was then pressed in the press section (95) and drying was started in contact with a Yankee dryer (96), the web was optionally calendered (97) and further drying was carried out using steam-heated drying cans in the drying section (97). The final dry web (~2.0% moisture) was then reeled up (99). The oven-dried fiber weight of the board was 105 lbs./3000 sq. ft.

Figure 9:
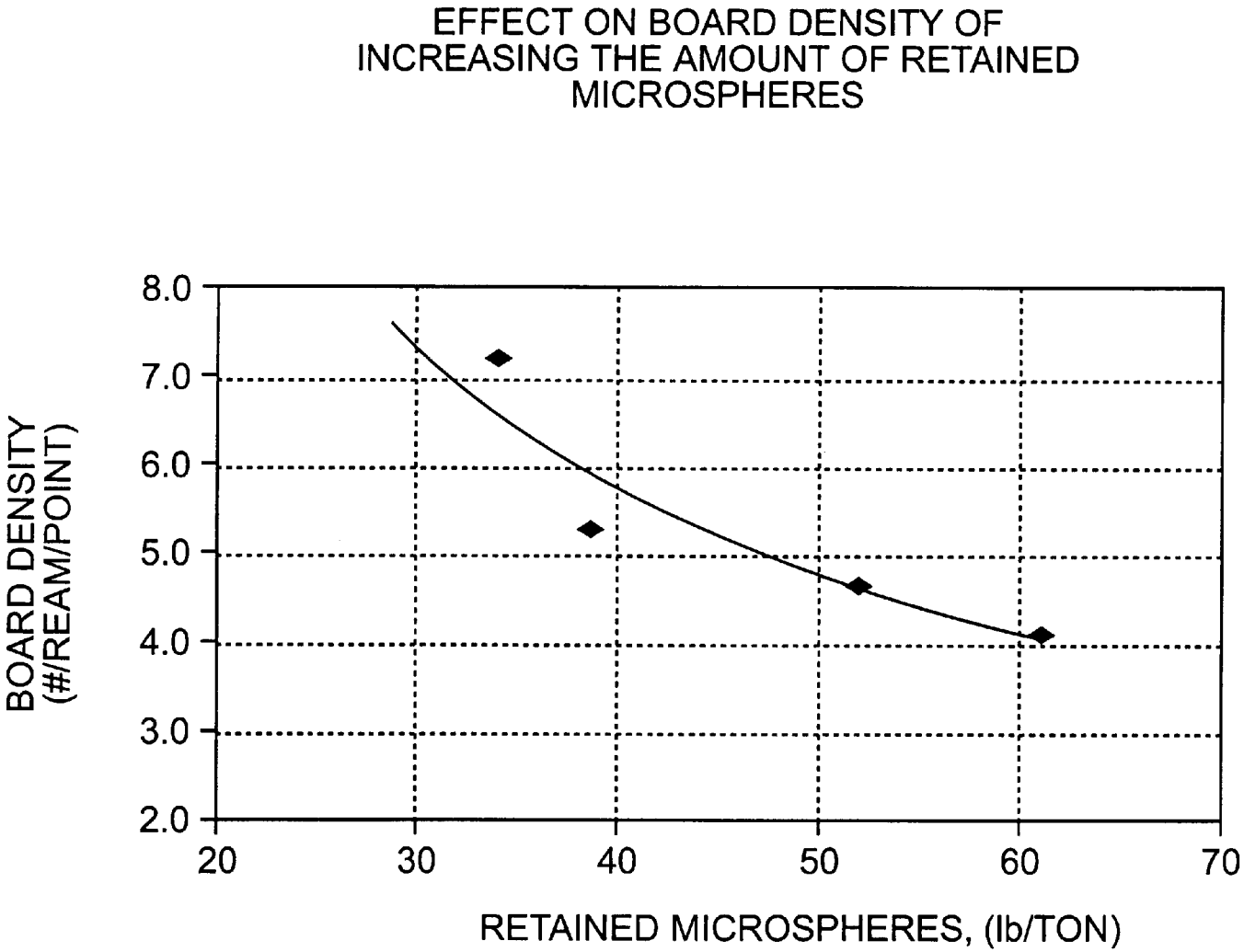
FIG. 9 is a graph depicting the effect on board density of increasing the amount of retained microspheres.

Runs 2, 3, and 4. Run 1 was then repeated using 60, 80, and 100 lbs. of the microspheres for each ton of the cellulosic feedstock and the caliper was found to increase as shown in Table 3. A graphical plot showing the relationship between bulk and the amount of retained microspheres is shown in FIG. 9.

TABLE 3

| | Run 1 | Run 2 | Run 3 | Run 4 |
|---|---|---|---|---|
| Fiber weight (lbs./3000 sq. ft. ream) | 112 | 112 | 112 | 112 |
| Expancel ® addition (lb./ton) | 50.0 | 60.0 | 80.0 | 100.0 |
| Retention Aid (lb./ton) | 33.9 | 38.5 | 51.9 | 61.0 |
| Retention (%) | 67.8 | 64.2 | 64.9 | 61.0 |
| Caliper ($\mu$) | 15.5 | 21.0 | 24.0 | 27.0 |
| Density (lb./3000 sq. ft. ream/$\mu$) | 7.23 | 5.34 | 4.67 | 4.15 |

EXAMPLE 11

Twelve runs were conducted using the procedure of Example 10. The superior retention of the microspheres and the excellent properties of the bulk enhanced board produced in Runs 1–12 is set forth in Tables 4 through 6.

TABLE 4A

| | Run 1 | Run 2 | Run 3 | Run 4 | Run 5 | Run 6 | Run 7 | Run 8 | Run 9 | Run 10 | Run 11 | Run 12 |
|---|---|---|---|---|---|---|---|---|---|---|---|---|
| | | | | | 90 pound ream | | | | | | | |
| Expancel-820 | 0 | 50 | 75 | 0 | 50 | 75 | 0 | 50 | 75 | 0 | 50 | 75 |
| Alum | 10 | 10 | 10 | 10 | 10 | 10 | 10 | 10 | 10 | 10 | 10 | 10 |
| Apollo starch | 8 | 8 | 8 | 8 | 8 | 8 | 8 | 8 | 8 | 8 | 8 | 8 |
| Neuphor 635 | 6 | 6 | 6 | 6 | 6 | 6 | 6 | 6 | 6 | 6 | 6 | 6 |
| Accurac 120 | 1.5 | 1.5 | 1.5 | 1.5 | 1.5 | 1.5 | 1.5 | 1.5 | 1.5 | 1.5 | 1.5 | 1.5 |
| HBA | 0 | 0 | 0 | 5 | 5 | 5 | 10 | 10 | 10 | 15 | 15 | 15 |
| SWK | 25 | 25 | 25 | 20 | 20 | 20 | 15 | 15 | 15 | 10 | 10 | 10 |
| HWK | 75 | 75 | 75 | 75 | 75 | 75 | 75 | 75 | 75 | 75 | 75 | 75 |
| | | | | | DATA | | | | | | | |
| Basis Weight | 90 | 90 | 90 | 90 | 90 | 90 | 90 | 90 | 90 | 90 | 90 | 99 |
| Caliper | 12.0 | 16.0 | 20.5 | 12.0 | 17.5 | 22.5 | 13.0 | 19.0 | 23.0 | 16.0 | 19.0 | 26.0 |
| Density | 7.5 | 5.6 | 4.4 | 7.5 | 5.1 | 4.0 | 6.9 | 4.7 | 3.9 | 5.6 | 4.7 | 3.8 |
| Retained | 0.0 | 35.4 | 58.6 | 0 | 36.4 | 60.2 | 0 | 37.3 | 54.3 | 0 | 35.4 | 48.2 |
| % Retention | 0.0 | 70.8 | 78.1 | 0 | 72.8 | 80.3 | 0 | 74.6 | 72.4 | 0 | 70.8 | 64.3 |

TABLE 4B

| RUN # | | MUTEK Potential mV | MUTEK Charge μeq/g | Density Headbox % | CONSISTENCY Tray % | CONSISTENCY FPR % | Note |
|---|---|---|---|---|---|---|---|
| Blank | 75% HW + 25% SW (+ Alum + Neuphor) | −88.1 | −5.8 | | | | |
| 1 | 1.5#/t Accurac 120 + 0#/t Expancel | NA | NA | NA | NA | NA | 90#/ream |
| 2 | 1.5#/t Accurac 120 + 50#/t Expancel | −36.3 | −10.8 | 0.285 | 0.007 | 97.54 | 90#/ream |
| 3 | 1.5#/t Accurac 120 + 75#/t Expancel | −20.1 | −18.8 | 0.259 | 0.002 | 99.23 | 90#/ream |
| 4 | 5% HBA + 1.5#/t Accurac 120 + 0#/t Expancel | −11.8 | −31.3 | 0.268 | 0.001 | 99.63 | 90#/ream |
| 5 | 5% HBA + 1.5#/t Accurac 120 + 50#/t Expancel | 12.0 | 25.4 | 0.257 | 0.003 | 98.83 | 90#/ream |
| 6 | 5% HBA + 1.5#/t Accurac 120 + 75#/t Expancel | −58.0 | −20.2 | 0.277 | 0.003 | 98.92 | 90#/ream |
| 7 | 10% HBA + 1.5#/t Accurac 120 + 0#/t Expancel | −135.0 | −34.1 | 0.265 | 0.006 | 97.74 | 90#/ream |
| 8 | 10% HBA + 1.5#/t Accurac 120 + 50#/t Expancel | −110.6 | −17.4 | 0.284 | 0.003 | 98.94 | 90#/ream |
| 9 | 10% HBA + 1.5#/t Accurac 120 + 75#/t Expancel | −101.1 | −20.0 | 0.305 | 0.006 | 98.03 | 90#/ream |
| 10 | 15% HBA + 1.5#/t Accurac 120 + 0#/t Expancel | −4.0 | −5.9 | 0.279 | 0.006 | 97.85 | 90#/ream |
| 11 | 15% HBA + 1.5#/t Accurac 120 + 50#/t Expancel | −54.0 | −16.9 | 0.286 | 0.006 | 97.90 | 90#/ream |
| 12 | 15% HBA + 1.5#/t Accurac 120 + 75#/t Expancel | −75.0 | −20.3 | 0.318 | 0.006 | 98.11 | 90#/ream |

TABLE 5

| Run # | 1 | 2 | 3 | 4 | 5 | 6 | 7 | 8 | 9 | 10 | 11 | 12 |
|---|---|---|---|---|---|---|---|---|---|---|---|---|
| Nip PSIG | "18/19 | "18/19 | "18/19 | "18/19 | "18/19 | "18/19 | "18/19 | "18/19 | "18/19 | "18/19 | "18/19 | "18/19 |
| Yan. Steam PSIG/C' | "0/160 | "0/160 | "0/160 | "0/160 | "0/160 | "0/160 | "0/160 | "0/160 | "0/160 | "0/160 | "0/160 | "0/160 |
| Blade Angle | MG | MG | MG | MG | MG | MG | MG | MG | MG | MG | MG | MG |
| Vacuum " of Hg | | | | | | | | | | | | |
| Felt Inside | 15.0 | 15.0 | 15.0 | 15.0 | 15.0 | 15.0 | 15.0 | 15.0 | 15.0 | 15.0 | 15.0 | 15.0 |
| Felt Outside | 18.0 | 18.0 | 18.0 | 18.0 | 18.0 | 18.0 | 18.0 | 18.0 | 18.0 | 18.0 | 18.0 | 18.0 |
| Pickup Shoe | 12.5 | 12.5 | 12.5 | 12.5 | 12.5 | 12.5 | 12.5 | 12.5 | 12.5 | 12.5 | 12.5 | 12.5 |
| Position p.u. Shoe | D-20 | D-20 | D-20 | D-20 | D-20 | D-20 | D-20 | D-20 | D-20 | D-20 | D-20 | D-20 |
| Additives in Chest - Alum | | | | | | | | | | | | |
| Pounds/T Add On | 10.0 | 100 | 100 | 100 | 100 | 10.0 | 10.0 | 10.0 | 10.0 | 10.0 | 10.0 | 10.0 |
| OD Pounds Needed | 0.60 | 0.60 | 0.60 | 0.60 | 0.60 | 0.60 | 0.60 | 0.60 | 0.60 | 0.60 | 0.60 | 0.60 |
| Additives in Chest - Neuphor 635 | | | | | | | | | | | | |
| Pounds/T Add On (Sizing) | 6.0 | 6.0 | 6.0 | 6.0 | 6.0 | 6.0 | 6.0 | 6.0 | 6.0 | 6.0 | 6.0 | 6.0 |
| OD Pounds Needed | 0.36 | 0.36 | 0.36 | 0.36 | 0.36 | 0.36 | 0.36 | 0.36 | 0.36 | 0.36 | 0.36 | 0.36 |
| Additives - DN Leg - Apollo 600 | | | | | | | | | | | | |
| Pounds/T Add On (Starch) | 8.0 | 8.0 | 8.0 | 8.0 | 8.0 | 8.0 | 8.0 | 8.0 | 8.0 | 8.0 | 8.0 | 8.0 |
| "% Solids | 5.00 | 5.00 | 5.00 | 5.00 | 5.00 | 5.00 | 5.00 | 5.00 | 5.00 | 5.00 | 5.00 | 5.00 |
| Mil's Added/Min. | 25.4 | 25.4 | 25.4 | 25.4 | 25.4 | 25.4 | 25.4 | 25.4 | 25.4 | 25.4 | 25.4 | 25.4 |
| Additives - DN Leg - Accurac 120 | | | | | | | | | | | | |
| Pounds/T Add On | 1.5 | 1.5 | 1.5 | 1.5 | 1.5 | 1.5 | 1.5 | 1.5 | 1.5 | 1.5 | 1.5 | 1.5 |
| "% Solids | 0.35 | 0.35 | 0.35 | 0.35 | 0.35 | 0.35 | 0.35 | 0.35 | 0.35 | 0.35 | 0.35 | 0.35 |
| Mil's Added/Min. | 68.0 | 68.0 | 68.0 | 68.0 | 68.0 | 68.0 | 68.0 | 68.0 | 68.0 | 68.0 | 68.0 | 68.0 |
| Additives - Fan Pump - Spheres (Keep Under Constant Agitation) | | | | | | | | | | | | |
| Pounds/T Add On | 0.0 | 50.0 | 75.0 | 0.0 | 50.0 | 75.0 | 0.0 | 50.0 | 75.0 | 0.0 | 50.0 | 75.0 |
| "% Solids | 4.00 | 4.00 | 4.00 | 4.00 | 4.00 | 4.00 | 4.00 | 4.00 | 4.00 | 4.00 | 4.00 | 4.00 |
| Mil's Added/Min. | 0.0 | 198.5 | 297.7 | 0.0 | 198.5 | 297.7 | 0.0 | 198.5 | 297.7 | 0.0 | 198.5 | 297.7 |

The order of addition was alum, sulfuric acid to adjust the pH, and neuphor. The HBA pulp was passed through an open refiner to remove nits.

TABLE 6A

| Run # | 1 | 2 | 3 | 4 | 5 | 6 | 7 | 8 | 9 | 10 | 11 | 12 |
|---|---|---|---|---|---|---|---|---|---|---|---|---|
| Conditions | | | | | | | | | | | | |
| Naheola HWK | 75% | 75% | 75% | 75% | 75% | 75% | 75% | 75% | 75% | 75% | 75% | 75% |
| Naheola SWK | 25% | 25% | 25% | 20% | 20% | 20% | 15% | 15% | 15% | 10% | 15% | 15% |
| HBA | 0% | 0% | 0% | 5% | 5% | 5% | 10% | 10% | 10% | 15% | 15% | 15% |
| M.C. Batch Size | 120.0 | 120.0 | 120.0 | 120.0 | 120.0 | 120.0 | 120.0 | 120.0 | 120.0 | 120.0 | 120.0 | 120.0 |
| Starting CSF | 650 | 650 | 650 | 650 | 650 | 650 | 650 | 650 | 650 | 650 | 650 | 650 |
| Refiner Jordan (Cone) Set Points - 95 AMPS/800 RPM | | | | | | | | | | | | |
| Refining Time - Kraft | "40 Min's | "40 Min's | "40 Min's | "40 Min's | "40 Min's | "40 Min's | "40 Min's | "40 Min's | "40 Min's | "40 Min's | "40 Min's | "40 Min's |
| CSF @ M.C. | 505 | 505 | 505 | 524 | 524 | 524 | 526 | 526 | 526 | 604 | 604 | 604 |
| Inches in Tank | 53.0 | 53.0 | 53.0 | 53.0 | 53.0 | 53.0 | 53.0 | 53.0 | 53.0 | 53.0 | 53.0 | 53.0 |

TABLE 6B

| Run # | 1 | 2 | 3 | 4 | 5 | 6 |
|---|---|---|---|---|---|---|
| Headbox Vacuum #1 | 4.0 | 4.0 | 4.0 | 4.0 | 4.0 | 4.0 |
| Headbox Vacuum #2 | 2.5 | 2.5 | 2.5 | 2.5 | 2.5 | 2.5 |
| Headbox Vacuum #3 | 3.5 | 3.5 | 3.5 | 3.5 | 3.5 | 3.5 |
| Headbox Vacuum #4 | 2.0 | 2.0 | 2.0 | 2.0 | 2.0 | 2.0 |
| Inches of H2O #5 | 4.0 | 4.0 | 4.0 | 4.0 | 4.0 | 4.0 |
| Pond Height | "6.5" | "6.5" | "6.5" | "6.5" | "6.5" | "6.5" |
| Manifold Position | "15.0" | "15.0" | "15.0" | "15.0" | "15.0" | "15.0" |
| | | | Stock Flow | | | |
| Loop #1 GPM | 8.53 | 8.53 | 8.53 | 8.53 | 8.53 | 8.53 |
| "% Consistency | 0.99 | 0.99 | 0.99 | 0.99 | 0.99 | 0.99 |
| | | | White Water | | | |
| Loop #3 GPM | 35.0 | 35.0 | 35.0 | 35.0 | 35.0 | 35.0 |
| "% Consistency | 0.24 | 0.24 | 0.24 | 0.24 | 0.24 | 0.24 |
| Machine Chest PH | 4.8 | 4.8 | 4.8 | 4.8 | 4.8 | 4.8 |
| Wire FPM | 20.0 | 20.0 | 20.0 | 20.0 | 20.0 | 20.0 |
| Felt FPM | "2.8/20.5 | "2.8/20.5 | "2.8/20.5 | "2.8/20.5 | "2.8/20.5 | "2.8/20.5 |
| Yankee FPM | 20.3 | 20.3 | 20.3 | 20.3 | 20.3 | 20.3 |
| "%Crepe | −1.5% | −1.5% | −1.5% | −1.5% | −1.5% | −1.5% |
| | | | Calender FPM | | | |
| Can, S/FPM | "−.7/20.3 | "−.7/20.3 | "−.7/20.3 | "−.7/20.3 | "−.7/20.3 | "−.7/20.3 |
| Reel #2 FPM | 20.0 | 20.0 | 20.0 | 20.0 | 20.0 | 20.0 |
| Basis Wt. | 91.80 | 91.80 | 91.80 | 91.80 | 91.80 | 91.80 |
| A.D. @ 2.0% | | | | | | |
| Basis Wt. O.D. | 90.0 | 90.0 | 90.0 | 90.0 | 90.0 | 90.0 |
| Amt. Made | 600 | 600 | 600 | 600 | 600 | 600 |
| Time Start | "10:30 | "2:30 | "1:45 | "11:45 | "12:15 | "1:00 |
| Rolls Needed | 1 | 1 | 1 | 1 | 1 | 1 |
| Min's Needed | 30 | 30 | 30 | 30 | 30 | 30 |
| OD #/Min. | 0.7000 | 0.7000 | 0.7000 | 0.7000 | 0.7000 | 0.7000 |

| Run # | 7 | 8 | 9 | 10 | 11 | 12 |
|---|---|---|---|---|---|---|
| Headbox Vacuum #1 | 4.0 | 4.0 | 4.0 | 4.0 | 4.0 | 4.0 |
| Headbox Vacuum #2 | 2.5 | 2.5 | 2.5 | 2.5 | 2.5 | 2.5 |
| Headbox Vacuum #3 | 3.5 | 3.5 | 3.5 | 3.5 | 3.5 | 3.5 |
| Headbox Vacuum #4 | 2.0 | 2.0 | 2.0 | 2 0 | 2.0 | 2.0 |
| Inches of H2O #5 | 4.0 | 4.0 | 4.0 | 4.0 | 4.0 | 4.0 |
| Pond Height | "6.5" | "6.5" | "6.5" | "6.5" | "6.5" | "6.5" |
| Manifold Position | "15.0" | "15.0" | "15.0" | "15.0" | "15.0" | "15.0" |
| | | | Stock Flow | | | |
| Loop #1 GPM | 8.53 | 8.53 | 8.53 | 8.53 | 8.53 | 8.53 |
| "% Consistency | 0.99 | 0.99 | 0.99 | 0.99 | 0.99 | 0.99 |
| | | | White Water | | | |
| Loop #3 GPM | 35.0 | 35.0 | 35.0 | 35.0 | 35.0 | 35.0 |
| "% Consistency | 0.24 | 0.24 | 0.24 | 0.24 | 0.24 | 0.24 |
| Machine Chest PH | 4.8 | 4.8 | 4.8 | 4.8 | 4.8 | 4.8 |
| Wire FPM | 20.0 | 20.0 | 20.0 | 20.0 | 20.0 | 20.0 |
| Felt FPM | "2.8/20.5 | "2.8/20.5 | "2.8/20.5 | "2.8/20.5 | "2.8/20.5 | "2.8/20.5 |
| Yankee FPM | 20.3 | 20.3 | 20.3 | 20.3 | 20.3 | 20.3 |
| "% Crepe | −1.5% | −1.5% | −1.5% | −1.5% | −1.5% | −1.5% |
| | | | Calender FPM | | | |
| Can, S/FPM | "−.7/20.3 | "−.7/20.3 | "−.7/20.3 | "−.7/20.3 | "−.7/20.3 | "−.7/20.3 |
| Reel #2 FPM | 20.0 | 20.0 | 20.0 | 20.0 | 20.0 | 20.0 |
| Basis Wt. | 91.80 | 91.80 | 91.80 | 91.80 | 91.80 | 91.80 |
| A.D. @ 2.0% | | | | | | |
| Basis Wt. O.D. | 90.0 | 90.0 | 90.0 | 90.0 | 90.0 | 90.0 |
| Amt. Made | 600 | 600 | 600 | 600 | 600 | 600 |
| Time Start | "10:15 | "10:45 | "11:30 | "1:25 | "2:05 | "2:45 |
| Rolls Needed | 1 | 1 | 1 | 1 | 1 | 1 |
| Min's Needed | 30 | 30 | 30 | 30 | 30 | 30 |
| OD #/Min. | 0.7000 | 0.7000 | 0.7000 | 0.7000 | 0.7000 | 0.7000 |

EXAMPLE 12

Thirty runs were conducted using the procedure of Examples 10 and 11. In Table 7 the superior properties of the

TABLE 7

| | Run # | 1 | 2 | 3 | 4 | 5 | 6 | 7 | 8 | 9 | 10 | 11 |
|---|---|---|---|---|---|---|---|---|---|---|---|---|
| | Retention System | Reten | Reten | Reten Nalco | Reten Nalco | Reten Nalco | Accurac | Accurac | Accurac | Polymin | Polymin | Polymin |
| Dry | Tensile Load at Max Load MD 48 T | 41.36 | 24.75 | 29.75 | 28.37 | 40.01 | 38.27 | 31.46 | 31.57 | 42.93 | 34.23 | 28.94 |
| Dry | Stretch % Strain at Max Load MD 48 T | 2.471 | 2.226 | 2.058 | 2.248 | 2.505 | 2.335 | 2.102 | 2.164 | 2.748 | 2.357 | 2.226 |
| Dry | TEA MD 48 T | 0.720 | 0.381 | 0.412 | 0.433 | 0.704 | 0.622 | 0.445 | 0.462 | 0.842 | 0.555 | 0.444 |
| Dry | Modulus psi/100 MD 48 T | 482.2 | 173.9 | 242.3 | 196.8 | 460.8 | 422.2 | 248.3 | 221.2 | 481.9 | 291.3 | 214.5 |
| Dry | Caliper mils MD 48 T | 10.4 | 17.1 | 15.1 | 16.8 | 10.6 | 11.3 | 14.8 | 16.8 | 10.8 | 13.8 | 15.9 |
| Dry | Tensile Load at Max Load CD 48 T | 25.01 | 19.56 | 23.50 | 19.96 | 29.94 | 27.93 | 22.07 | 20.88 | 26.71 | 22.79 | 20.65 |
| Dry | Stretch % Strain at Max Load CD 48 T | 3.045 | 2.785 | 2.871 | 2.863 | 3.471 | 3.277 | 2.948 | 3.018 | 3.338 | 3.120 | 2.980 |
| Dry | TEA CD 48 T | 0.569 | 0.400 | 0.485 | 0.412 | 0.768 | 0.683 | 0.470 | 0.454 | 0.662 | 0.521 | 0.445 |
| Dry | Modulus psi 1000 CD 48 T | 275.9 | 131.9 | 176.0 | 333.0 | 320.5 | 309.5 | 163.4 | 143.0 | 315.2 | 202.1 | 155.3 |
| Dry | Caliper mils CD 48 T | 10.8 | 17.3 | 15.1 | 16.8 | 10.8 | 10.7 | 15.4 | 16.4 | 10.6 | 13.4 | 1.55 |
| Wet | Tensile Load at Max Load MW 48 T | 2.07 | 2.81 | 2.08 | 2.68 | 1.88 | 1.49 | 2.00 | 2.51 | 2.27 | 2.71 | 2.96 |
| Wet | Stretch % Strain at Max Load MW 48 T | 2.172 | 2.927 | 2.100 | 2.852 | 2.002 | 1.777 | 2.143 | 2.383 | 2.236 | 2.744 | 3.102 |
| Wet | TEA MW 48 T | 0.036 | 0.058 | 0.033 | 0.055 | 0.030 | 0.023 | 0.032 | 0.046 | 0.039 | 0.055 | 0.068 |
| Wet | Tensile Load at Max Load CW 48 T | 1.63 | 1.87 | 1.75 | 1.59 | 1.46 | 1.08 | 1.31 | 1.73 | 1.81 | 2.20 | 2.20 |
| Wet | Stretch % Strain at Max Load CW 48 T | 3.013 | 3.717 | 2.954 | 2.760 | 2.533 | 2.395 | 2.610 | 3.111 | 3.269 | 3.468 | 3.458 |
| Wet | TEA CW 48 T gm/sqm | 0.038 | 0.050 | 0.037 | 0.032 | 0.028 | 0.020 | 0.026 | 0.040 | 0.3044 | 0.053 | 0.053 |
| Wet | Cobb Lbl $H_2O$ Absorb | 28.5 | 21.5 | 26.8 | 24.3 | 30.6 | 33.0 | 25.5 | 28.3 | 29.2 | 24.8 | 22.9 |
| Wet | Taber Avg MD units | 22.3 | 37.4 | 36.2 | 44.1 | 37.4 | 23.0 | 33.2 | 41.6 | 23.1 | 32.1 | 36.3 |
| Wet | Taber Avg CD units | 14.8 | 25.5 | 26.9 | 28.2 | 15.4 | 14.3 | 24.4 | 30.8 | 15.5 | 26.1 | 25.7 |
| | Run # | 12 | 13 | 14 | 15 | 16 | 17 | 18 | 19 | 20 | 22 | 30 |
| | Retention System | Polymin Nalco | Polymin Nalco | Polymin Nalco | Reten HBA | Reten HBA | Reten HBA | Accurac HBA | Accurac HBA | Accurac HBA | Accurac HBA | Accurac HBA |
| Dry | Tensile Load at Max Load MD 48 T | 37.82 | 30.80 | 29.40 | 26.89 | 24.04 | 21.36 | 26.58 | 20.72 | 18.33 | 19.30 | 20.25 |
| Dry | Stretch % Strain at Max Load MD 48 T | 2.390 | 2.193 | 2.368 | 2.062 | 2.313 | 2.285 | 1.995 | 2.071 | 1.884 | 1.870 | 2.555 |
| Dry | TEA MD 48 T | 0.637 | 0.470 | 0.479 | 0.395 | 0.397 | 0.343 | 0.377 | 0.299 | 0.241 | 0.248 | 0.361 |
| Dry | Modulus psi/1000 MD 48 T | 456.0 | 247.5 | 199.1 | 251.1 | 156.7 | 117.4 | 230.3 | 125.8 | 98.7 | 103.1 | 59.1 |
| Dry | Caliper mils MD 48 T | 10.3 | 15.0 | 16.6 | 13.5 | 17.8 | 20.4 | 14.7 | 19.3 | 21.9 | 22.7 | 33.3 |
| Dry | Tensile Load at Max Load CD 48 T | 26.07 | 23.24 | 20.41 | 18.61 | 17.49 | 15.24 | 18.39 | 14.63 | 13.55 | 15.49 | 16.06 |
| Dry | Stretch % Strain at Max Load CD 48 T | 3.004 | 2.990 | 2.587 | 2.705 | 2.520 | 2.431 | 2.315 | 2.488 | 2.391 | 2.258 | 2.543 |
| Dry | TEA CD 48 T | 0.581 | 0.501 | 0.375 | 0.376 | 0.319 | 0.265 | 0.31 1 | 0.263 | 0.232 | 0.254 | 0.295 |
| Dry | Modulus psi/1000 CD 48 T | 306.9 | 180.7 | 137.7 | 173.2 | 112.4 | 86.7 | 166.6 | 82.5 | 69.3 | 84.0 | 49.2 |
| Dry | Caliper mils CD 48 T | 10.6 | 14.6 | 17.4 | 13.4 | 18.3 | 20.2 | 14.3 | 19.7 | 21.7 | 22.0 | 35.5 |
| Wet | Tensile Load at Max Load MW 48 T | 1.81 | 2.47 | 2.74 | 0.88 | 1.17 | 1.10 | 0.86 | 1.01 | 1.29 | 1.43 | 1.84 |
| Wet | Stretch % Strain at Max Load MW 48 T | 1.984 | 2.531 | 2.592 | 1.567 | 2.025 | 1.878 | 1.565 | 1.954 | 1.940 | 2.220 | 2.336 |
| Wet | TEA MW 48 T | 0.028 | 0.048 | 0.052 | 0.012 | 0.019 | 0.016 | 0.012 | 0.016 | 0.020 | 0.025 | 0.034 |
| Wet | Tensile Load at Max Load CW 48 T | 1.43 | 1.85 | 2.33 | 0.60 | 0.93 | 0.93 | 0.69 | 0.86 | 0.98 | 0.98 | 0.97 |
| Wet | Stretch % Strain at Max Load CW 48 T | 3.065 | 3.065 | 3.651 | 2.052 | 2.728 | 2.651 | 2.270 | 2.591 | 2.678 | 2.557 | 2.317 |
| Wet | TEA CW 48 T gm/sqm | 0.041 | 0.040 | 0.061 | 0.011 | 0.022 | 0.021 | 0.014 | 0.019 | 0.020 | 0.020 | 0.020 |
| Wet | Cobb Lbl $H_2O$ Absorb | 31.1 | 25.9 | 23.5 | 28.5 | 27.8 | 27.0 | 33.5 | 27.4 | 25.4 | 27.4 | 28.7 |
| Wet | Taber Avg MD units | 22.1 | 32.5 | 40.3 | 21.2 | 29.7 | 35.4 | 23.1 | 29.4 | 31.6 | 37.6 | 87.5 |
| Wet | Taber Avg CD units | 14.8 | 22.8 | 26.6 | 15.2 | 24.1 | 27.4 | 18.0 | 24.6 | 27.3 | 32.4 | 80.3 |

As is apparent from the foregoing specification and examples, the improved paperboard and the improved methods of the present invention may be used with various alterations and modifications which differ from those described above. The articles of manufacture formed from the paperboard of this invention include cartons, folding bulk enhanced board produced in Runs 1–30 are set forth. paper boxes, cups (FIGS. 23, 24, and 28), plates (FIG. 16), compartmented plates (FIG. 17), bowls (FIG. 18), canisters (FIG. 19), French fry sleeves (FIG. 20), hamburger clam shells (FIG. 21), rectangular take-out containers (FIG. 22), and food buckets (FIG. 25). For this reason, it is to be understood that the foregoing is intended to be merely illustrative and is not to be construed or interpreted as being restrictive or otherwise limiting of the present invention. Rather, the appended claims are to be construed to cover all equivalents failing within the scope and spirit of the invention.

We claim:

1. A cellulosic multi-ply paperboard comprising:

(a) predominantly cellulosic fibers;

(b) bulk and porosity enhancing additive interspersed with said cellulosic fibers in a controlled distribution throughout the thickness of said paperboard; and (c) size press applied binder coating, optionally including a pigment adjacent both surfaces of the paperboard and penetrating into the board to a controlled extent; the overall fiber weight "w" of the paperboard being at least about 40 lbs./3000 square foot ream (i) the distribution of the bulk and porosity enhancing additive throughout the thickness of the paperboard, and (ii) the penetration of the size press applied pigment coating into the board, both being controlled to simultaneously produce at a fiber mat density of 3, 4.5, 6.5, 7, 8.3, and 9 pounds per 3000 square foot ream at a fiberboard thickness of 0.001 inch respectively:

(A) a GM Taber stiffness of at least about 0.00716 $w^{2.63}$ grams-centimeter/fiber mat density$^{1.63}$ pounds per 3000 square foot ream at a fiberboard thickness of 0.001 inch; and (B) at a fiber mat density of about 3 to 9 pounds per 3000 square foot ream at a fiberboard thickness of 0.001 inch, a GM tensile stiffness of at least 1890+24.2 w pounds per inch.

2. The multi-ply paperboard of claim 1 wherein at a fiber mat density of 3, 4.5, 6.5, 7, 8.3, and 9 pounds per 3000 square foot ream at a fiberboard thickness of 0.001 inch respectively, the GM Taber stiffness is at least 0.00501 $w^{2.63}$ grams-centimeter/fiber mat density$^{1.63}$ pounds per 3000 square foot ream at a fiberboard thickness of 0.001 inch, and the GM tensile stiffness is at least 1323+24.2 w pounds per inch.

3. The multi-ply paperboard web of claim 2 wherein at a fiber mat density of 3, 4.5, 6.5, 7, and 8.3 pounds per 3000 square foot ream at a fiberboard thickness of 0.001 inch respectively, the GM Taber stiffness is at least 0.0084 $w^{2.63}$ grams-centimeter/fiber mat density$^{1.63}$ pounds per 3000 square foot ream at a fiberboard thickness of 0.001 inch, 0.00043 $w^{2.63}$ grams-centimeter/fiber mat density$^{1.63}$ pounds per 3000 square foot ream at a fiberboard thickness of 0.001 inch, 0.00024 $w^{2.63}$ grams-centimeter/fiber mat density$^{1.63}$ pounds per 3000 square foot ream at a fiberboard thickness of 0.001 inch, 0.00021 $w^{2.63}$ grams-centimeter/fiber mat density$^{1.63}$ pounds per 3000 square foot ream at a fiberboard thickness of 0.001 inch, and 0.00016 $w^{2.63}$ grams-centimeter/fiber mat density$^{1.63}$ pounds per 3000 square foot ream at a fiberboard thickness of 0.001 inch.

4. The multi-ply paperboard web of claim 3 wherein at a fiber mat density of 3, 4.5, 6.5, and 7 pounds per 3000 square foot ream at a fiberboard thickness of 0.001 inch respectively, the GM Taber stiffness is at least 0.0084 $w^{2.63}$ grams-centimeter/fiber mat density$^{1.63}$ pounds per 3000 square foot ream at a fiberboard thickness of 0.001 inch, 0.00043 $w^{2.63}$ grams-centimeter/fiber mat density$^{1.63}$ pounds per 3000 square foot ream at a fiberboard thickness of 0.001 inch, 0.00024 $w^{2.63}$ grams-centimeter/fiber mat density$^{1.63}$ pounds per 3000 square foot ream at a fiberboard thickness of 0.001 inch, and 0.00021 $w^{2.63}$ grams-centimeter/fiber mat density$^{1.63}$ pounds per 3000 square foot ream at a fiberboard thickness of 0.001 inch.

5. The paperboard web of claim 3 or claim 4 wherein the fiber weight of the multi-ply paperboard is at least about 60 lbs./3000 square foot ream.

6. The cellulosic multi-ply paperboard of claim 5 wherein the bulk and porosity enhancing additive interspersed with said cellulosic fibers in a controlled distribution throughout the thickness of said paperboard comprises expanded and/or unexpanded microspheres.

7. The paperboard of claim 6 comprising a plurality of expanded or unexpanded microspheres in a proportion of between about 10 lbs. to about 400 lbs. per ton of fiber and a retention aid in an amount sufficient to retain a sufficient portion of the microspheres in all layers within the paperboard.

8. The paperboard of claim 7 wherein the microspheres have a mean diameter ranging between about 0.5 to 60 microns in the unexpanded state and having a maximum expansion of between about 4 and 9 times the mean diameters.

9. The paperboard of claim 7 wherein the retention aid is diallyldimethyl ammonium chloride polymer having a molecular weight in excess of ninety thousand.

10. The paperboard of claim 7 wherein the retention aid is polyethylenimine having a molecular weight of about forty thousand to two million.

11. The paperboard of claim 10 wherein the polyethylenimine has a molecular weight of about five hundred thousand to two million.

12. The paperboard web of claim 7 wherein the retention aid is selected from the group consisting of polyacrylomides, acrylamide-acrylate polymers, cationic acrylamide copolymers, and mixtures of these having a molecular weight in the range of one hundred thousand to thirty million.

13. The paperboard web of claim 12 wherein the retention aid has a molecular weight of about ten to twenty million.

14. The paperboard of claim 1 wherein the bulk and porosity enhancing additive interspersed with said cellulosic fibers in a controlled distribution throughout the thickness of said paperboard comprises a mixture of anfractuous cellulosic fiber subjected to thermal and/or chemical treatment and expanded or unexpanded microspheres.

15. The paperboard of claim 1 wherein the bulk and porosity enhancing additive interspersed with said cellulosic fibers in a controlled distribution throughout the thickness of said paperboard comprises a mixture of HBA fiber and expanded or unexpanded microspheres.

16. The paperboard of claim 1 wherein the bulk and porosity enhancing additive interspersed throughout the thickness of said paperboard comprise continuously or discontinuously coated expanded or unexpanded microspheres.

17. The paperboard of claim 1 wherein the paperboard has been coated with a binder and an inorganic or organic pigment.

18. An article of manufacture formed from the paperboard of claim 17.

19. The article of manufacture of claim 18 in the form of a carton.

20. The article of manufacture of claim 18 in the form of a folding paper box.

21. The paperboard of claim 17 wherein the binder is selected from the group consisting of aliphatic acrylate acrylonitrile styrene copolymers, n-butyl acrylate acrylonitrile styrene copolymer, n-amyl acrylate acrylonitrile styrene copolymer, n-propyl acrylate acrylonitrile styrene copolymer, n-ethyl acrylate acrylonitrile styrene copolymer, aliphatic acrylate styrene copolymers, n-butyl acrylate styrene copolymer, n-amyl acrylate styrene copolymer, n-propyl acrylate styrene copolymer, n-ethyl acrylate styrene copolymer, cationic starch, anionic starch, amphoteric starch, starch latex copolymers, animal glue, gelatin, methyl cellulose, carboxymethylcellulose, polyvinyl alcohol, ethylene-vinyl acetate copolymer, vinyl acetate-acrylic copolymer, styrene-butadiene copolymer, ethylene-vinyl chloride copolymer, vinyl acetate polymer, vinyl acetate-ethylene copolymer, acrylic copolymer, styrene-acrylic copolymer, stearylated melamine, hydrophilic epoxy esters, and mixtures of these.

22. The paperboard of claim 17 wherein the pigment is selected from the group consisting of a clay, chalk, barite, silica, talc, bentonite, glass powder, alumina, titanium dioxide, graphite, carbon black, zinc sulfide, alumina silica, calcium carbonate, and mixtures of these.

23. The paperboard of claim 22 wherein the pigment is kaolin clay.

24. A cellulosic cup formed from the paperboard of claim 1.

25. A cellulosic plate formed from the paperboard of claim 1.

26. The cellulosic plate formed from the paperboard of claim 17.

27. The cellulosic plate of claim 25 in the form of a compartmented plate.

28. A cellulosic bowl formed from the paperboard of claim 1.

29. A cellulosic canister formed from the paperboard of claim 1.

30. A cellulosic rectangular take-out container formed from the paperboard of claim 1.

31. A cellulosic hamburger clam shell formed from the paperboard of claim 1.

32. A cellulosic French fry sleeve formed from the paperboard of claim 1.

33. A cellulosic food bucket container formed from the paperboard of claim 1.

34. An article of manufacture formed from the multi-ply cellulosic paperboard according to claim 1 wherein the bulk and porosity enhancing additive is in the form of expanded or unexpanded microspheres.

35. The article of manufacture of claim 34 wherein at a fiber mat density of 3, 4.5, 6.5, 7, 8.3, and 9 pounds per 3000 square foot ream at a fiberboard thickness of 0.001 inch respectively, the GM Taber stiffness is at least 0.00501 $w^{2.63}$ grams-centimeters/fiber mat density$^{1.63}$ pounds per 3000 square foot ream at a fiberboard thickness of 0.001 inch, and the GM tensile stiffness is at least 1323+24.2 w pounds per inch.

36. The article of manufacture of claim 35 wherein at a fiber mat density of 3, 4.5, 6.5, 7, and 8.3 pounds per 3000 square foot ream at a fiberboard thickness of 0.001 inch, respectively, the GM Taber stiffness of the paperboard is at least 0.0084 $w^{2.63}$ grams-centimeter/fiber mat density$^{1.63}$ pounds per 3000 square foot ream at a fiberboard thickness of 0.001 inch, 0.00043 $w^{2.63}$ grams-centimeter/fiber mat density$^{1.63}$ grams-centimeter/fiber mat density$^{1.63}$ pounds per 3000 square foot ream at a fiberboard thickness of 0.001 inch, 0.00024 $w^{2.63}$ grams-centimeter/fiber mat density$^{1.63}$ pounds per 3000 square foot ream at a fiberboard thickness of 0.001 inch, and 0.00021 $w^{2.63}$ grams-centimeter/fiber mat density$^{1.63}$ pounds per 3000 square foot ream at a fiberboard thickness of 0.001 inch, and 0.00016 $w^{2.63}$ grams-centimeter/fiber mat density$^{1.63}$ pounds per 3000 square foot ream at a fiberboard thickness of 0.001 inch, and the GM tensile stiffness is at least 1323+24.2 w pounds per inch.

37. The article of manufacture of claim 36 wherein at a fiber mat density of 3, 4.5, 6.5, and 7 pounds per 3000 square foot ream at a fiberboard thickness of 0.001 inch respectively, the GM Taber stiffness is at least 0.0084 $w^{2.63}$ grams-centimeters/fiber mat density$^{1.63}$ pounds per 3000 square foot ream at a fiberboard thickness of 0.001 inch, 0.00043 $w^{2.63}$ grams-centimeters/fiber mat density$^{1.63}$ pounds per 3000 square foot ream at a fiberboard thickness of 0.001 inch, 0.00024 $w^{2.63}$ grams-centimeters/fiber mat density$^{1.63}$ pounds per 3000 square foot ream at a fiberboard thickness of 0.001 inch, and 0.00021 $w^{2.63}$ grams-centimeters/fiber mat density$^{1.63}$ pounds per 3000 square foot ream at a fiberboard thickness of 0.001 inch, and the GM tensile stiffness is at least 1323+24.2 w pounds per inch.

38. The article of manufacture of claim 36 or claim 37 wherein the fiber weight of the paperboard is at least about 60 lbs./3000 square foot ream.

39. The article of manufacture of claim 38 in the form of a cup.

40. The article of manufacture of claim 38 in the form of a plate.

41. The plate of claim 40 in the form of a compartmented plate.

42. The article of manufacture of claim 38 in the form of a bowl.

43. The article of manufacture of claim 38 in the form of a canister.

44. The article of manufacture of claim 38 in the form of a rectangular take-out container.

45. The article of manufacture of claim 38 in the form of a hamburger clam shell.

46. The article of manufacture of claim 38 in the form of a French fry sleeve.

47. The article of manufacture of claim 38 in the form of a food bucket.

48. The article of manufacture of claim 36 or claim 37 coated on one or both sides with a coating resistant to moisture.

49. The article of manufacture of claim 48 in the form of a cup having an inner and outer surface which when filled with a liquid at 190° F., exhibits thermal insulative properties such that at room temperature and one atmosphere pressure the temperature of the outer surface does not reach a temperature of about 140° F.–145° F. in less than thirty seconds.

50. The cellulosic paperboard of claim 1 wherein the paperboard is coated with a grease resistant polymer including the fluorine moiety or is coated on one or both sides with a coating resistant to moisture.

51. The paperboard of claim 50 wherein one or both sides of the paperboard are coated with a chemical composition selected from the group consisting of polyolefin, nitrocellulose, methyl cellulose, carboxy methyl cellulose, ethylvinyl acetate copolymer, vinyl acetate copolymer, styrene butadiene copolymer, vinyl acetate copolymer, vinyl acrylic copolymer, styrene acrylic copolymer, and mixtures of these.

52. An article of manufacture made from the paperboard of claim 51.

53. The article of manufacture of claim 52 in the form of a cup.

54. The cup of claim 53 having an inner and an outer surface which when filled with a liquid at 190° F. exhibits thermal insulative properties such that at room temperature and one atmosphere pressure the outer surface does not reach a temperature of about 140° F.–145° F. in less than thirty seconds.

55. The article of manufacture of claim 52 in the form of a carton.

56. The article of manufacture of claim 52 in the form of a folding paper box.

57. The article of manufacture of claim 52 in the form of a plate.

58. The article of manufacture of claim 52 in the form of a compartmented plate.

59. The article of manufacture of claim 52 in the form of a bowl.

60. The article of manufacture of claim 52 in the form of a canister.

61. The article of manufacture of claim 52 in the form of a rectangular take-out container.

62. The article of manufacture of claim 52 in the form of a hamburger clam shell.

63. The article of manufacture of claim 52 in the form of a French fry sleeve.

64. The article of manufacture of claim 52 in the form of a food bucket.

65. The cup of claim 54 wherein one or both sides of the cup are coated with high density polyethylene.

66. The French fry sleeve of claim 63 prepared from the cellulosic paperboard of claim 50.

67. The cellulosic paperboard of claim 1 wherein the paperboard is coated on one or both sides with a wax having a melting point of about 130° F. to about 150° F.

68. An article of manufacture prepared from the paperboard of claim 1 wherein the article of manufacture is coated with a wax having a melting point of about 130° F. to about 150° F.

69. The article of manufacture of claim 68 in the form of a cup.

* * * * *